US010704370B2

(12) United States Patent
Rao et al.

(10) Patent No.: US 10,704,370 B2
(45) Date of Patent: Jul. 7, 2020

(54) SINGLE-WELL GAS-ASSISTED GRAVITY DRAINAGE PROCESS FOR OIL RECOVERY

(71) Applicant: BOARD OF SUPERVISORS OF LOUISIANA STATE UNIVERSITY AND AGRICULTURAL AND MECHANICAL COLLEGE, Baton Rouge, LA (US)

(72) Inventors: Dandina Rao, Baton Rouge, LA (US); Bikash D. Saikia, Baton Rouge, LA (US)

(73) Assignee: Board of Supervisors of Louisiana State University and Agricultural and Mechanical College, Baton Rouge, LA (US)

( * ) Notice: Subject to any disclaimer, the term of this patent is extended or adjusted under 35 U.S.C. 154(b) by 0 days.

(21) Appl. No.: 15/572,704

(22) PCT Filed: May 9, 2016

(86) PCT No.: PCT/US2016/031455
§ 371 (c)(1),
(2) Date: Nov. 8, 2017

(87) PCT Pub. No.: WO2016/183001
PCT Pub. Date: Nov. 17, 2016

(65) Prior Publication Data

US 2018/0149004 A1 May 31, 2018

Related U.S. Application Data

(60) Provisional application No. 62/158,840, filed on May 8, 2015.

(51) Int. Cl.
*E21B 43/16* (2006.01)
*E21B 43/30* (2006.01)

(52) U.S. Cl.
CPC ..... *E21B 43/164* (2013.01); *E21B 43/168* (2013.01); *E21B 43/305* (2013.01)

(58) Field of Classification Search
CPC ..... E21B 43/168; E21B 43/305
See application file for complete search history.

(56) References Cited

U.S. PATENT DOCUMENTS 2,769,913 A * 11/1956 Mazzagatti ..... E21B 47/1015 250/255
4,454,916 A * 6/1984 Shu ..... E21B 43/34 166/260

(Continued)

OTHER PUBLICATIONS

International Search Report and Written Opinion dated Aug. 16, 2016 in PCT/US2016/031455.

*Primary Examiner* — Shane Bomar
(74) *Attorney, Agent, or Firm* — Douglas C. Tsao; Williams Mullen

(57) ABSTRACT

Disclosed is a less expensive, more efficient process for enhanced oil recovery, particularly useful in high cost environments such as offshore. This process is known as single well gas assisted gravity drainage (SW-GAGD). The process comprises the steps of drilling from a single wellbore one or more horizontal laterals near the bottom of a payzone and injecting a fluid displacer such as nitrogen or carbon dioxide through injection points. The injectant sweeps the oil and other produced fluids in the reservoir towards other producing perforations in the single well.

8 Claims, 47 Drawing Sheets

(56) References Cited

U.S. PATENT DOCUMENTS

| | | | | |
|---|---|---|---|---|
| 4,638,863 | A * | 1/1987 | Wilson | E21B 43/2401 166/248 |
| 5,273,111 | A * | 12/1993 | Brannan | E21B 43/2406 166/245 |
| 5,626,193 | A | 5/1997 | Nzekwu et al. | |
| 2006/0289157 | A1 | 12/2006 | Rao | |
| 2009/0200024 | A1 * | 8/2009 | Ayasse | E21B 43/243 166/261 |
| 2011/0083855 | A1 | 4/2011 | Wygnanski | |
| 2012/0043081 | A1 | 2/2012 | Kjorholt | |
| 2014/0000888 | A1 | 1/2014 | Kerr | |
| 2014/0076555 | A1 * | 3/2014 | Kerr | E21B 43/2408 166/272.3 |
| 2014/0096950 | A1 * | 4/2014 | Pyecroft | E21B 43/26 166/247 |
| 2015/0007988 | A1 * | 1/2015 | Ayasse | E21B 43/17 166/271 |
| 2019/0010792 | A1 * | 1/2019 | Arthur | E21B 43/12 |

* cited by examiner

SINGLE-WELL GAS-ASSISTED GRAVITY DRAINAGE PROCESS FOR OIL RECOVERY

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

GOVERNMENT SUPPORT

None.

RELATED APPLICATIONS

None.

FIELD

The disclosed single-well gas assisted gravity drainage process (SW-GAGD) relates to enhanced oil recovery, particularly useful in high cost environments such as off-shore.

BACKGROUND

The presently used gas injection schemes for enhanced oil recovery (EOR), such as continuous gas injection (CGI) and water-alternating-gas (WAG) injection, have performed quite poorly in tens of field projects yielding recoveries of only about 5-10%. These are large field projects (about 70 WAG projects in the Permian Basis of Texas alone) and have shown commercial profitability and are considered technically and economically successful by the industry even with the low (5-10%) recoveries. The gas assisted gravity drainage process (GAGD or GAGD process) disclosed in U.S. Pat. No. 8,215,392, which is hereby incorporated by reference in its entirety, has demonstrated recoveries in the range of 65% to 95% in laboratory experiments conducted at reservoir conditions of pressures and temperatures. This conventional GAGD process is well suited to onshore formations where oil production has been occurring over the years through numerous vertical wells. However, each offshore deepwater well costs in excess of $200 Million. Even the major oil companies do not have the luxury of drilling patterns of several wells needed to implement multiple well enhanced recovery processes offshore. Most of the research accomplishments (not only in our labs at LSU but in the outside world) and field implementation of these research findings have occurred only in onshore reservoirs, where the well drilling costs are orders of magnitude less. Therefore, the offshore resources of crude oil need specially developed EOR processes that operate with minimum number of wells being drilled and are less costly. What is needed is a GAGD process suited to meet the special cost requirements of offshore reservoirs without losing the advantages of the GAGD process.

SUMMARY

The single-well GAGD process described herein satisfies the particular cost requirements for use in offshore reservoirs, and retains the advantage of high oil recoveries (65-95%) provided by the GAGD process. The single-well GAGD process (SW-GAGD or SW-GAGD process) is a cost-effective alternative to the GAGD process to accomplish similar recovery factors using simplified well configurations to minimize number of wells and hence the associated costs of its implementation. Minimizing number of wells needed to implement the process enhances its applicability in deepwater offshore reservoirs where each well costs in excess of $200 Million to drill. SW-GAGD processes generally involve enhancing oil recovery from onshore and offshore petroleum reservoirs by injecting a gas into the top of the payzone through perforations in the casing of a vertical well, and producing oil/water and gas through one of several horizontal or laterals of the well located at the bottom of the payzone through the vertical well.

The SW-GAGD process is applicable in all offshore oil reservoirs, such as in the Gulf of Mexico in the US and in offshore reservoirs all around the world. The estimated oil resources in the Gulf of Mexico along is in excess of 40 Billion barrels and nearly two-thirds of this resource (or nearly 26 Billion barrels) will be left behind at the conclusion of primary and secondary recovery process implementation due to the trapping caused by capillary forces. The SW-GAGD process is also applicable in many offshore reservoirs that have not been well developed or exploited for production so far, and as such may not have vertical wells available for implementing the conventional GAGD. Furthermore, SW-GAGD processes may be used in conjunction with GAGD in onshore reservoirs where some selected exiting vertical wells can be converted suitable to implement SW-GAGD. The prize for onshore EOR is over 400 Billion barrels in the United States alone and nearly 2 Trillion barrels around the world (according to United States Department of Energy and European Alliance publications).

DETAILED DESCRIPTION

Figure 1:
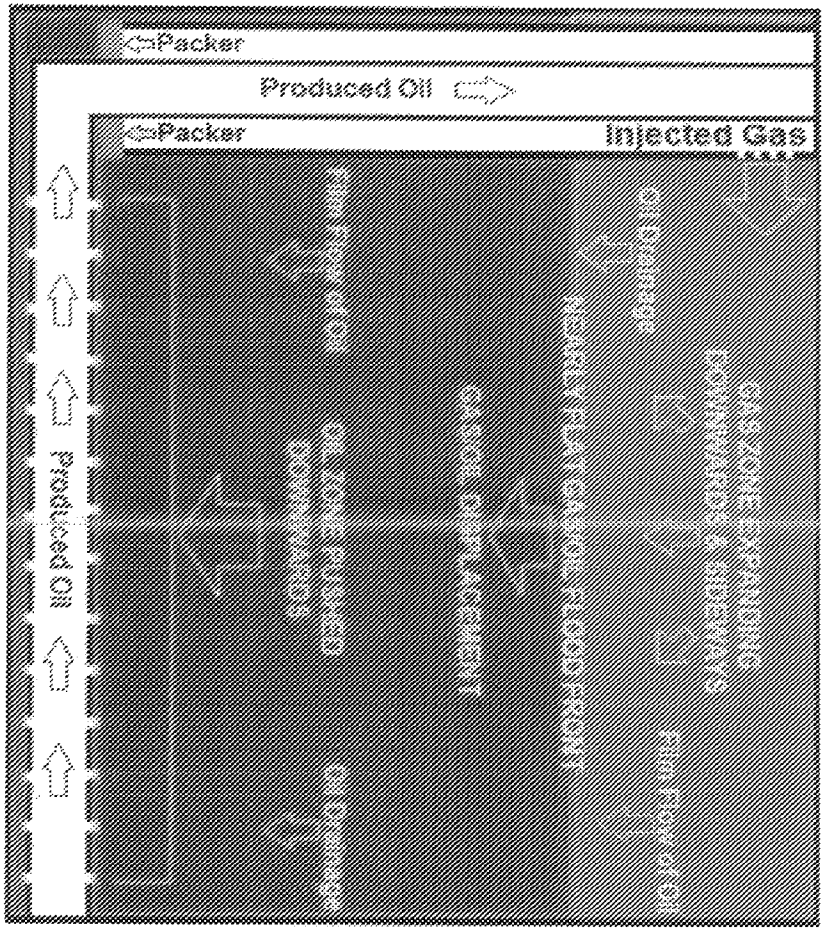
FIG. 1 is a Schematic representation of an embodiment the Single-Well Gas-Assisted Gravity Drainage (SW-GAGD) Process for Enhanced Oil Recovery.
Figure 2A:
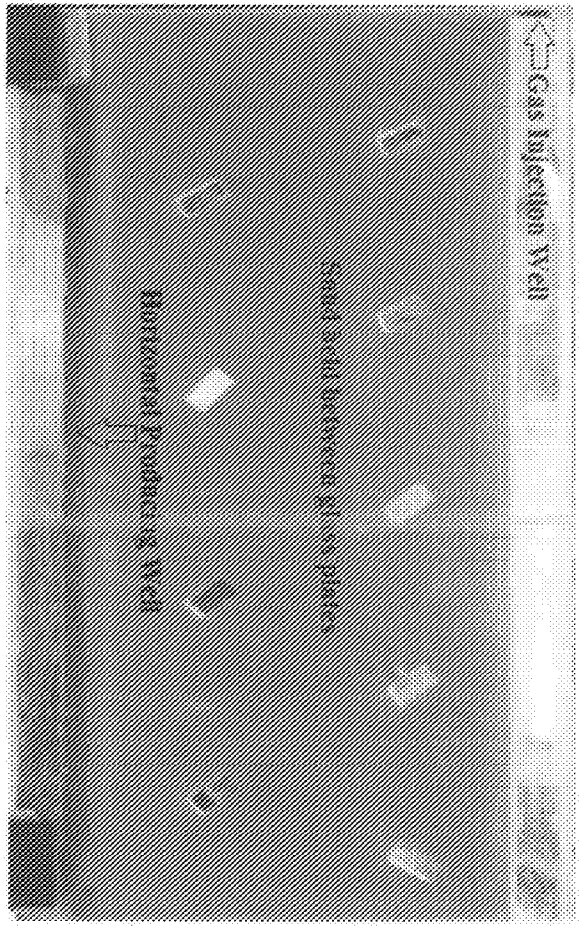
FIG. 2A is a Layout of the Laboratory Sandpack Model Designed to Test SW-GAGD Process.
Figure 2B:
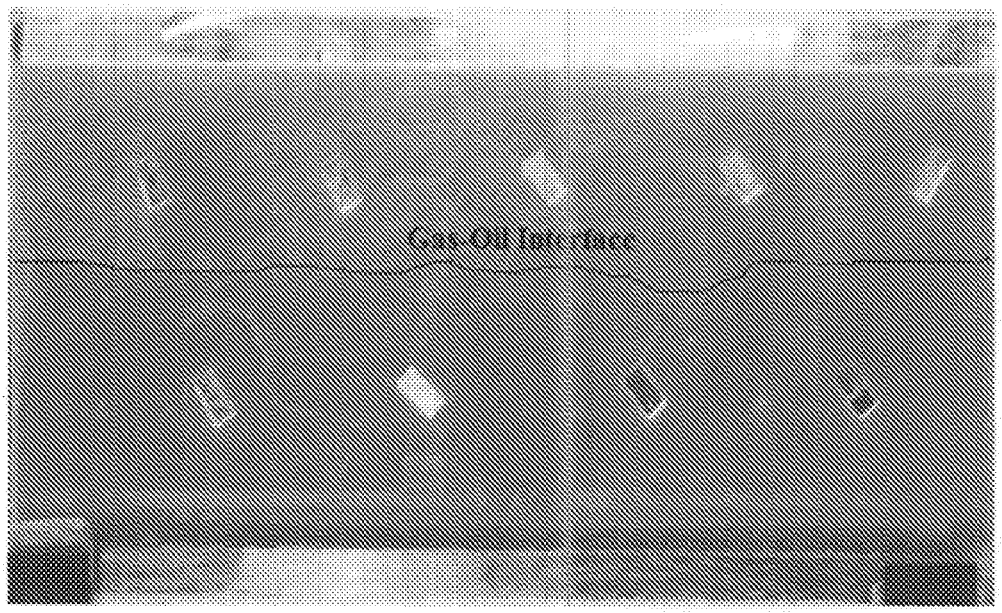
FIG. 2B shows the Progress of SW-GAGD Process Showing Gas-Oil Interface.
Figure 2C:
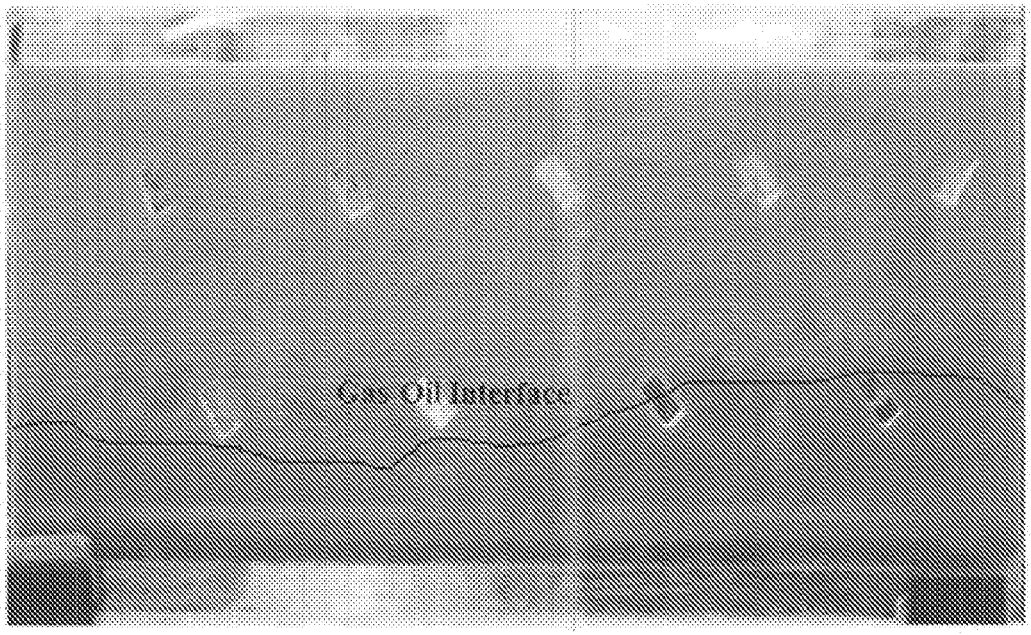
FIG. 2C shows SW-GAGD Displaying De-saturated Zone at the Top and the Gas-Oil Interface near the Bottom.

The SW-GAGD process generally involves enhancing oil recovery from onshore and offshore petroleum reservoirs by injecting a gas (such as, for example, CO2, nitrogen, flue gas, acid gas such as mixtures of H2S and CO2, and/or any other gaseous phase) into the top of the payzone through perforations in the casing of a vertical well and producing oil/water and gas through one of several horizontal or laterals at the bottom of the payzone, all through the same vertical well. A schematic of the SW-GAGD process is attached in FIG. 1. FIGS. 2A, 2B and 2C show the progressive advance of the SW-GAGD process in a laboratory physical model having two parallel plates with the gap being filled with sand saturated with red-dyed oil. As can be seen, the injected gas (CO2 in the laboratory experiments) accumulates at the top of the payzone enabling gravity drainage of oil downward towards the producing horizontal wells(s). The main advantage of this process is its use of a single vertical wellbore and multiple lateral wells to accomplish enhanced oil recovery (EOR). The conventional GAGD process (which was developed by this inventor at LSU and which is currently patented as U.S. Pat. No. 8,215,392 B2, dated Jul. 10, 2012) utilizes existing vertical wells in oil fields for gas injection and horizontal wells drilled at the bottom of a payzone for producing the draining oil.

Figure 3:
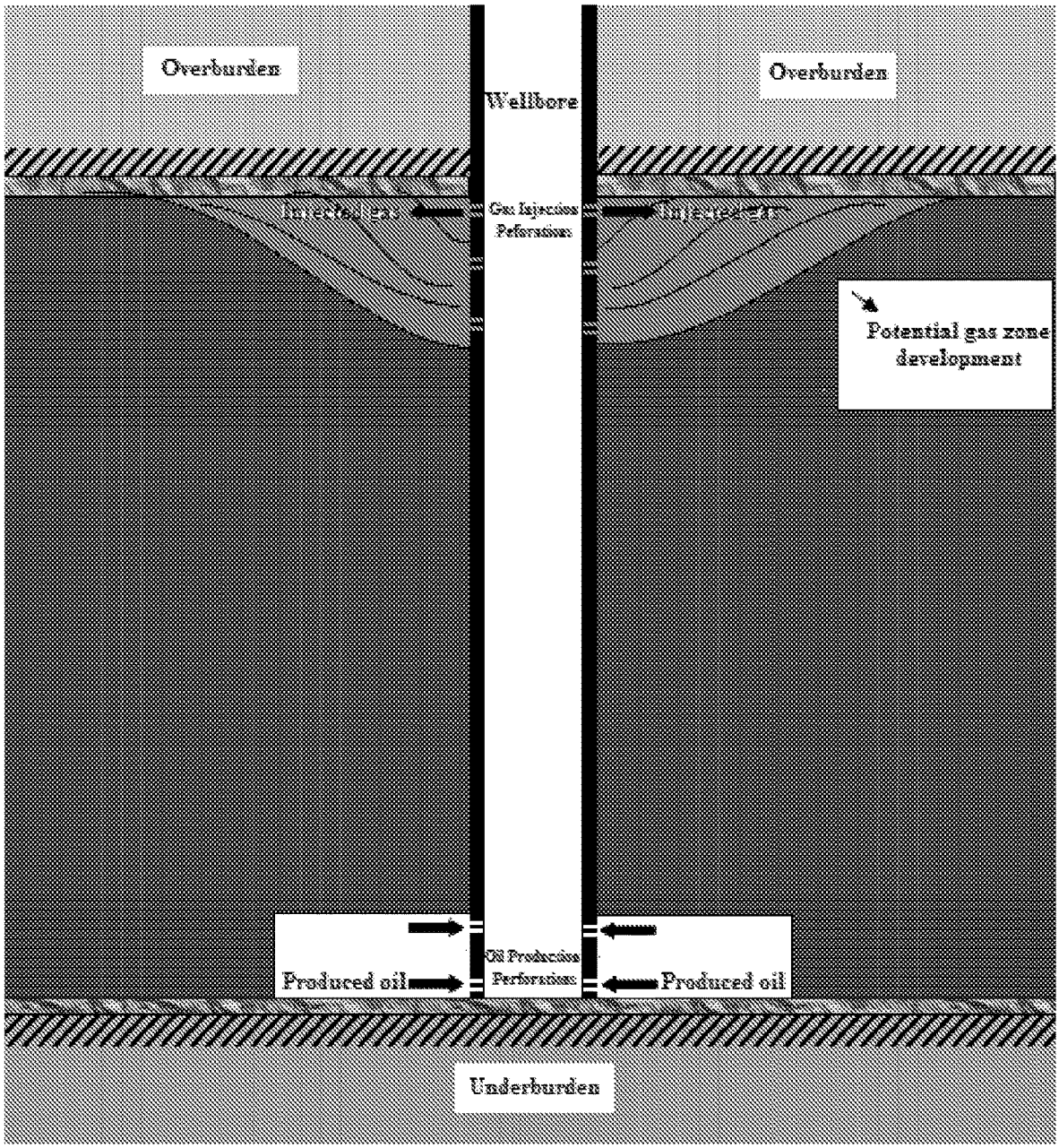
FIG. 3 is a Schematic Drawing of the Vertical SW-GAGD Process.

In the SW-GAGD process, a vertical well (either an existing well or a newly drilled well) is completed in such a way that the uppermost perforations are used to inject the displacing gas while the lower perforations are used to produce the reservoir fluids. This is a departure from the GAGD process in which more than one wells are used to drain a reservoir. At minimum, GAGD processes include a vertical gas injector and a horizontal producer which, in preferred embodiments, has its horizontal leg as close as possible to the bottom of the payzone and/or the oil-water contact. A study of the SW-GAGD process using known reservoir conditions of the Buckhorn field located in Tensas Parish, La. was undertaken to evaluate the efficacy. Multi-completion single wells were used to produce as much oil from the Buckhorn field through the injection of CO2 in the upper perforations and producing reservoir fluids from the lower completions. A diagram of the single-well GAGD process is depicted in FIG. 3. The objective of this phase of the simulation study is to investigate the potential oil recovery in the Buckhorn field when the GAGD process is applied using single wells with multiple completions (the SW-GAGD process). To this end, field-scale numerical simulations were conducted using CMG's GEM, a compositional simulator. The SW-GAGD oil recovery as referred to in this study is taken as the incremental recovery over the initial oil recovery during the primary depletion and waterflooding stage of the field development and as such, is always expressed in terms of percentage of the residual oil in place, % ROIP.

Numerical Study of the SW-GAGD Process

Block SW-GAGD Model—Description

As a starting point of the current simulation study the previously compiled reservoir and PVT model were used, as well as the most recent relative permeability curves derived from coreflooding experiments using reservoir core samples. However, they were applied not in the full-scale field model, but rather, in a much simpler block-shaped reservoir model to investigate the importance of the gas injection and oil production rate, the presence and severity of flow barriers, and the configuration of the SW-GAGD well on the ultimate oil recovery. The dependence of the SW-GAGD oil recovery on the gas and oil rate was investigated over a wide range of values, as was the location and magnitude of the flow restriction (mimicking a field-wide shale layer).

Figure 4:
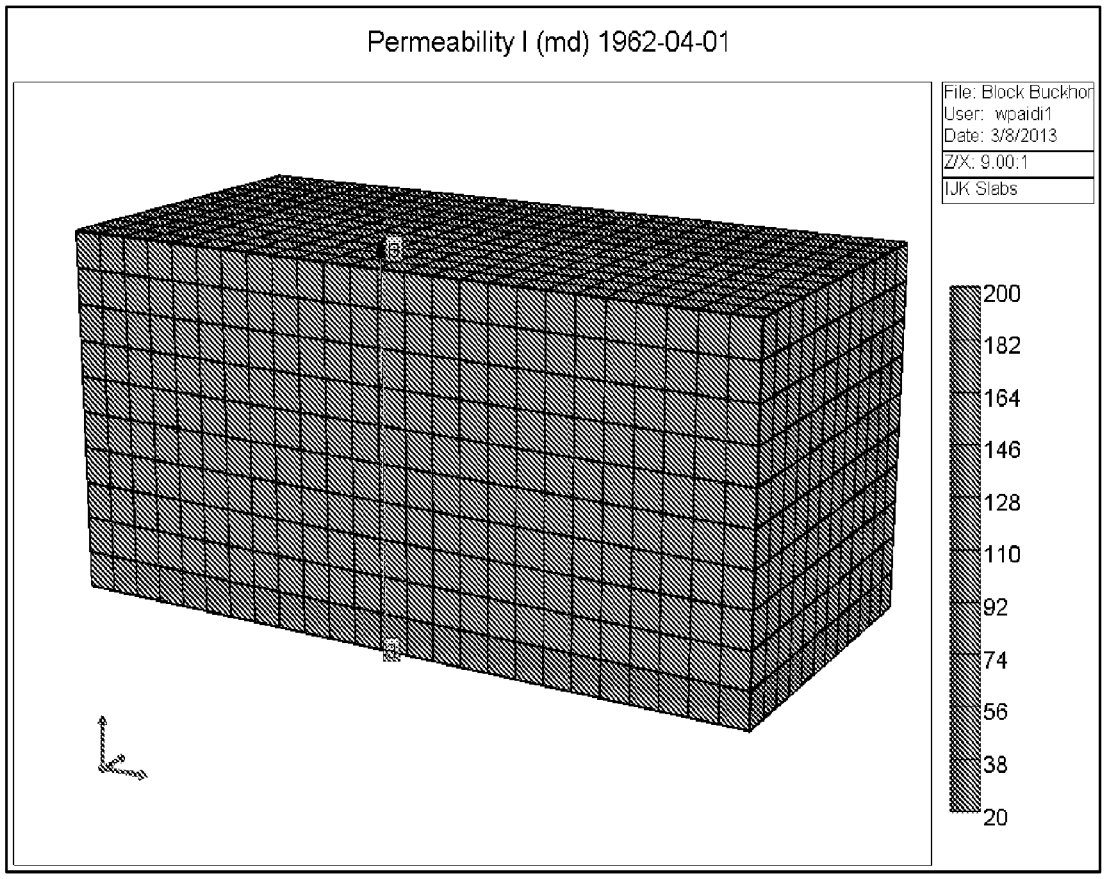
FIG. 4 shows a Cross Sectional View through SW-GAGD Block Model.

In order to be able to isolate the effect of the aforementioned parameters on the SW-GAGD recovery, it was decided to compile a very simple synthetic, block-shaped reservoir model that was very homogeneous, but at the same time it incorporated some of the same model parameters as the full-field numerical model. Some of the shared parameters were: the reservoir fluid model, the liquid-liquid and gas-liquid relative permeability curves and a representative value for both the porosity and the horizontal permeability, namely 23.5 percent and 200 mD, respectively. The block reservoir model had an area of 50 acres and a thickness of 25 feet with a total number of gridblocks of 6250. All simulations conducted with the synthetic block models spanned 10 years. FIG. 4 shows a side (cross-sectional) view of the synthetic block model with the vertical SW-GAGD well visible in the center of the model. The vertical SW-GAGD has its production completions in layers 8 to 9 while gas is injected in layers 1 and 2.

Figure 5:
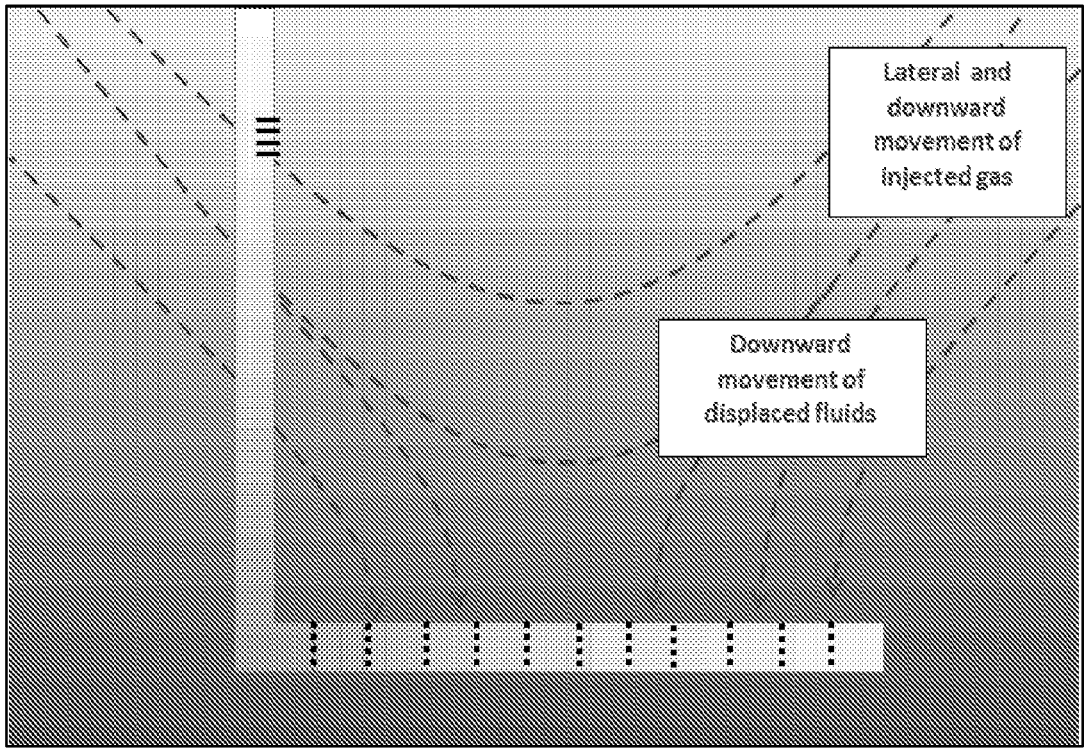
FIG. 5 is a Schematic Drawing of the Horizontal SW-GAGD Process.
Figure 6A:
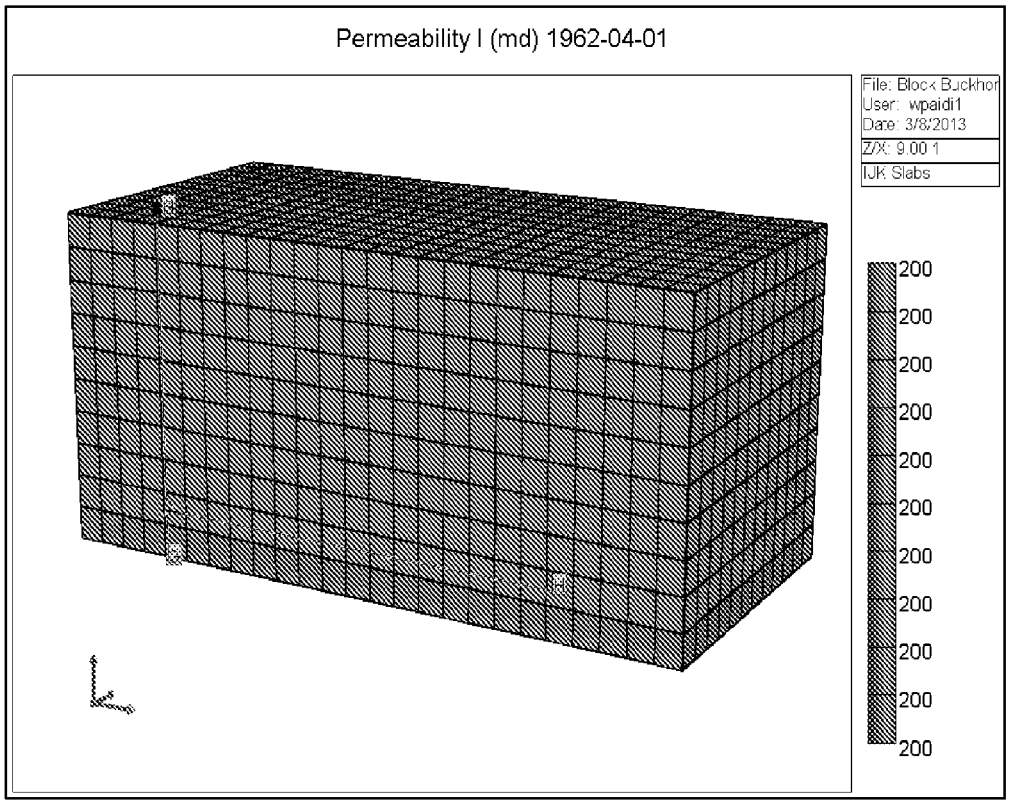
FIG. 6A shows a Cross Sectional View through SW-GAGD Block Model—Horizontal Variation.
Figure 6B:
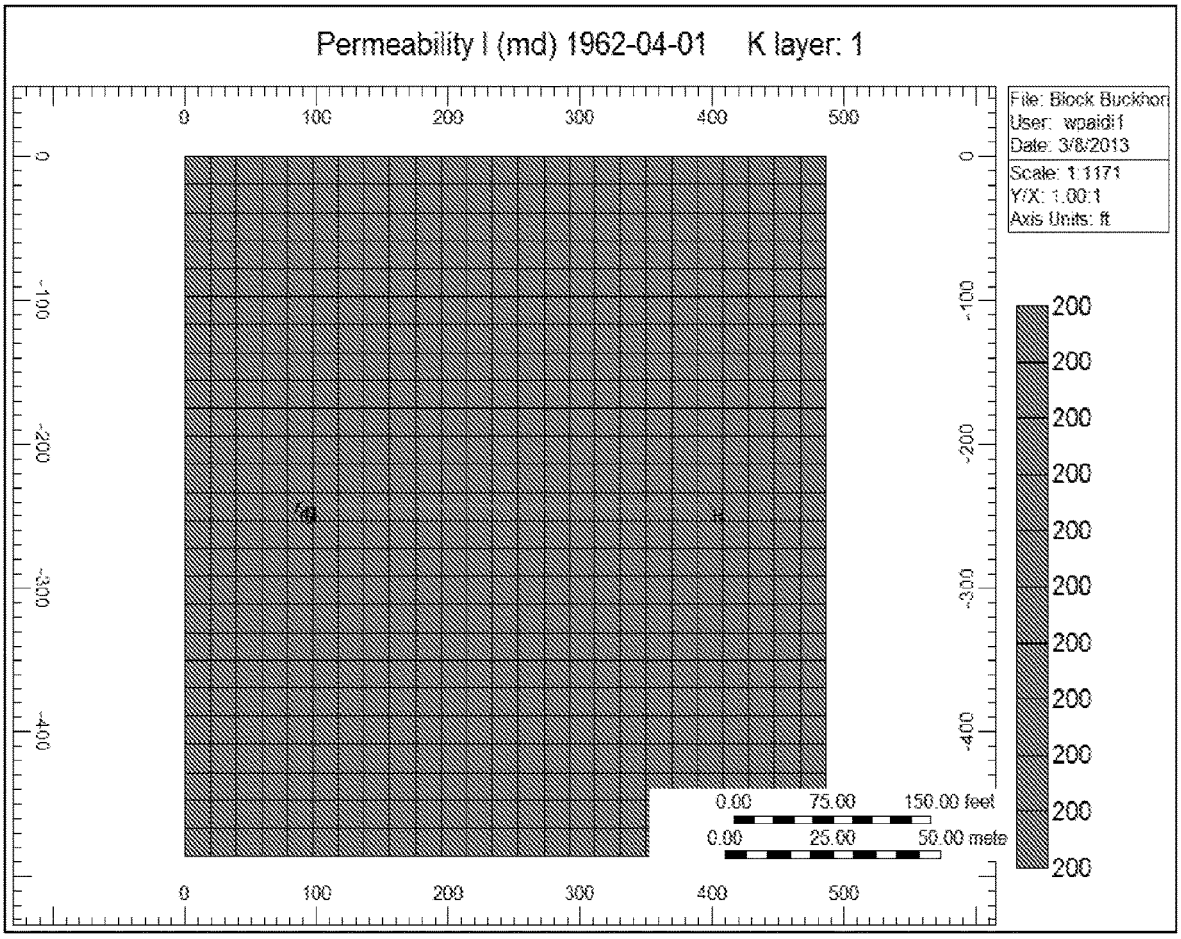
FIG. 6B shows an Aerial View SW-GAGD Block Model—Horizontal Variation.

Apart from the vertical trajectory of the SW-GAGD well as depicted above, another embodiment of the SW-GAGD process investigated was one in which the production occurred from the horizontal section of the well as is depicted in the schematic drawing in FIG. 5. The choice for placing the production completions in an offset (horizontal) section of the SW-GAGD well was made to improve the drainage patterns due to the increased well exposure of a horizontal well. The decrease in the well drawdown by using this configuration might in some embodiments also lead to higher SW-GAGD recoveries, and perhaps improved gas efficiency. A block synthetic model of this alternate configuration was also composed in a similar manner as before and is shown in FIGS. 5A and 5B. In this configuration all of the production completions are along the horizontal section of the well which is fully contained in layer 9.

The aforementioned synthetic block reservoir models were used to explore and optimize both variations of the single-well GAGD process as was previously done with the multi-well GAGD process.

In both variations of the SW-GAGD process (vertical versus horizontal well) the same range of values was used in the optimization study as follows:

CO2 injection rate: The gas injection rate was defined within the range of 0.5 to 2 MMSCF/day for a total of 10 possible values that are equally spaced.

Oil production rate: The oil rate was varied from 100 to 3000 BPD divided over 10 equal intervals.

Depth of the flow obstruction: In this case, a flow obstruction was again defined as a layer with a permeability that was 10 percent of the original horizontal permeability value. The position of the layer was varied within the 10 possible layers but restricted to layers 4 to 8. This means that neither the injection nor the production completions were ever in the layer that was defined as the flow barrier. The logic behind this choice is that in most cases completions are not performed in a shale layer or other tight/impermeable layer, which the flow obstruction is a proxy for. FIG. 4 shows the depth of the flow barrier as layer 4 (Z-direction increases downwards).

Block SW-GAGD Model—Results

Figure 7:
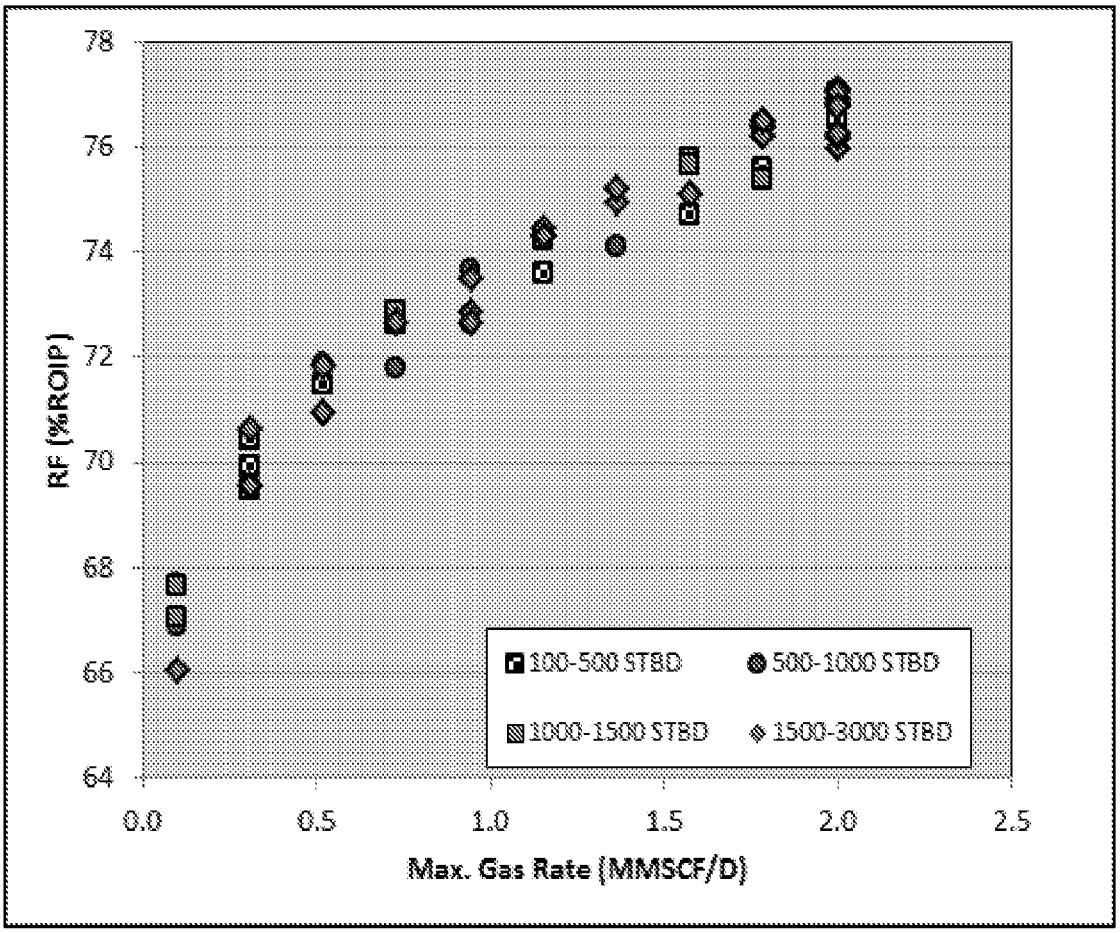
FIG. 7 is a Vertical SW-GAGD Recovery Factor vs. Gas Injection Rate—Block Model.
Figure 8:
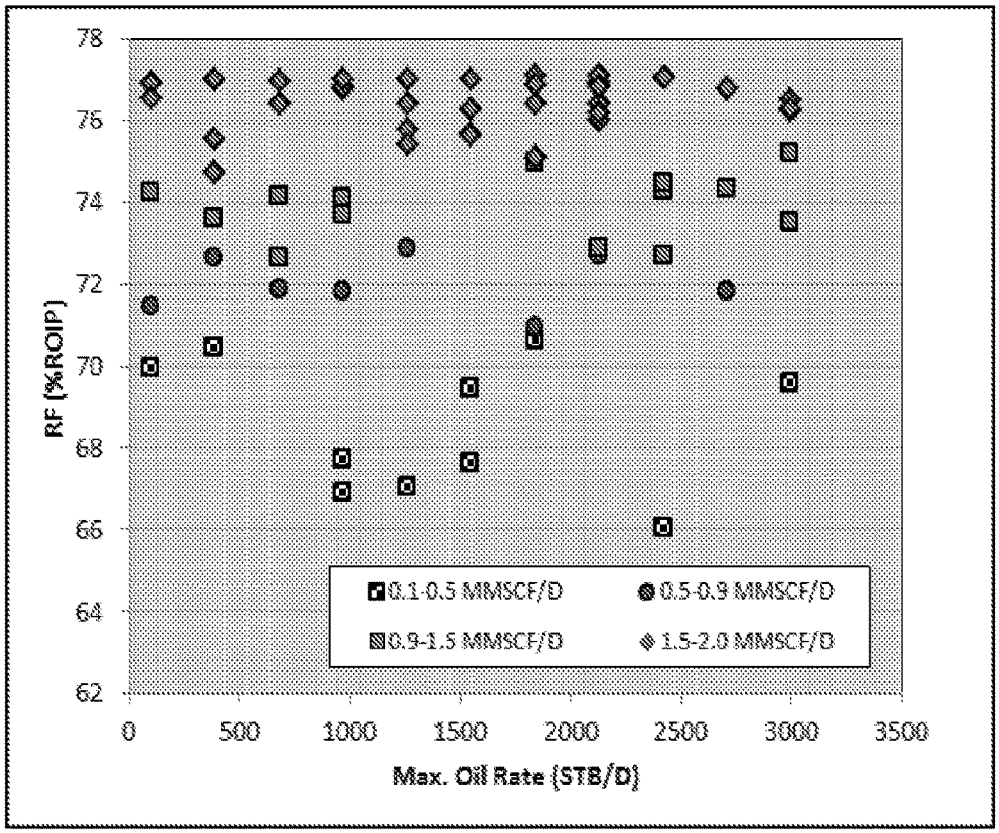
FIG. 8 is a Vertical SW-GAGD Recovery Factor vs. Oil Withdrawal Rate—Block Model.
Figure 9:
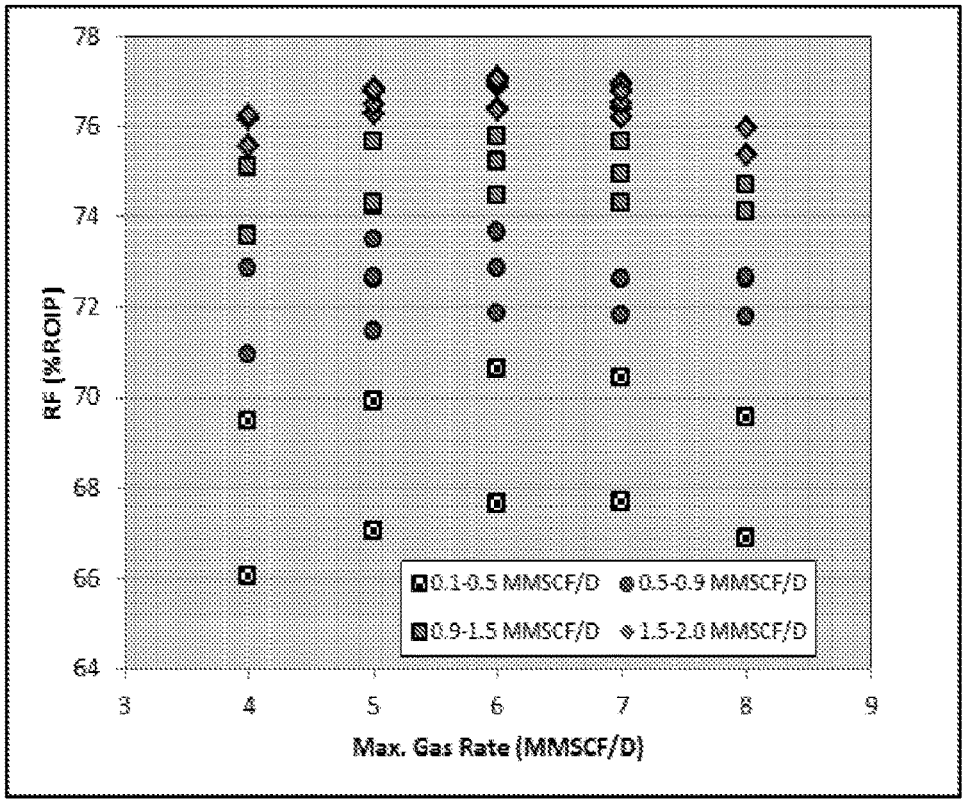
FIG. 9 is a Vertical SW-GAGD Recovery Factor vs. Depth of Flow Barrier—Block Model.

The results of the optimization of the vertical SW-GAGD process using the synthetic block model are summarized in FIGS. 7-9. The recovery factor is plotted on the Y-axis against the optimization variables in each of the subsequent figures. Each recovery value is the combined effect of varying three optimization results and as such the interpretation of the depicted results may not necessarily be straightforward. To aid in the interpretation of the CMOST® results the various data points have been grouped by either the gas injection or the oil production rate.

Despite the combined effect of three different variables on the SW-GAGD recovery factor, there is a very clear, not necessarily linear, trend visible when the recovery factor is plotted against the gas injection rate: an increase in the gas injection rate results in an increase in the SW-GAGD oil recovery regardless of the value of the oil production rate or the depth of the flow barrier (FIG. 7). The lack of significant scatter in the data indicates that the recovery factor is very dependent on the choice of the gas injection rate (as was expected).

When looking at the graph of the plotted recovery factor against the oil production rate (FIG. 8) it is clear that there is quite a bit of scatter in the data, as well as a lack of any discernible trend in the recovery factor with regards to the oil rate. However, because of the grouping of the data based on the gas injection rate a correlation does appear. Upon a closer examination of the graphed results it is evident that as the gas rate is increased this resulted in an increase of the RF leaving only the effect of the depth of the flow barrier to be assessed.

A similar picture emerges when the recovery factor is plotted against the depth of the flow barrier (with a horizontal permeability of 10 percent of the rest of the reservoir) as there is again a lot of variability in the optimization results (FIG. 9). However, there does seem to be a slight maximum visible when looking at the location of the optimum cases for the flow barrier being located in layer 6 (which is exactly in the middle of the synthetic block model). When the flow barrier occurs right in the middle of the reservoir it apparently seems to have a stabilizing effect on the displacement in the vertical SW-GAGD configuration. Key to the graph is that the presence of a flow barrier does not impede the SW-GAGD recovery regardless of its relative location. A strong correlation with the gas injection rate is again very clear from this graph.

Figure 10:
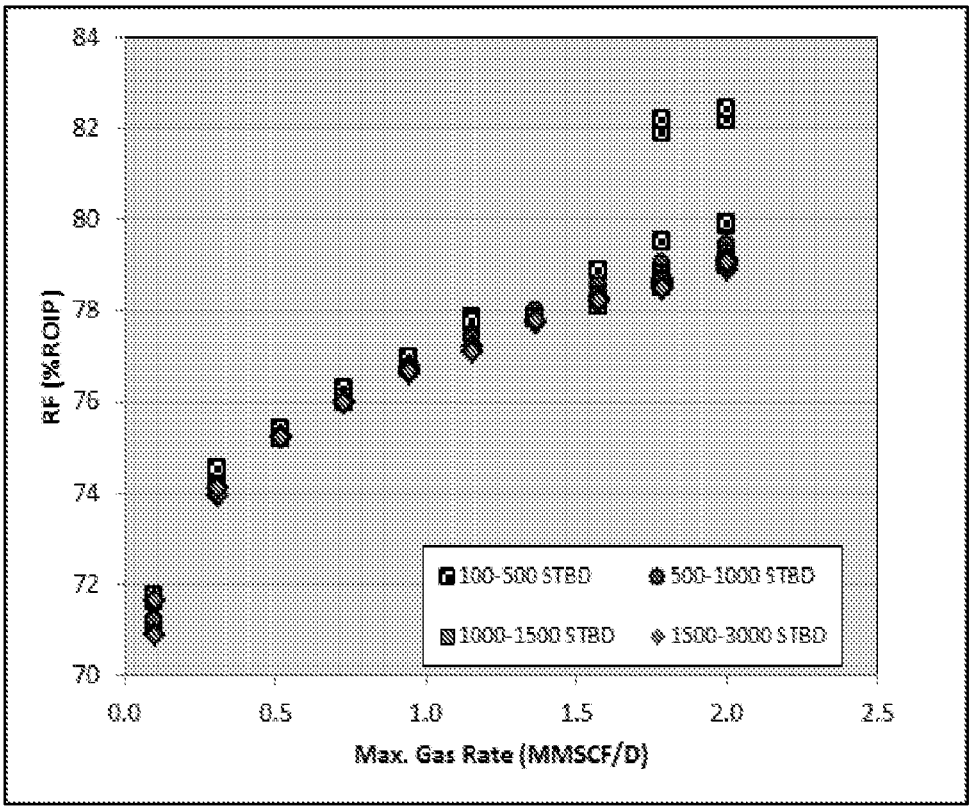
FIG. 10 is a Horizontal SW-GAGD Recovery Factor vs. Gas Injection Rate—Block Model.
Figure 11:
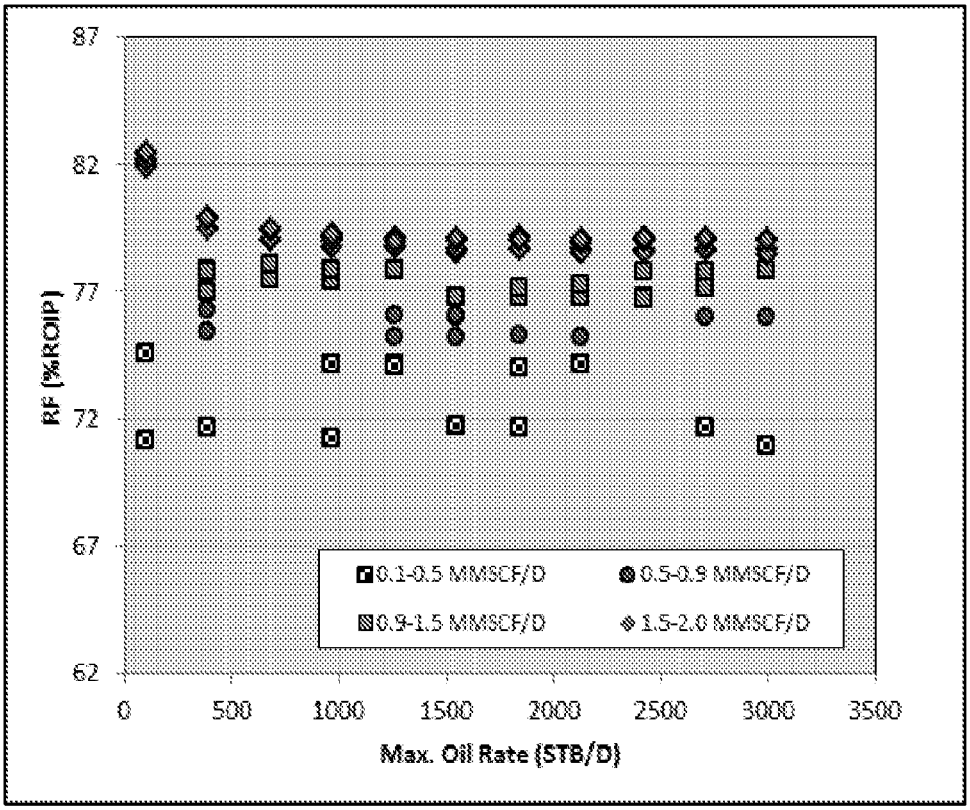
FIG. 11 is a Horizontal SW-GAGD Recovery Factor vs. Oil Withdrawal Rate—Block Model.
Figure 12:
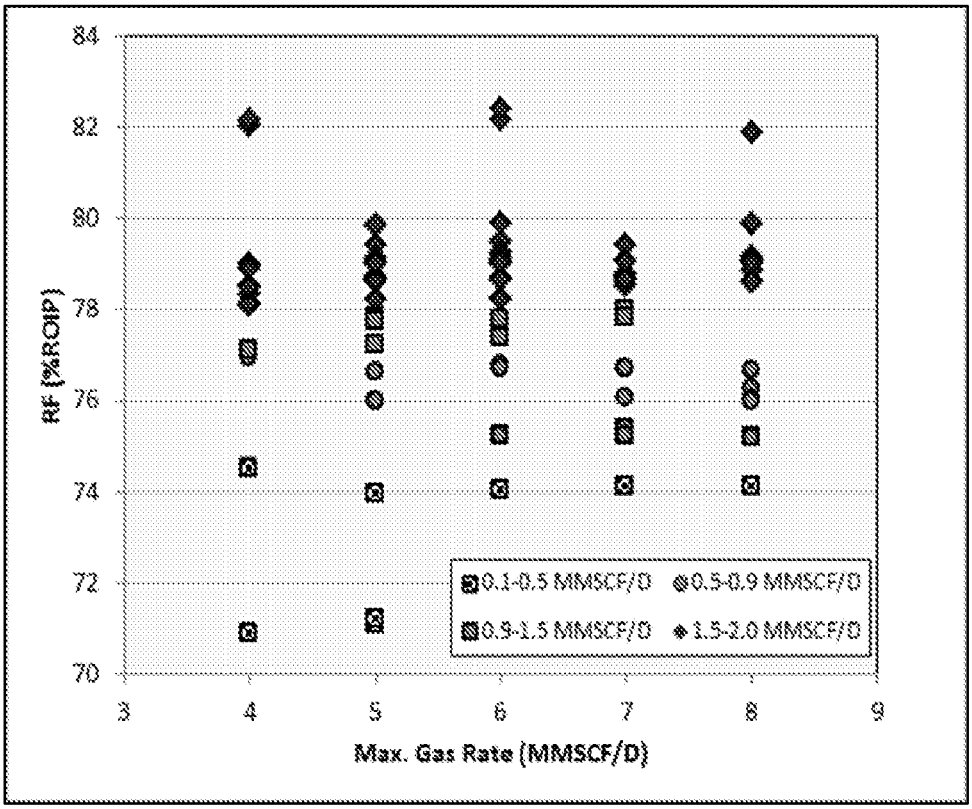
FIG. 12 is a Horizontal SW-GAGD Recovery Factor vs. Depth of Flow Barrier—Block Model.

The same trends as described above for the SW-GAGD optimization study using the vertical well configuration were also seen in the optimization study of the horizontal SW-GAGD variation. FIGS. 10 to 12 show the recovery factor as a function of the gas injection and oil production rate, and the depth of the flow obstruction layer.

Apart from the fact that a strong positive relationship is revealed between the SW-GAGD recovery factor and the gas injection rate (FIG. 10), it is also worth noting that the oil recovery values are higher when compared to the vertical SW-GAGD results. This indicates that using one horizontal well for both injection and production purposes does indeed lead to better oil recovery results as was hypothesized before. Some of the highest RF-values were attained with the lower oil production rates in combination with the highest gas injection rates.

Figure 13:
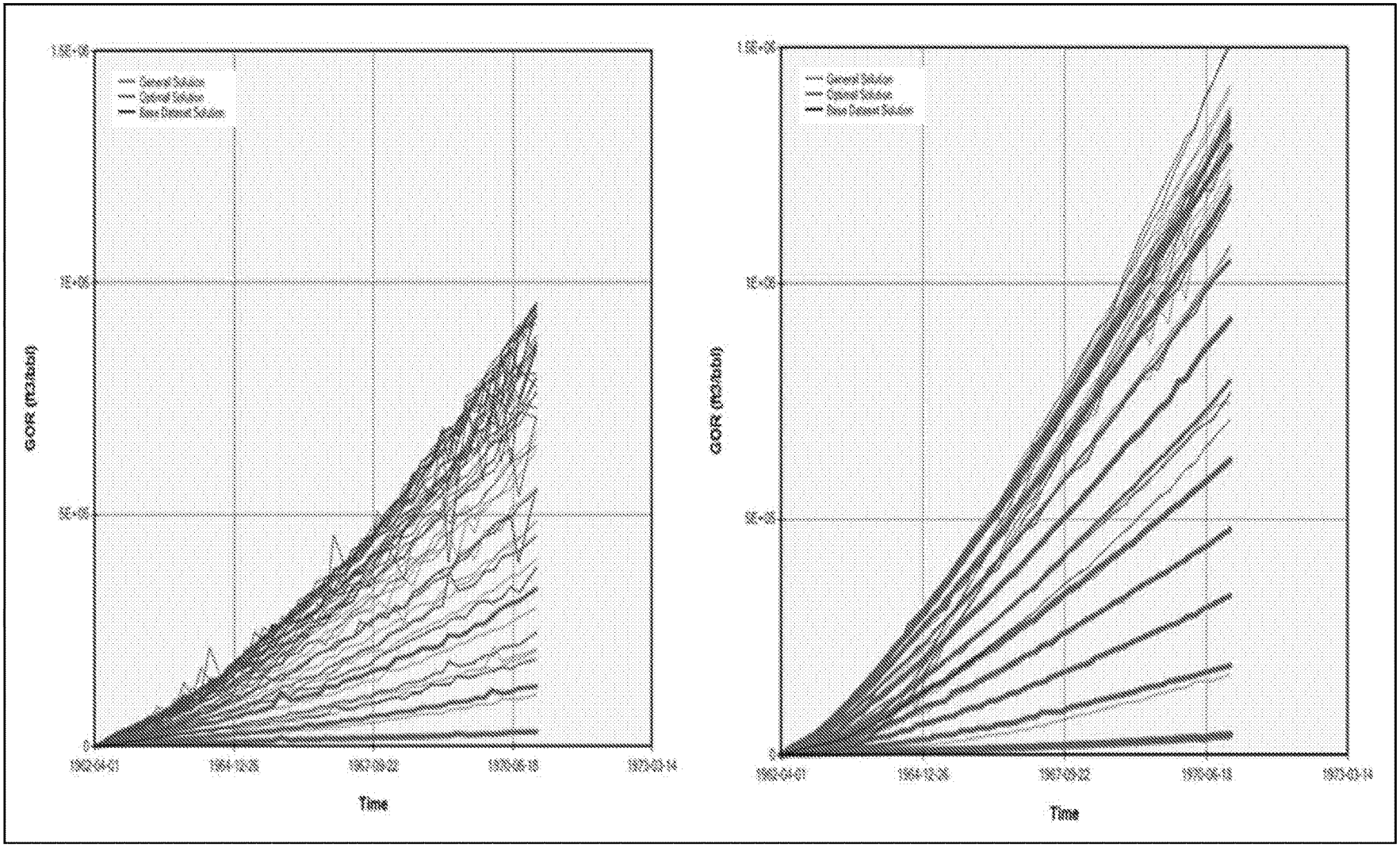
FIG. 13 shows Gas Efficiency of Vertical (Left) and Horizontal (Right) SW-GAGD—Block Model.
Figure 14:
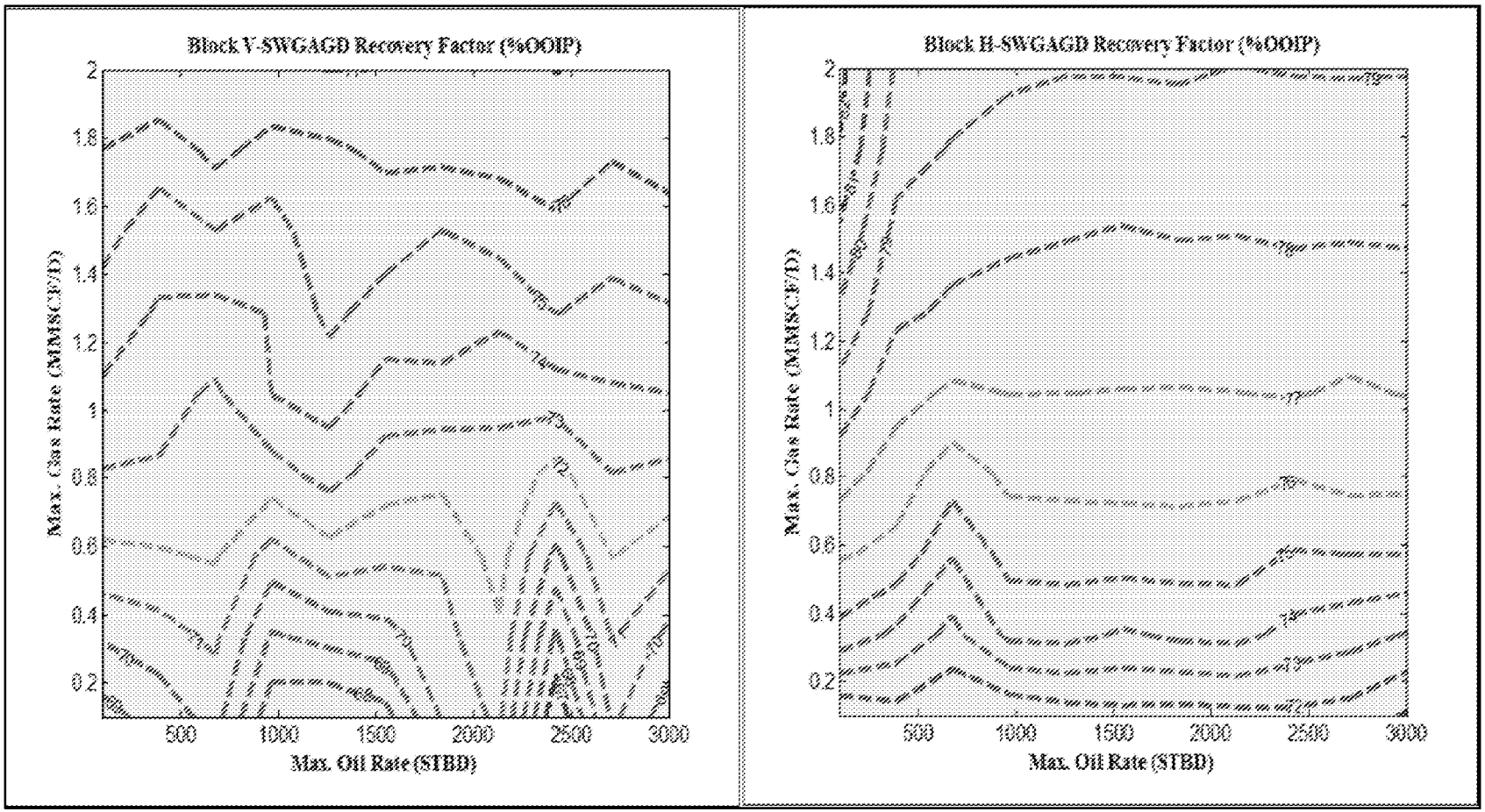
FIG. 14 shows Contour Plots of Vertical (Left) and Horizontal (Right) SW-GAGD Recovery—Block Model.

The optimization of the horizontal SW-GAGD process using the synthetic block model again showed that the oil recovery has very little dependency on either the oil rate (FIG. 11) or the depth of the flow barrier (FIG. 12), implying that when the SW-GAGD process efficiency is to be simulated using the full-scale field model it will be the gas injection rate that shall prove to be the dominant factor influencing the ultimate oil recovery. As for the gas efficiency comparison between the two variations of the SW-GAGD process it can be seen from FIG. 13 that even though using a horizontal well does indeed result in better oil recovery numbers it does come at the cost of utilizing the injected gas less efficiently. This is indicated by the higher producing gas-oil-ratios of the horizontal SW-GAGD process as compared to that of the vertical configuration. This may be offset by the higher attained RF-values for the horizontal SW-GAGD process as is evident from the RF-contour plots for both variations of the SW-GAGD process in FIG. 14.

Field-Scale Simulations of the SW-GAGD Process

The optimization study as described above was extended to the full-scale reservoir model to investigate whether the same trends as were seen with the synthetic block model would translate to the reservoir model. In order to accomplish this task, the contour plots of the block model RF as a function of gas injection and oil rate were assessed to choose appropriate values. As a result, the gas injection rate was chosen from within the range of 0.25 to 3 MMSCF/day while the oil production rate ranged from 500 to 3000 BPD.

Location of the GAGD Wells

Figure 15:
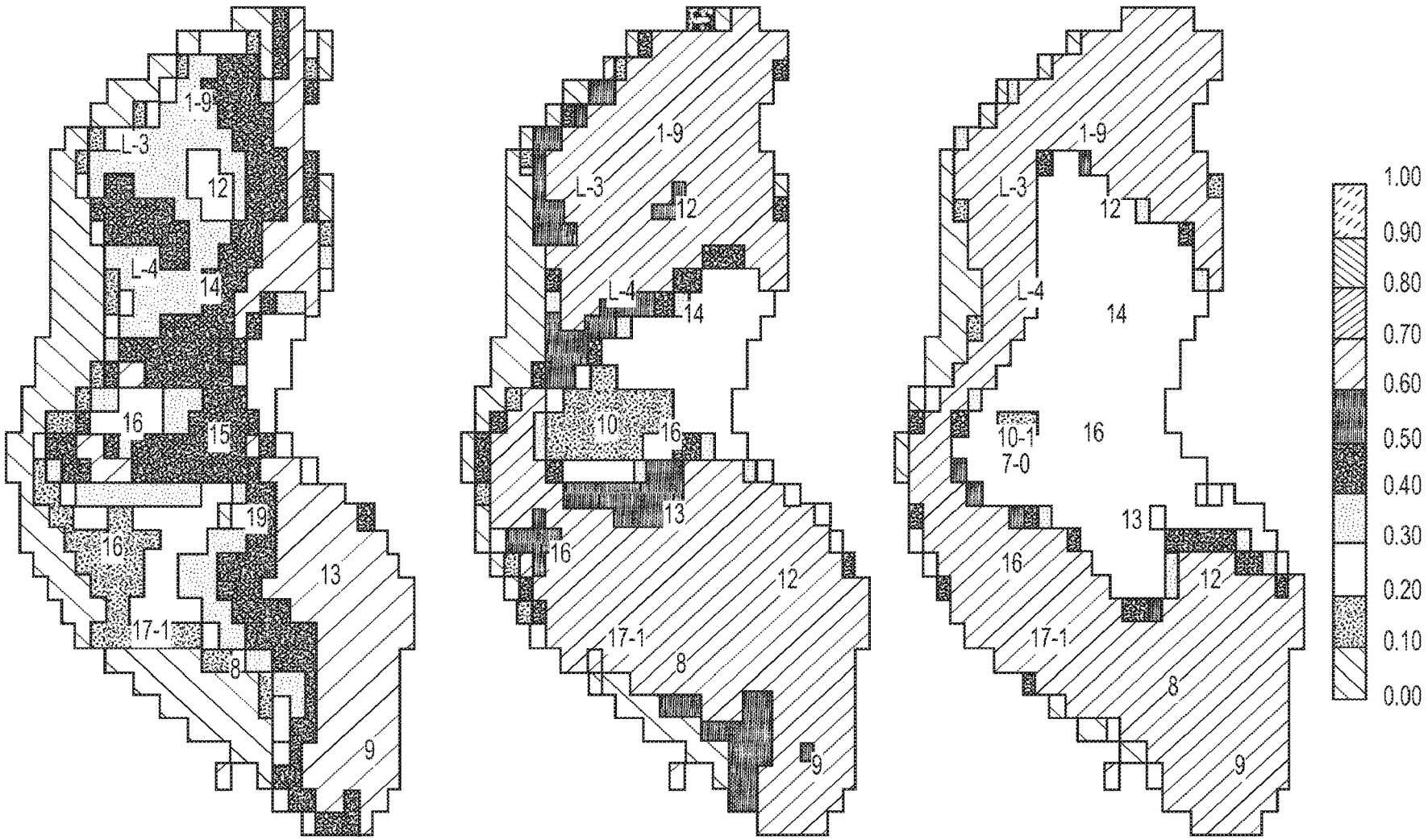
FIG. 15 shows Oil Saturation Maps Prior to the Start of SW-GAGD—From Left to Right: Layer 1, 2 and 3.
Figure 16:
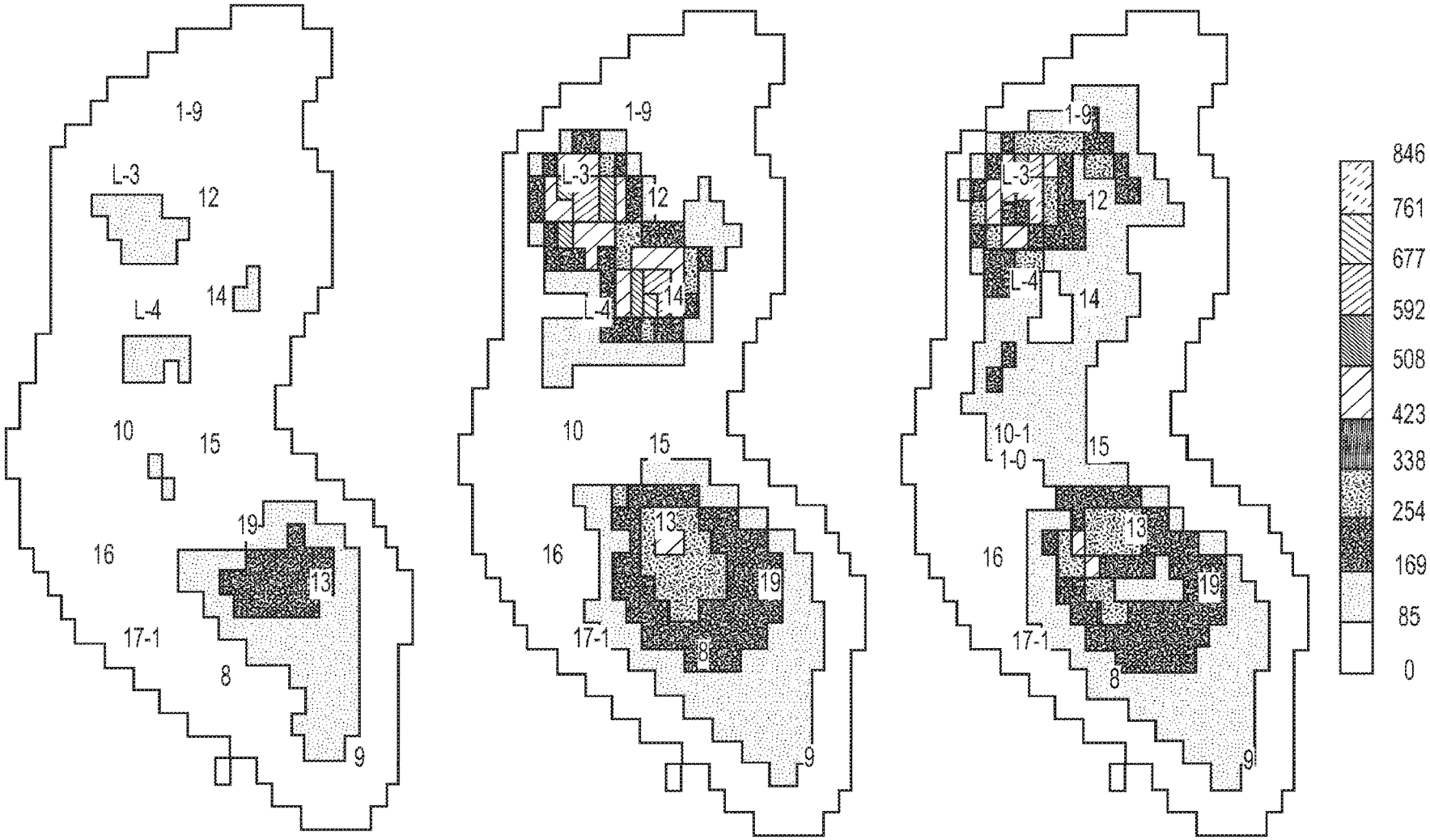
FIG. 16 is Production Capacity Maps Prior to the Start of SW-GAGD—From Left to Right: Layer 1, 2 and 3.
Figure 17:
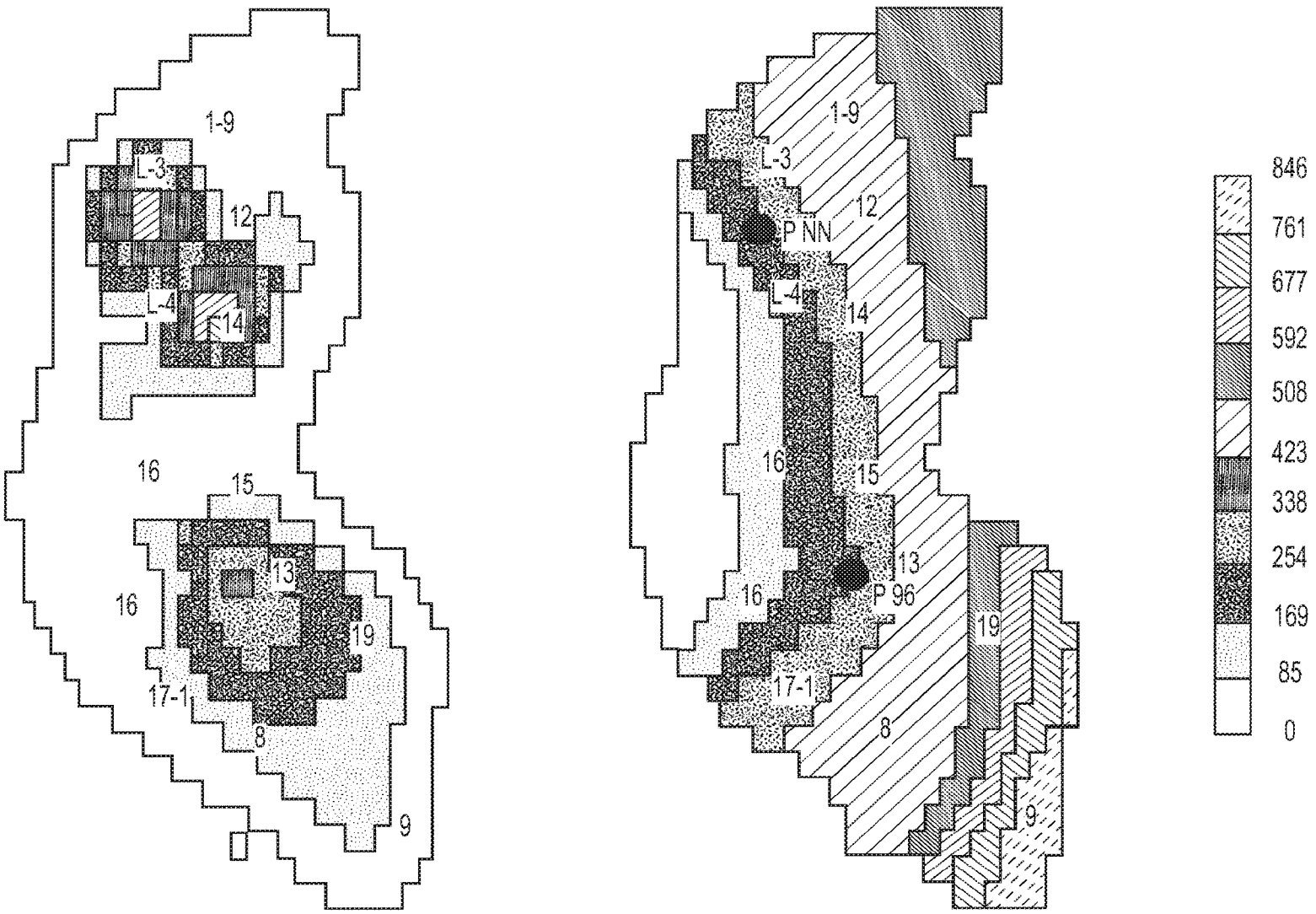
FIG. 17 shows the Location of SW-GAGD Well Coinciding with Maximum Production Capacity (Red).
Figure 18:
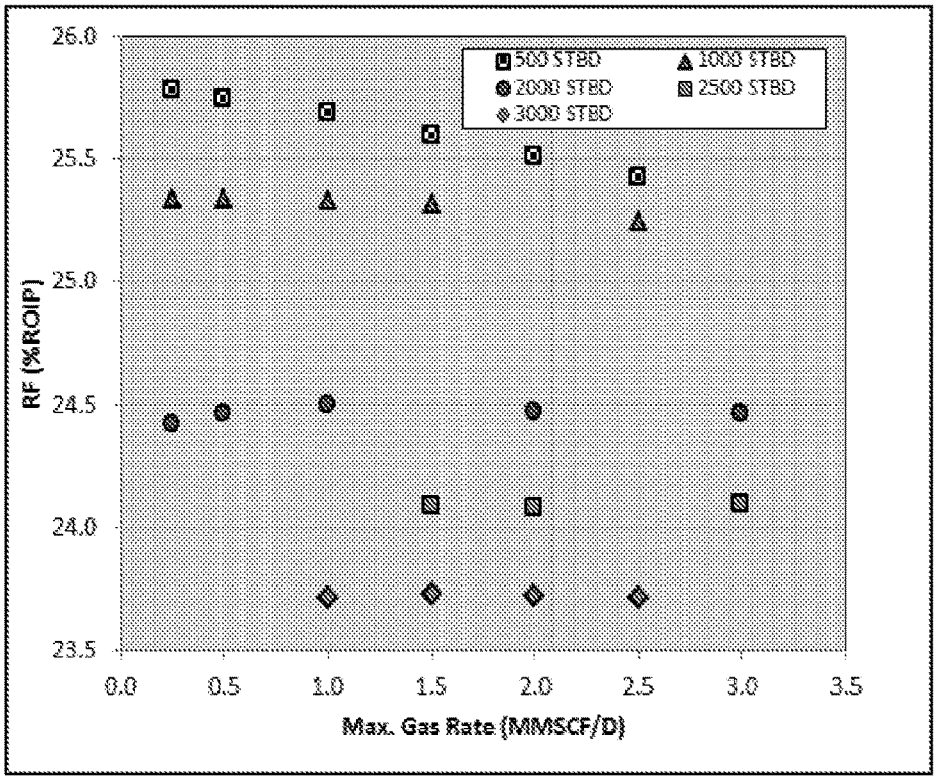
FIG. 18 is a Vertical SW-GAGD Recovery Factor vs. Gas Injection Rate—Field Model.

It is expected that the final location of the GAGD dual-completion wells will an important aspect of the field application of SW-GAGD. One of the ways of determining the future location of these wells is to place them such that they will be most effective in draining the remaining oil in place after the primary production and waterflooding stage. Maps of oil saturation could be helpful in finding the optimum well location but unfortunately at the end of the first production stage the oil saturation distribution map of the Buckhorn field did not prove to be helpful as can be seen in FIG. 15. The areas of high oil saturation are too large to facilitate the decision where to place the GAGD wells. Another option would be to examine maps of so-called productive capacity which in this context was taken as the product of the oil saturation, the pay thickness, the effective porosity and the reservoir permeability. FIG. 16 indicates that there are two defined areas with the highest production capacity potential that could be suitable for GAGD well placement. This option is depicted in FIG. 17. The GAGD wells are indicated in the figure by red dots. The simulations were set up in a very similar manner to the previously discussed conventional GAGD runs in that there was a 6-month stagger between the well located in the Northern part of the field compared to the one in the Southern part of the Buckhorn field.

Field-Scale Simulation Results—Vertical SW-GAGD

The optimization study as described above was extended to the full-scale reservoir model to investigate whether the same trends as were seen with the synthetic block model would translate to the reservoir model. In order to accomplish this task, the gas injection rate was chosen from within the range of 0.25-3 MMSCF/day while the oil production rate ranged from 500 to 3000 BPD.

The results from the optimization study were very surprising, in that it they revealed a very different picture from what had been observed with the synthetic block model. In this case, the reservoir optimization of the vertical SW-GAGD process showed that there was not as clear a trend in the recovery data when plotted in terms of the gas injection rate (FIG. 16). This was compounded by the presence of quite a bit of scatter as well. However, the data does show that with increasing gas injection rate the recovery factor does seem to decrease in general. This is probably the result of early breakthrough occurring resulting in a displacement that is suboptimal. In order to make sense of the plotted results, the data was grouped as a function of the oil production rate and it can be seen that the lower oil production rates resulted in the highest RF-values. Furthermore, there is a very clear negative correlation visible, i.e. increasing the oil production rate results in a decrease of the ultimate oil recovery. This phenomenon was further substantiated by FIG. 19.

Figure 19:
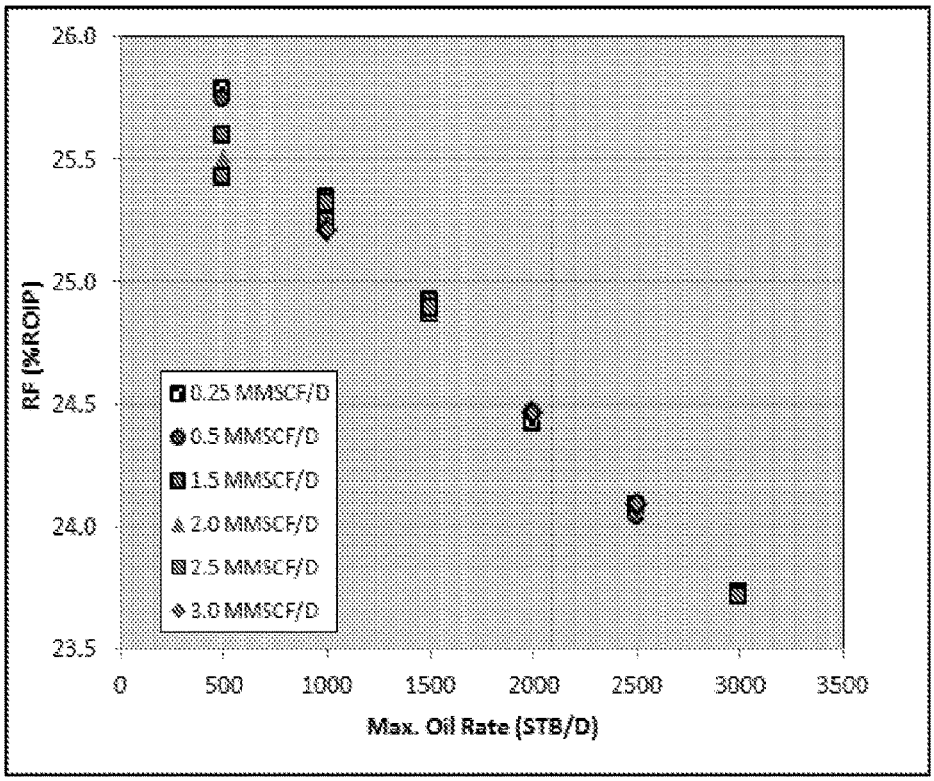
FIG. 19 is a Vertical SW-GAGD Recovery Factor vs. Oil Rate—Field Model.
Figure 20:
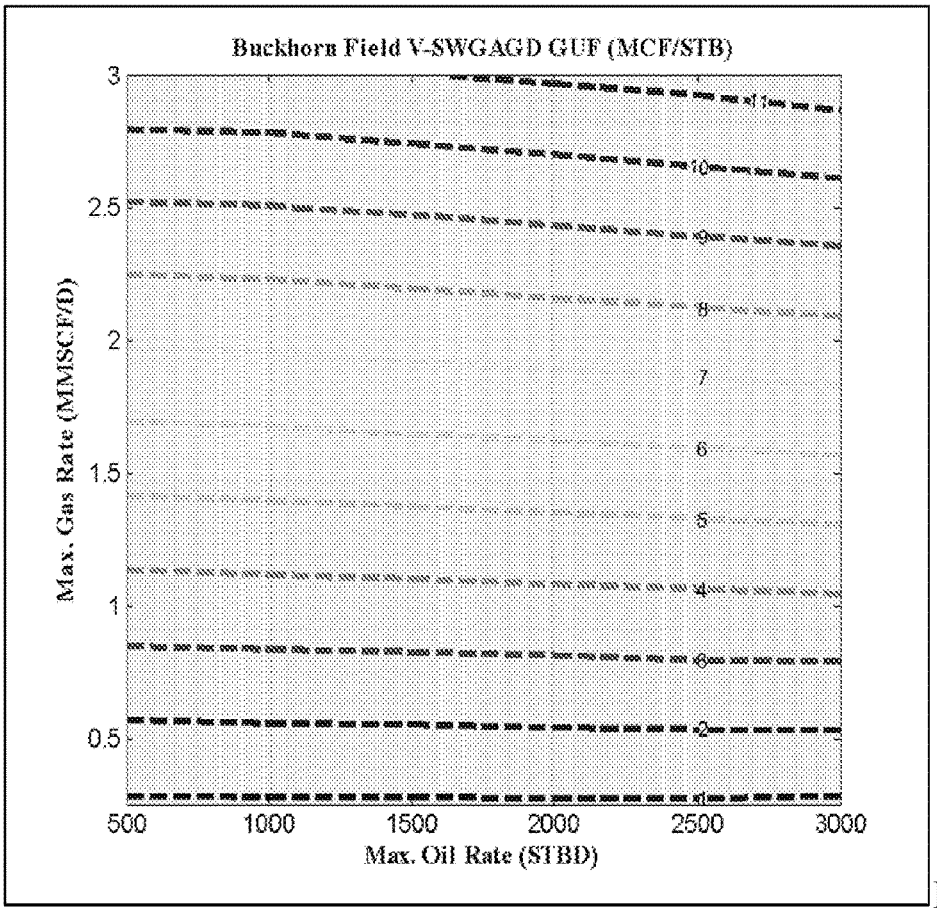
FIG. 20 is a Vertical SW-GAGD GUF vs. Gas and Oil Rate—Field Model.

As opposed to the synthetic model results, the vertical SW-GAGD recovery data in terms of the oil production rate did show a very clear linear relationship, but this time around a decreasing trend rather than an increasing trend (see FIG. 19). The lack of scatter in the simulation data points indicates that the recovery factor is very responsive to changes in the maximum allowed oil rate. There seems to exist a delicate balance between the reservoir voidance due to the oil withdrawal rate and the void replacement due to the injected gas that needs to be appropriately chosen in order for the displacement to result in a maximum oil recovery.

In order to facilitate the choice for the optimum combination of gas injection and oil withdrawal rates for the field-scale simulation of the vertical SW-GAGD process, the gas utilization factor (GUF) optimization results were plotted against the gas injection and oil rate in a contour plot (see FIG. 208). A cut-off value of 8 MCF/STB was used for the GUF which meant that injecting gas at a lower value than 3 MMSCF/D could still result in an optimum case with regards to the oil recover factor. The following values were chosen for the CO2 injection and oil production rate:

Gas injection rate: 0.25, 1 and 2 MMSCF/D;

Maximum oil withdrawal rate: 500, 1000, 15000 and 2000 STB/D.

Figure 21:
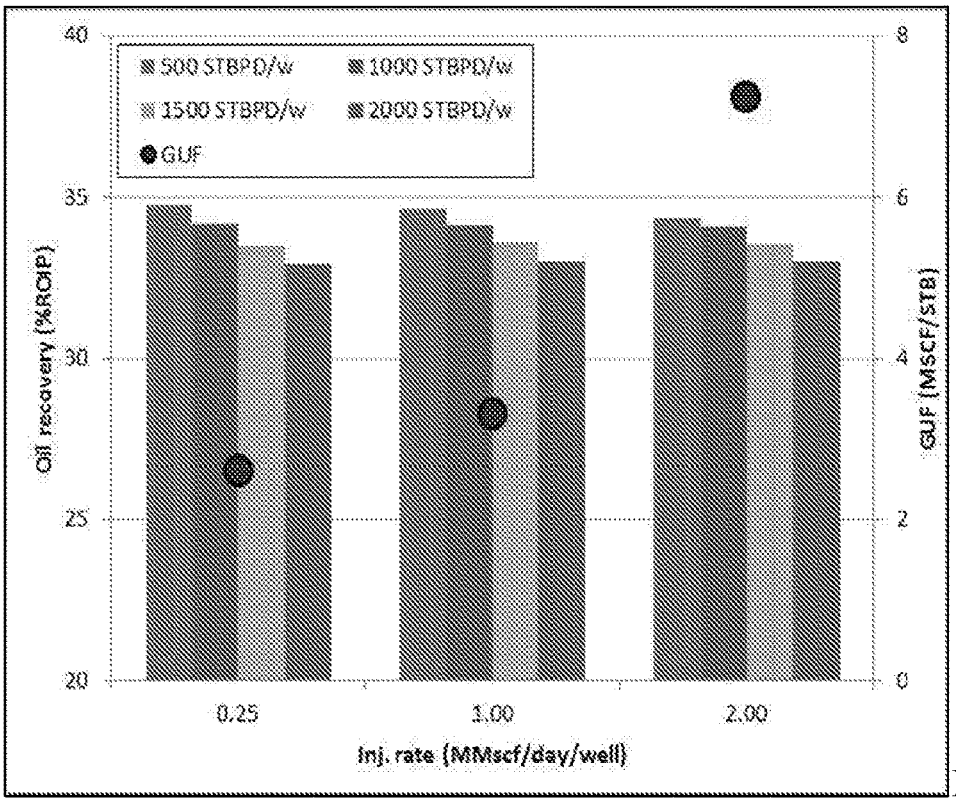
FIG. 21 is a Column Chart of Vertical SW-GAGD RF and GUF—Field Model.

A maximum injection pressure of 4500 psi and a minimum bottom-hole pressure of 500 psi were also used for the injection and production wells, respectively. The simulation results of the vertical SW-GAGD application in the Buckhorn Field are summarized in Table 1 and are also depicted in FIG. 21. The latter figure also shows the average GUF as a function of the gas injection rate.

TABLE 1

Summary of Vertical SW-GAGD Oil Recovery Simulation Results

| Max. Oil Production Rate (BPD/well) | Gas Injection Rate (MMSCFD/well) 0.25 Incremental Recovery (% ROIP) | 1 Incremental Recovery (% ROIP) | 2 Incremental Recovery (% ROIP) |
|---|---|---|---|
| 500 | 34.8 | 34.6 | 34.4 |
| 1000 | 34.2 | 34.2 | 34.1 |
| 1500 | 33.5 | 33.6 | 33.6 |
| 2000 | 32.9 | 33.0 | 33.0 |

Field-Scale Simulation Results—Horizontal SW-GAGD

Figure 22:
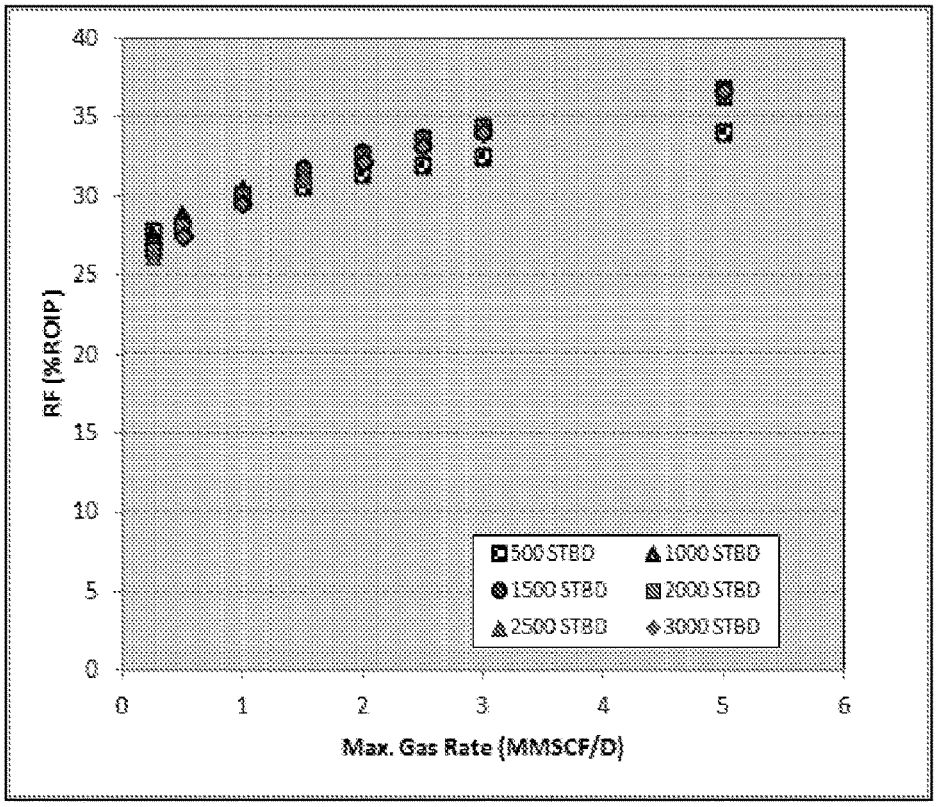
FIG. 22 is a Horizontal SW-GAGD Recovery Factor vs. Oil Rate—Field Model.
Figure 23:
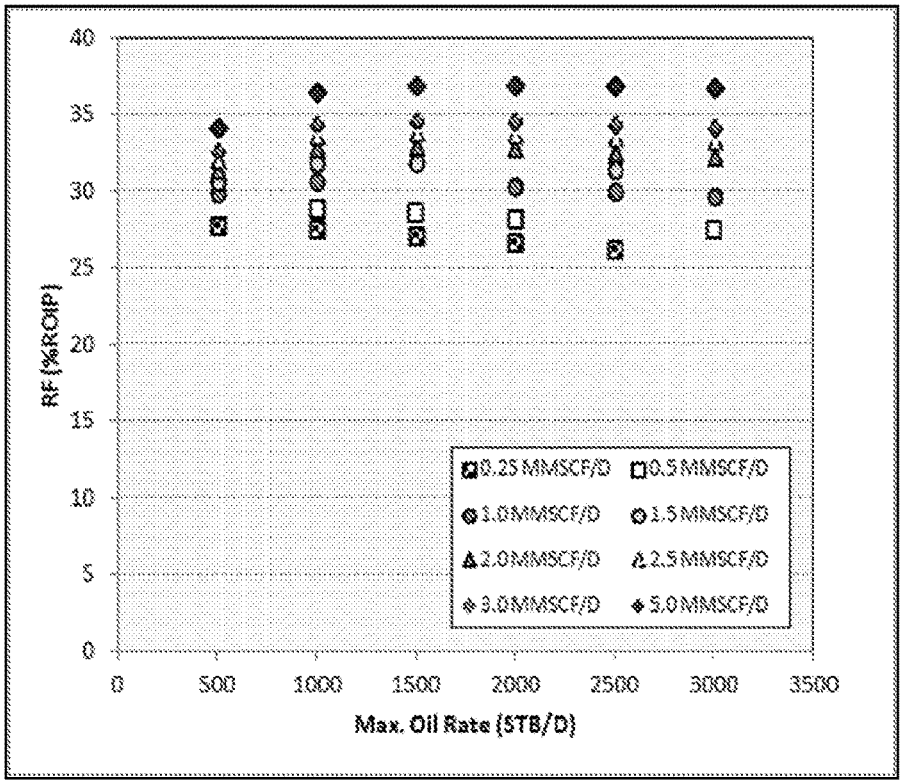
FIG. 23 is a Horizontal SW-GAGD GUF vs. Gas and Oil Rate—Field Model.

In order to choose the best combination of values for the gas injection and the oil production rate for use in the simulation of the horizontal SW-GAGD process, it was also optimized using CMOST® in an exploratory way as was done for the vertical configuration. The same types of figures were also used to aid in the choice. As was done before, the data points were grouped by either the gas injection or the oil production rate to facilitate an easier interpretation of the simulation results. Interestingly, when examining the various graphs of the recovery factor as a function of the gas injection (FIG. 22) and the oil rate (FIG. 23) a picture emerges that is the opposite as was seen in the optimization of the vertical SW-GAGD field-scale application, but very similar to the optimization of the same process using the synthetic block model. A strongly positive relationship is seen between the recovery factor and the gas injection rate while FIG. 23 seems to indicate that the performance of the horizontal SW-GAGD process seems to be insensitive to the oil production rate. It is also clear that the resulting ultimate recovery is quite a bit higher than was seen for the vertical SW-GAGD process.

Figure 25:
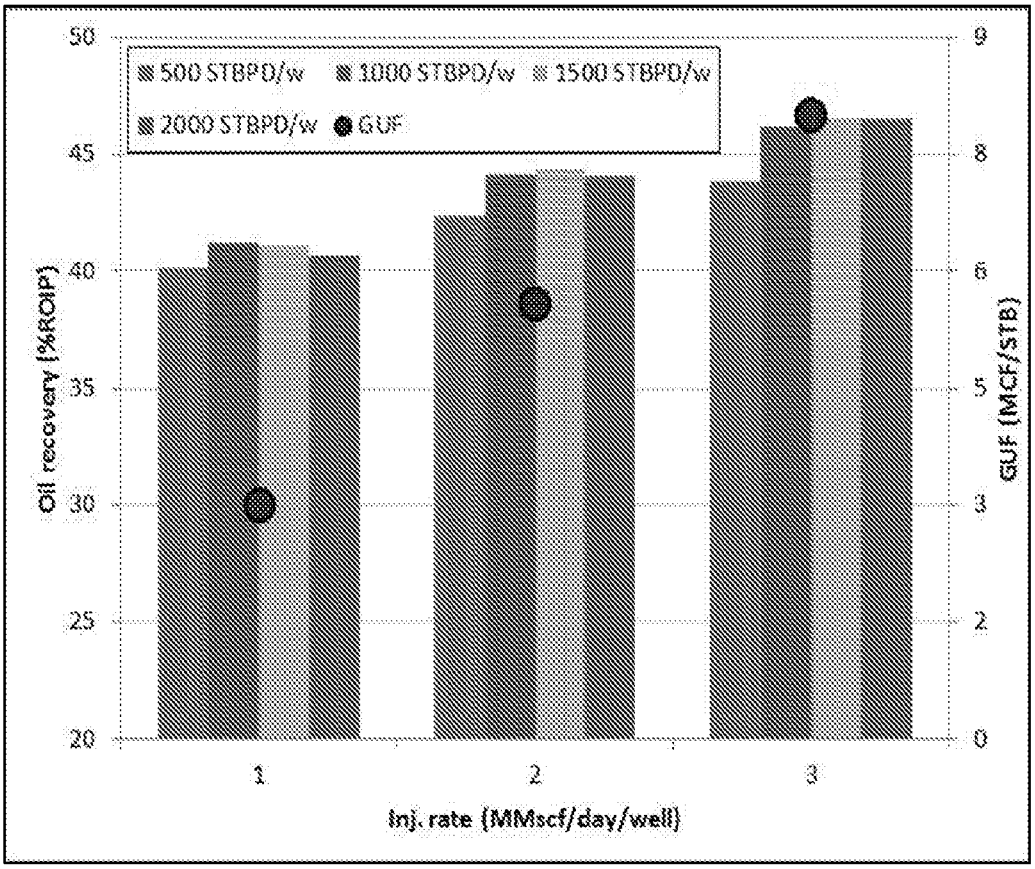
FIG. 25 is a Column Chart of Horizontal SW-GAGD RF and GUF—Field Model.

A contour plot of the GUF (FIG. 25) was again used as a guide for choosing the simulation parameter values for the vertical SW-GAGD process; the following ranges were chosen:

Gas injection rate: 1, 2 and 3 MMSCF/D;

Maximum oil withdrawal rate: 500, 1000, 1500 and 2000 STB/D.

Again, a maximum injection pressure of 4500 psi and a minimum bottom-hole pressure of 500 psi were also used for the injection and production wells, respectively. The run time for each of the simulations was set to be 8 years. The oil recovery results are tabulated in Table 2 and shown in FIG. 25.

TABLE 2

Summary of Horizontal SW-GAGD Oil Recovery Simulation Results

| Max. Oil Production Rate (BPD/well) | Gas Injection Rate (MMSCFD/well) 1 Incremental Recovery (% ROIP) | 2 Incremental Recovery (% ROIP) | 3 Incremental Recovery (% ROIP) |
|---|---|---|---|
| 500 | 40.1 | 42.3 | 43.8 |
| 1000 | 41.2 | 44.2 | 46.2 |
| 1500 | 41.0 | 44.4 | 46.6 |
| 2000 | 40.7 | 44.1 | 46.5 |

The results do indicate that the oil recovery results are significantly higher than when the vertical SW-GAGD configuration was assessed by about 8.5% ROIP on average. However, as was expected from the exploratory optimization phase, the injected gas is not as efficiently used at times as is indicated by the higher GUF values (Table 3) at similar levels of gas injection and oil production rate. In the case of using a horizontal well section for production purposes it not only positively affect oil production by increasing the drainage area and exposure, but it also provides more pathways for the injected gas to be produced along with any reservoir oil/water. This was previously indicated by the comparison of the cumulative GOR-values for both single-well GAGD configurations.

TABLE 3

Gas Utilization Factor of Horizontal SW-GAGD Application in Buckhorn Field

| Max. Oil Prod. Rate (BPD/well) | Vertical | Horizontal | Vertical | Horizontal |
|---|---|---|---|---|
| | Gas Injection Rate (MMSCFD/well) 1 Gas Utilization Factor (Mscf/STB) | | 2 Gas Utilization Factor (Mscf/STB) | |
| 500 | 3.5 | 3.0 | 3.3 | 5.8 |
| 1000 | 2.3 | 3.0 | 3.3 | 5.5 |
| 1500 | 2.3 | 3.0 | 3.3 | 5.5 |
| 2000 | 2.3 | 3.0 | 3.3 | 5.5 |

Deepwater Offshore Environment Application of SW-GAGD.

Figure 26:
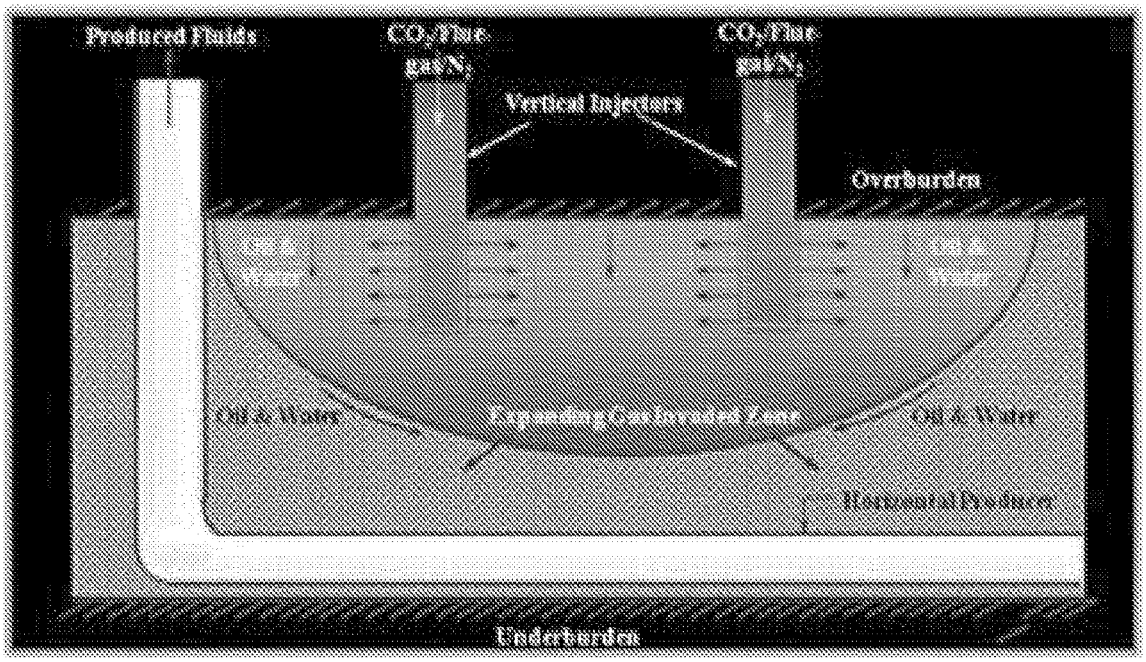
FIG. 26 is a conceptual view of GAGD process (Ref: Rao et al.)

GAGD process is a significant improvement with recoveries in the range of 65-95% over current industry standard WAG process that has yielded 5-10% recoveries. Such high recoveries in case of GAGD process is as a result of excellent volumetric sweep efficiency of the process coupled with high microscopic sweep efficiency associated with gas injection processes. Following events occur in a typical GAGD process (shown in FIG. 26):

Gas is injected at the top of the pay zone using existing (or newly drilled) vertical injectors.

Expanding gas zone pushes oil downward.

Oil drainage and film flow of oil occurs as oil flows to horizontal producer at the bottom of pay.

To emulate the success of GAGD in deepwater offshore environment, where a single well costs in excess of $200 Million, concept of Single-Well GAGD (in short SW-GAGD) has been envisaged. In the novel SW-GAGD process, a single well performs both as an injector and a producer operating in GAGD mode. The single well comprises a vertical portion and one or more horizontal lateral portions. The lateral portions are drilled away from the vertical portion into the productive reservoir or formation.

Proof of Concept of SW-GAGD

Figure 27:
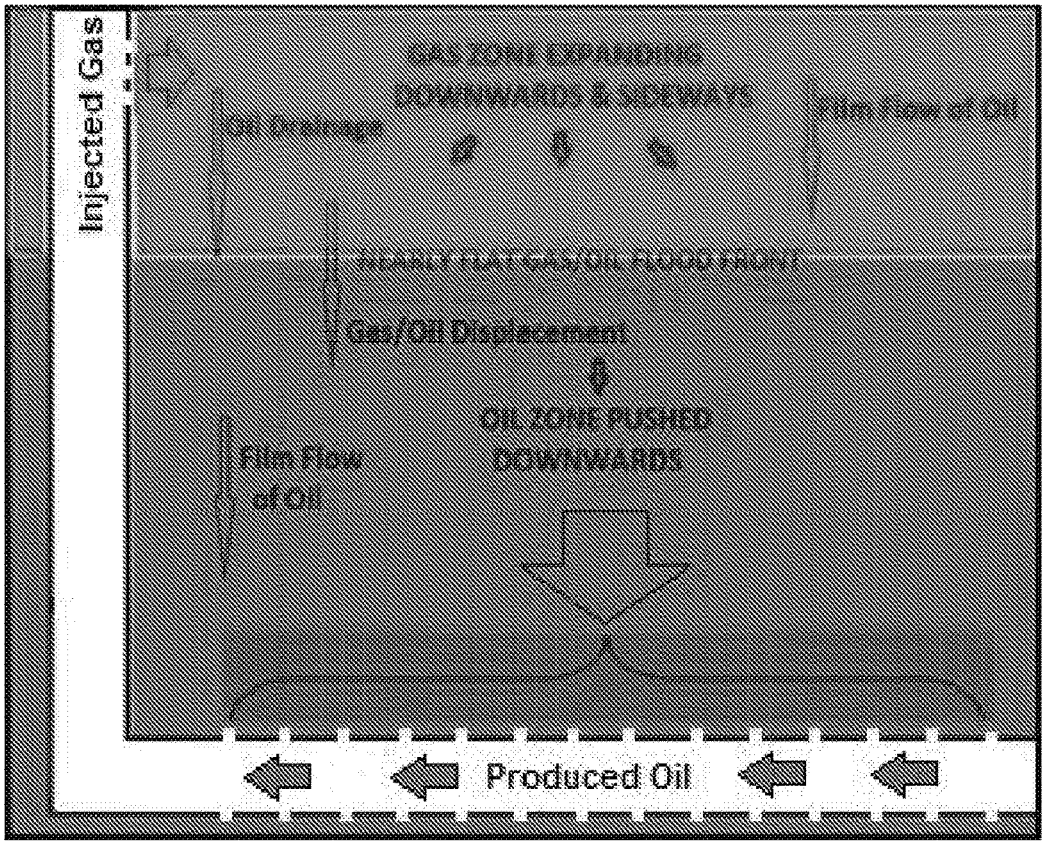
FIG. 27 is a conceptual view of SW-GAGD process.
Figure 28:
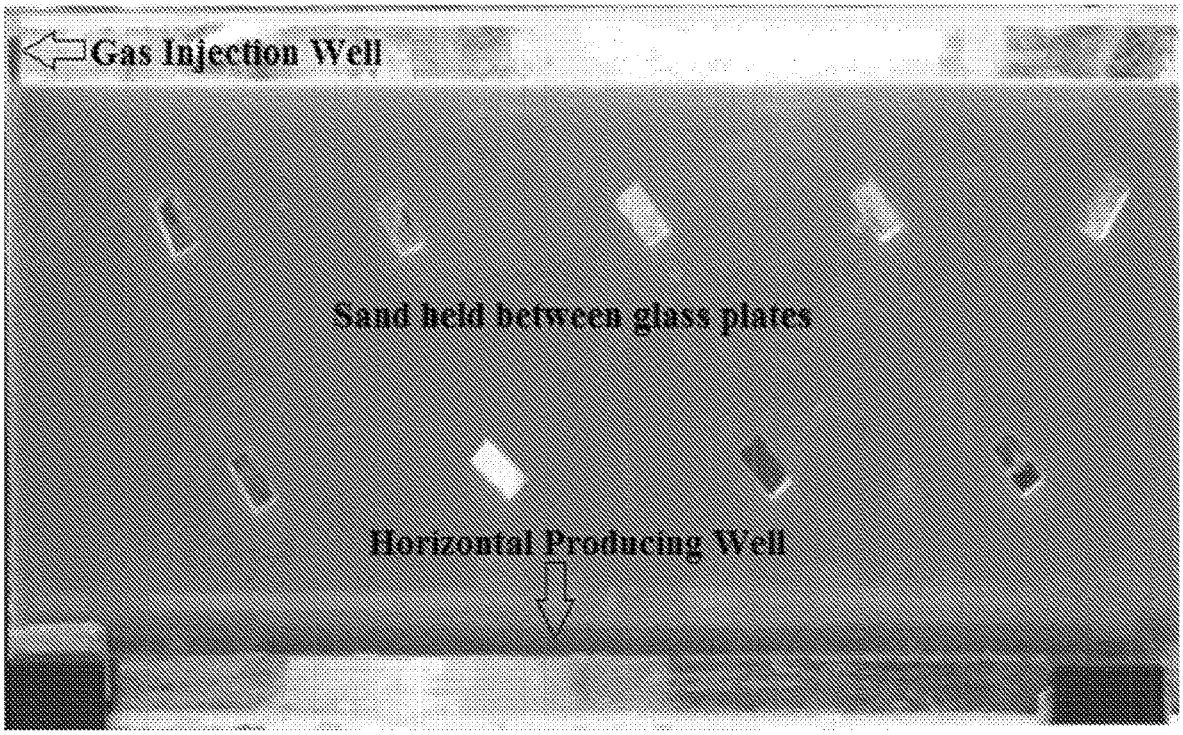
FIG. 28 is a sand-packed glass SW-GAGDE model.

Schematic of the novel concept of SW-GAGD process is shown in FIG. 27. Firstly, proof of concept of SW-GAGD process was carried out using a sand-packed (50/70 mesh sand size) glass model. It had a horizontal producer spanning the entire width of the model and a single injector (top perforations) at the top on one side-edge of the model. FIG. 28 shows an actual sand packed SW-GAGD model.

One of the main concerns with the design of SW-GAGD process was the behavior of the gas front as the gas is injected through the injector. Short circuiting of the injected gas to the horizontal producer was highly suspected. This would have led to poorer sweep of the model area, resulting in shelving of the concept itself.

Figure 29:
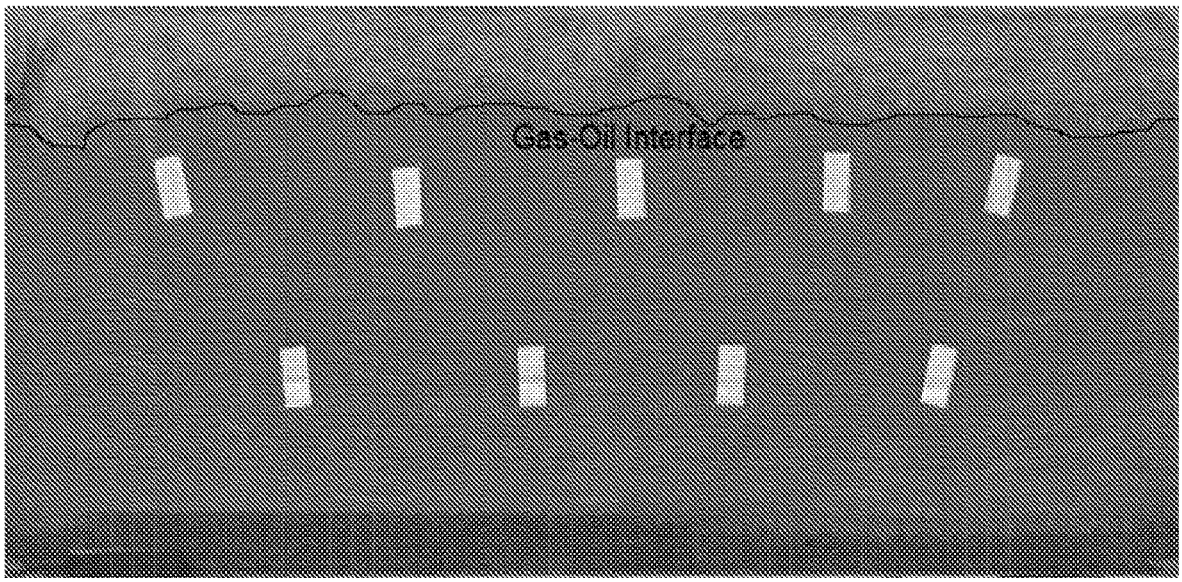
FIG. 29 is a SW-GAGD sandpack model at the beginning of gas-flood, showing development of a gravity stable flat front at the top of same.
Figure 30:
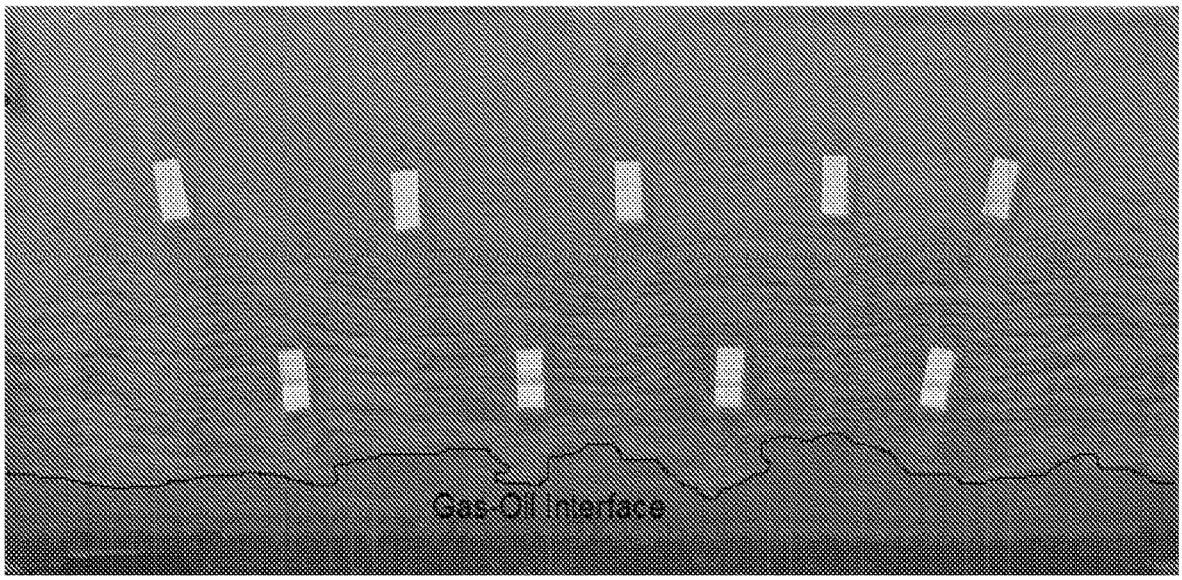
FIG. 30 is a SW-GAGD model with a fully developed gravity stable gas-front showing good vertical sweep of model.

As was visually observed (FIGS. 29, 30), these fears were allayed, when instead of short-circuiting, the injected gas was seen to spread out horizontally to fill the entire model top, before starting a top-down displacement of the model area.

Dimensionless Analysis for Scale-Up

Our objective here is to be able to translate the results obtained with SW-GAGD physical model from laboratory to deepwater Gulf of Mexico reservoirs. This step attempts to bridge the gap that exists between laboratory and field. Our methodology involved the following steps:

Determination of Dimensionless Scaling Groups

Principles of dimensional analysis and scaling were applied to ascertain a set of dimensionless numbers to scale up the performance of laboratory physical model to field scale. In any gravity drainage process in porous media, the forces that affect flow are gravity, capillary and viscous. Dimensionless numbers that are widely accepted in the literature to represent the interplay of these forces are Bond number, Capillary number and Gravity number. Bond number, being a ratio of gravity to capillary forces, gives an indication of the relative importance of gravity force over that of capillary force. Similarly, Capillary number gives the relative importance of viscous force over capillary force. These dimensionless numbers can be used to quantify the dynamic behavior, which has a predominant effect on recovery efficiency, of a gravity drainage process. They thus help to compare not only the dynamic behavior but also the recovery factor of gravity drainage processes across different scales.

Choice of Representative Deepwater Gulf of Mexico Reservoir Properties

Deepwater Gulf of Mexico reservoirs represent varied and complex geology, rock and fluid properties and drive mechanisms. Hence no single reservoir will be representative of the gamut of reservoirs encountered in the deepwater Gulf of Mexico. For our task, one of the prolific reservoirs in the deepwater Gulf of Mexico, viz., N/O reservoir in Mars field1 was chosen. N/O (Yellow) reservoir is a Miocene to Pliocene age sand with a thickness of 99 ft. and acreage of 4,917 acres. Initial reservoir pressure at datum was 11,305 psia with OOIP of 535 MMSTB. The reservoir is highly overpressurized and highly compacting with a limited aquifer influx. Reservoir also has good vertical and horizontal permeability and good connectivity. Reservoir pressure went down to 6800 psi when water injection was started to keep the reservoir producing above bubble point pressure (6,306 psia) and also to avoid compaction of the reservoir. Waterflood recovery is estimated at 56% for the reservoir. For our hypothetical SW-GAGD application the intervention pressure has been chosen to be slightly above the saturation pressure at 6500 psia. Though the base properties are that for Mars field, in order to represent the entire span of deepwater Gulf of Mexico reservoirs, rock and fluid properties have been spread out to cover the full range of properties encountered in DGOM.

Calculation of Dimensionless Numbers

The following definitions have been used while calculating the dimensionless numbers.

$$N_B = \frac{\Delta\rho_{(oil-gas)} g\left(\frac{K}{\phi}\right)}{\sigma_{og}} = \frac{\Delta\rho\left(\frac{kg}{m^3}\right) g\left(\frac{m}{s^2}\right) L^2(m^2)}{\sigma_{og}\left(\frac{N}{m}\right)} = M^0 L^0 T^0 \quad (1)$$

-continued $$N_C = \frac{v\mu}{\sigma} = \frac{v\left(\frac{m}{s}\right)\mu(Pa\cdot s)}{\sigma_{og}\left(\frac{N}{m}\right)} = M^0 L^0 T^0 \quad (2)$$

$$N_G = \frac{\Delta\rho_{(oil-gas)} g\left(\frac{K}{\phi}\right)}{v\mu} = \frac{\Delta\rho\left(\frac{kg}{m^3}\right) g\left(\frac{m}{s^2}\right) L^2(m^2)}{v\left(\frac{m}{s}\right)\mu(Pa\cdot s)} = M^0 L^0 T^0 \quad (3)$$

Since, some of the rock and fluid property data were missing for Mars field, analogs were used from other deepwater Gulf of Mexico reservoirs to obtain those properties. Injectant gas used is Nitrogen gas and the displacement process is characterized as immiscible to near miscible. Choice of immiscible to near miscible displacement is necessitated by the fact that at miscibility conditions, IFT between gas and oil phases will become zero and that will make these dimensionless numbers infinite. Since, this exercise is for comparing the dynamic performance of the process across different scales, this assumption will not limit the merit of the comparison. The use of nitrogen in place of CO2 is considered from an economic perspective, as Nitrogen can be generated on site whereas CO2 will have to be transported across hundreds of miles. As can be seen from equations (1)-(3), the parameters and properties needed for the calculation of the dimensionless numbers are: $\Delta\rho_{og}{}^2$, L, $\sigma_{og}{}^3$, $v^4$ and $\mu^1$. For calculation of v (Darcy velocity), the base injectivity value was chosen to be one half of the peak gas production rate from a similar depth well (Mica) in the deepwater Gulf of Mexico. This was done as there were no reported values for gas injectivity in deepwater Gulf of Mexico as there isn't a single gas injection projects in there till date.

Range of Values for Dimensionless Numbers

The range of values for the dimensionless numbers are presented below.

| Dimensionless Nos. | Typical Value | Minimum Value | Maximum Value |
|---|---|---|---|
| $N_B$ | 3.42E−05 | 7.73E−06 | 7.52E−03 |
| $N_C$ | 5.36E−09 | 3.57E−10 | 3.06E−04 |
| $N_G$ | 6370.53 | 5.05 | 105228.61 |

Here, typical value represents the value observed for the base properties and the range is depicted through minimum and maximum values.

Dimensionless Numbers for the Physical SW-GAGD Model

Having obtained the range of dimensionless numbers for deepwater Gulf of Mexico fields the next task is to construct the SW-GAGD model and to choose appropriate fluids to obtain the dimensionless numbers within the range exhibited by DGOM reservoirs. Dimensionless numbers have been calculated for a typical SW-GAGD model with the following specifications:

Dimensions: 22"×10"×0.37"

Sand Size: 60 Mesh (0.251 mm)

Fluids: Decane and N2

Gas Injection Rate: 10 cc/min

The calculated values obtained for Bond number ($N_B$) and Capillary ($N_C$) numbers for this model are 1.92*10-5 and 3.11*10-5. These values are within the range of values for the deepwater Gulf of Mexico reservoirs. Hence, it can be safely asserted that our results obtained with SW-GAGD physical model can be translated to DGOM reservoirs.

Performance of a SW-GAGD Model Configuration with Top Injection Point

Figure 31:
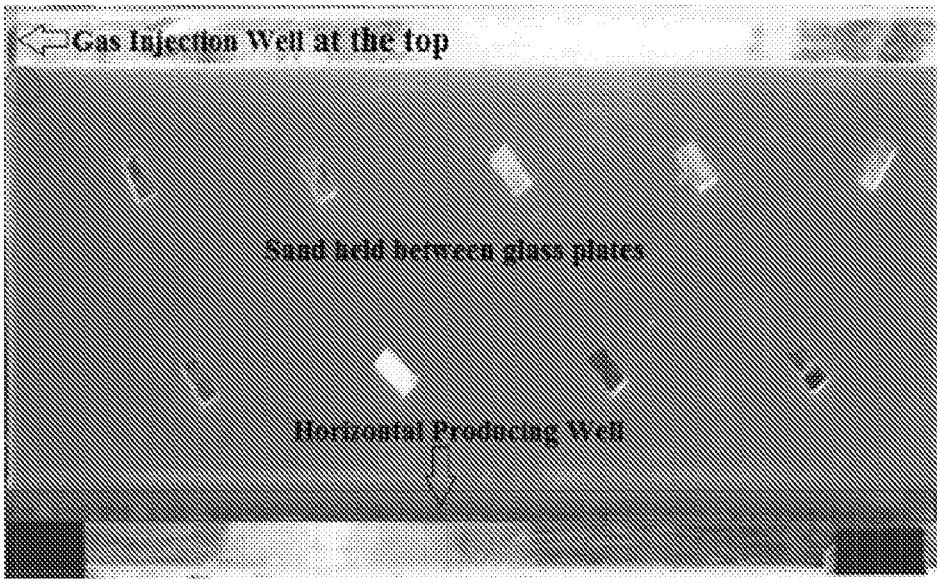
FIG. 31 is a SW-GAGD configuration with injection well at the top.

This is the first and the most basic configuration of SW-GAGD model that was tested for its performance. Here as the title states, the injection point for the SW-GAGD model is at the very top of the payzone. A schematic of the model is shown in FIG. 31.

Effect of Rate on SW-GAGD Model Recovery

Figure 32:
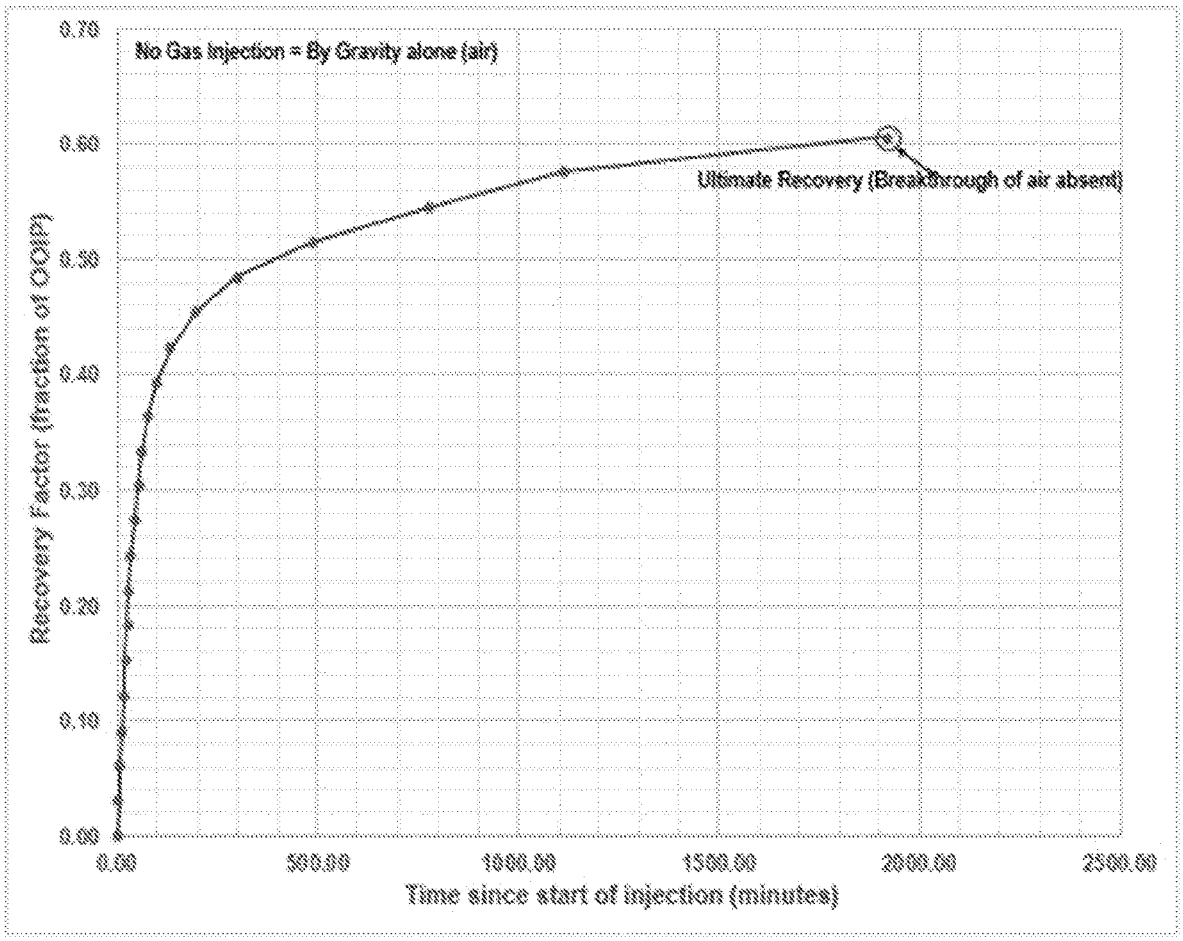
FIG. 32 is recovery Fs Time in case of pure gravity drainage (without Nitrogen Injection).

One of the most important operational parameter is the rate of injection of the injected gas. Too high a rate is fraught with viscous instability and early breakthrough of the injected gas leading to poorer sweep and too low a rate would mean low production rates and low ultimate recoveries. In this study, Nitrogen gas, was injected at 5 different flow rates, viz., 2.5, 5, 10, 15 and 20 SCCM. The Nitrogen gas was chosen as it was immiscible with Decane, the oil phase in the model. Recovery of the model was also evaluated when the production was simply due to gravity without the injection of Nitrogen gas. FIG. 32 shows this base case when the production was solely because of gravity.

Figure 33:
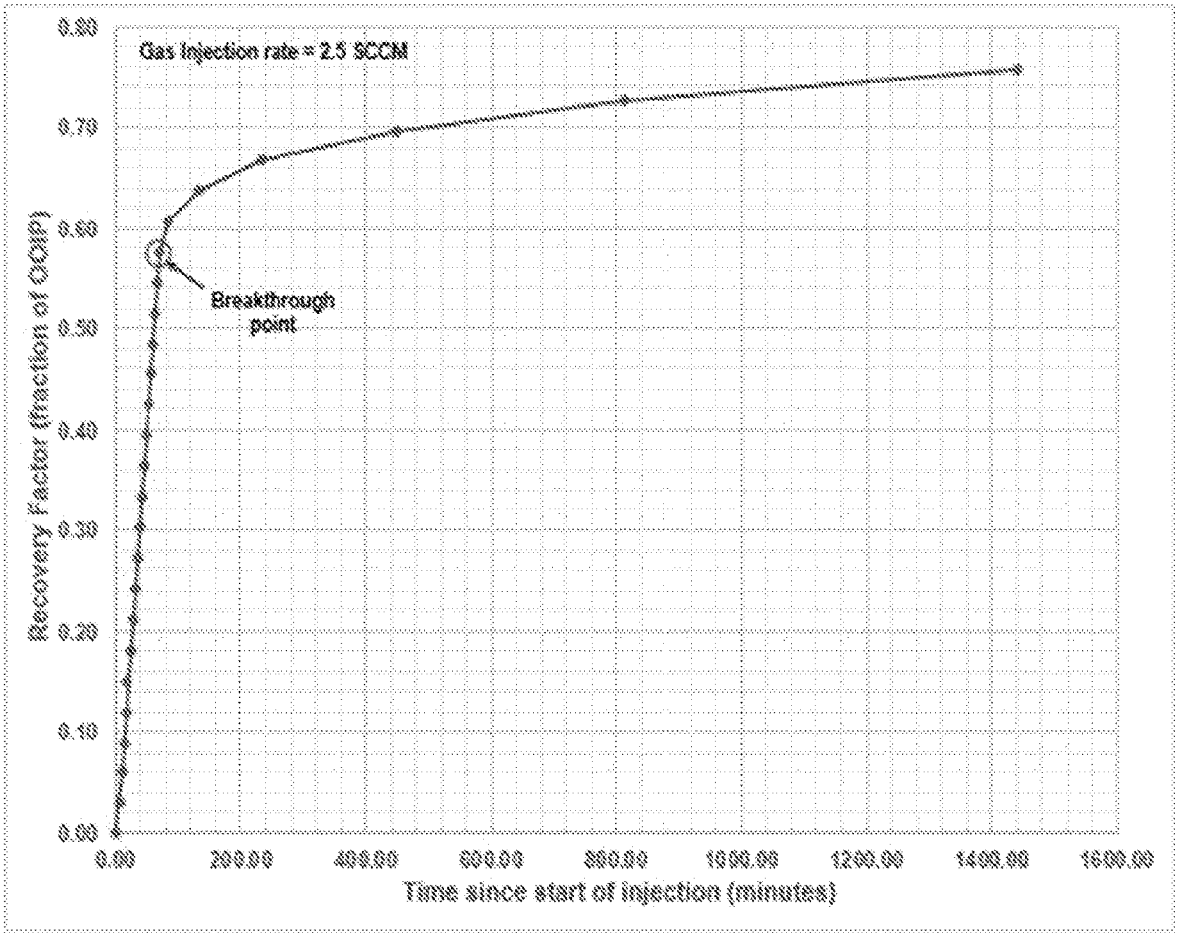
FIG. 33 is recovery Vs Time in case of injection rate of 2.5 SCCM.
Figure 34:
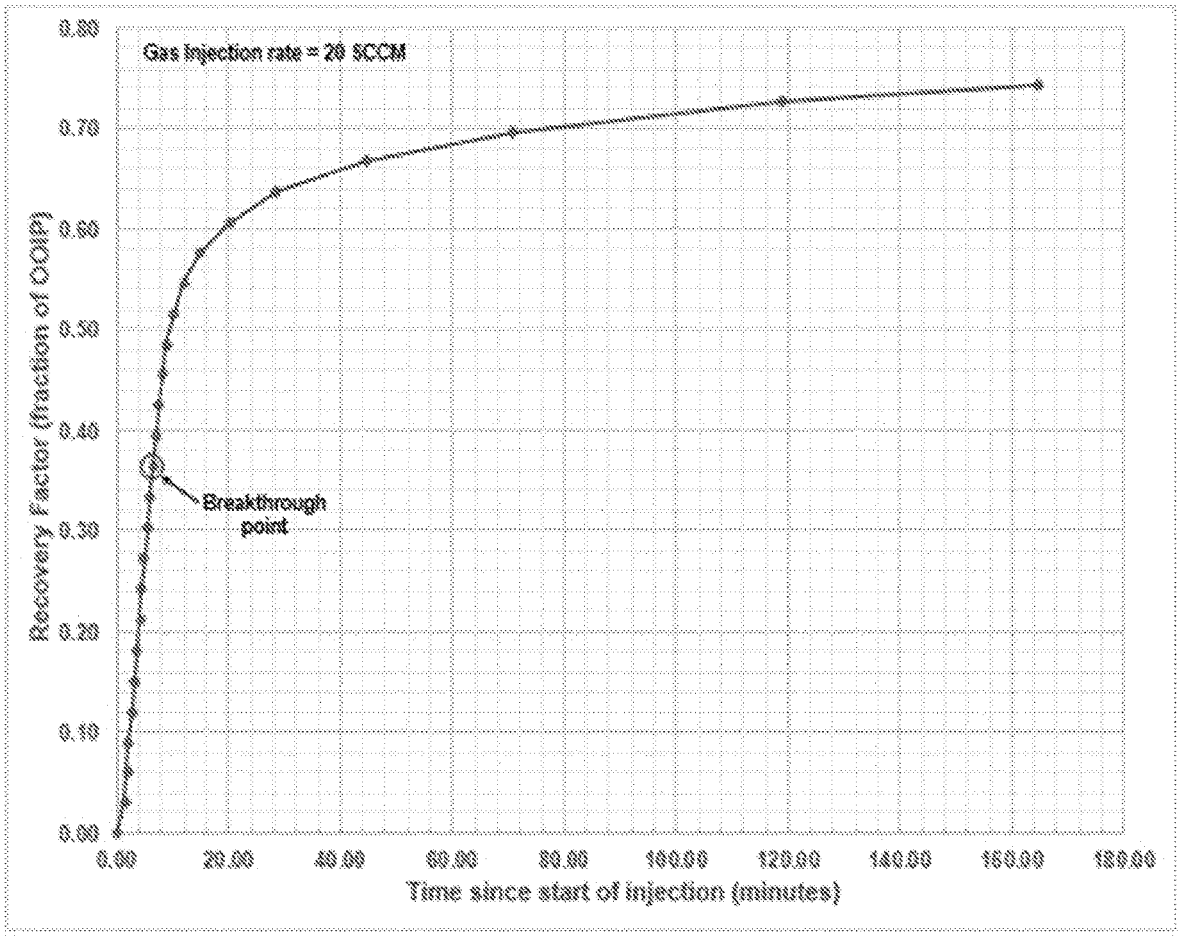
FIG. 34 is recovery Vs Time in case of injection rate of 20 SCCM.

As can be seen from FIG. 32, the production rate gradually slowed down with time and the ultimate recovery was around 61%. Almost 39% of the OOIP remained trapped within the model because of the capillary and frictional forces. FIGS. 33 and 34 show the corresponding recoveries for two injection rates of 2.5 and 20 SCCM. Comparing FIG. 32 for pure gravity drainage with that of FIGS. 33 and 34, it is apparent that injection of gas not only increases the recovery factor but also increases the production rates by many fold.

Figure 35:
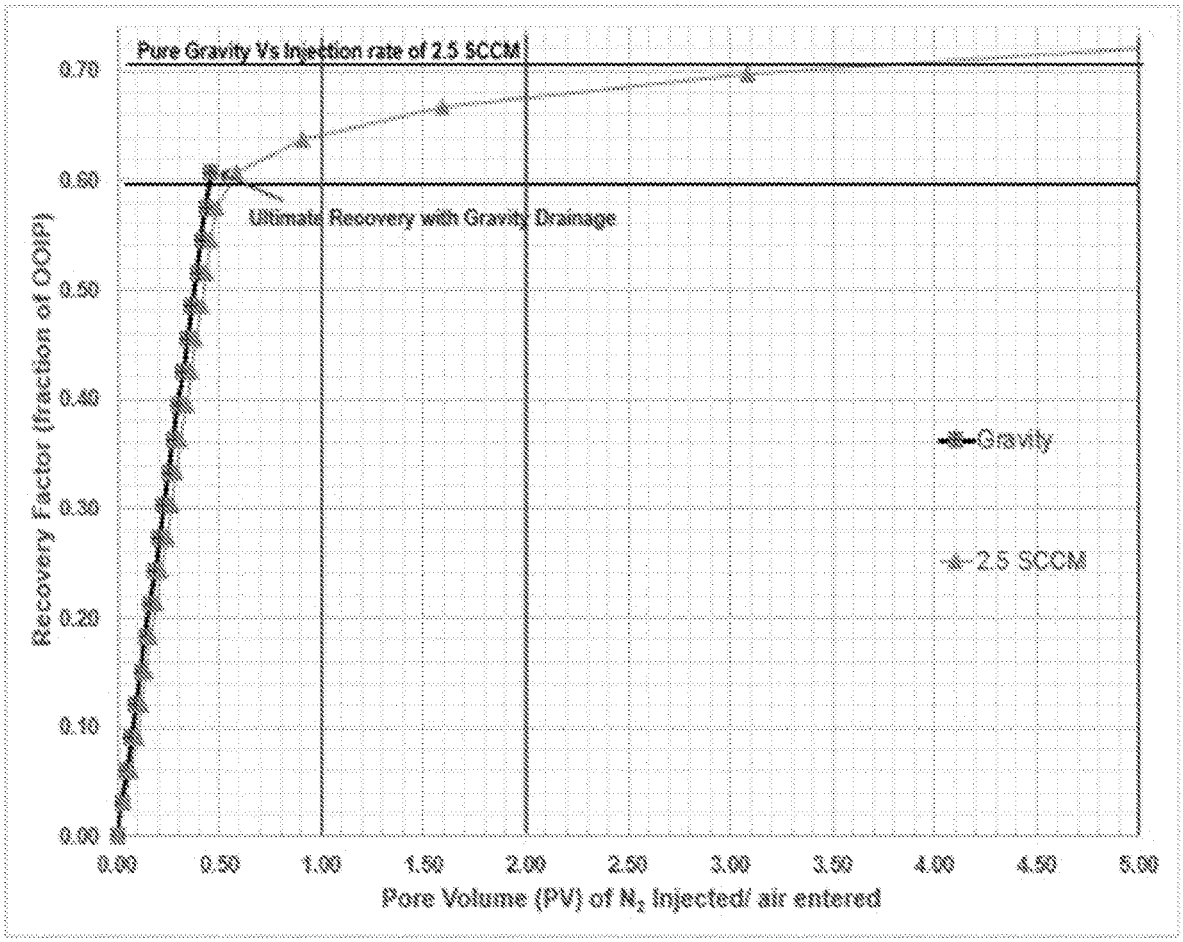
FIG. 35 is Pure Gravity Drainage Vs 2.5 SCCM of Gas Injection.

Recovery by gravity drainage is touted as one of the most efficient recovery method and the only drawback with natural gravity drainage process is the speed of such a process. By the injection of gas, we are able to remove this inherent drawback as well as increase the recovery factor. The increase in the recovery factor is clearly evident looking at FIG. 35. As can be seen from FIG. 35, by just having an injection rate of 2.5 SCCM, the recovery at 1 PV of gas injection exceeds the ultimate recovery associated with pure gravity drainage by 3% OOIP and that goes up to 5.5% at 2 PV of gas injection. The additional recovery with gas injection is because of overcoming of capillary and frictional forces by the injected gas.

Figure 36:
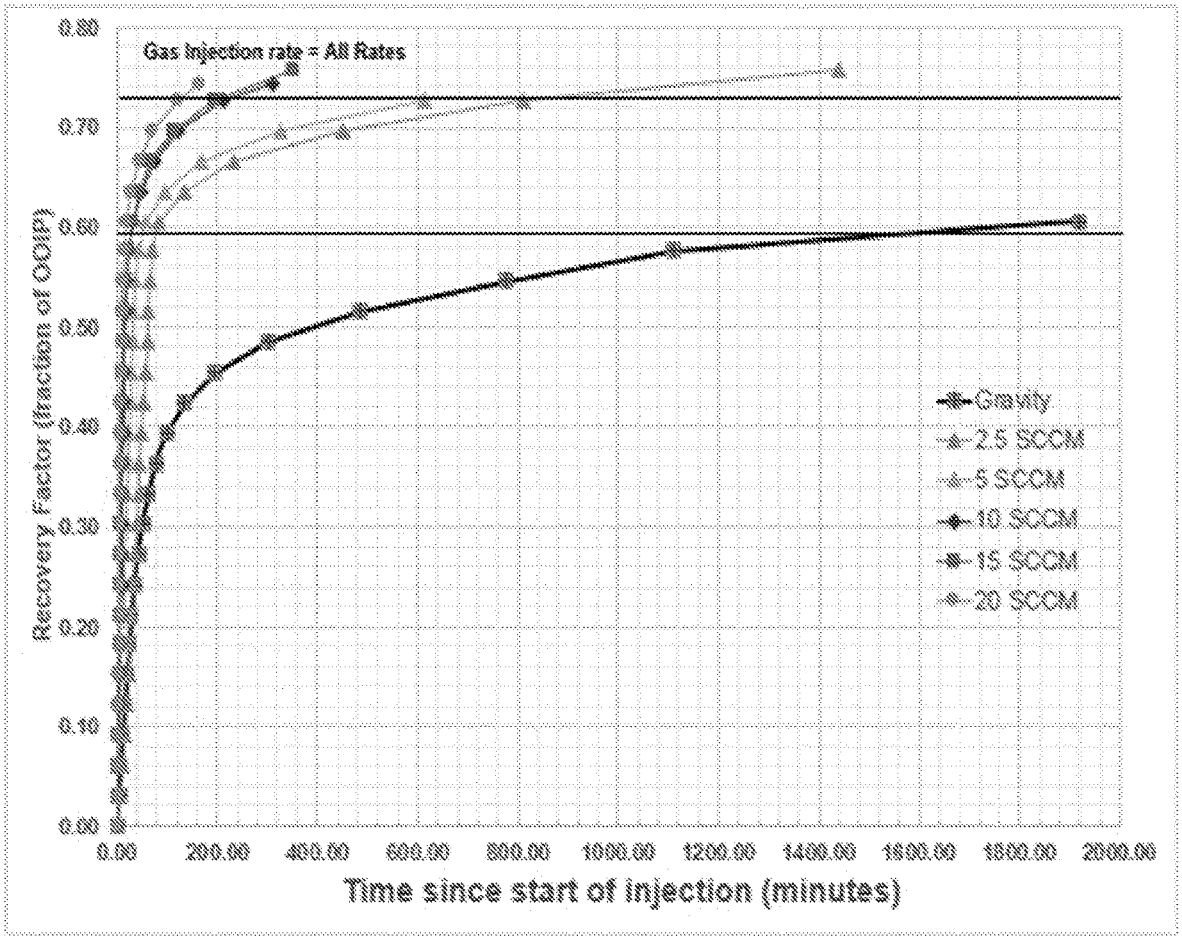
FIG. 36 is Recover Factor Vs Time for all rates.

As stated earlier, the rate of recovery plays an important factor determining the economics associated with the production of hydrocarbons. Without high enough production rates, the most efficient recovery method will have no meaning. FIG. 36 compares recovery factor at different rates including that of pure gravity drainage.

Considering the amount of time required to get to the ultimate recovery factor of 61% for pure gravity drainage, it can be seen that it takes much shorter to reach the same recovery factor in case of forced gravity drainage. Table below lists the time taken in each of the cases of pure gravity drainage, 2.5 SCCM injection rate and 20 SCCM injection rate for achieving 61% recovery factor.

| Rate/Mode | Time taken to reach 61% recovery factor |
|---|---|
| Pure Gravity Drainage | 1860 mins |
| Injection Rate = 2.5 SCCM | 80 mins |
| Injection Rate = 20 SCCM | 20 mins |

Figure 37:
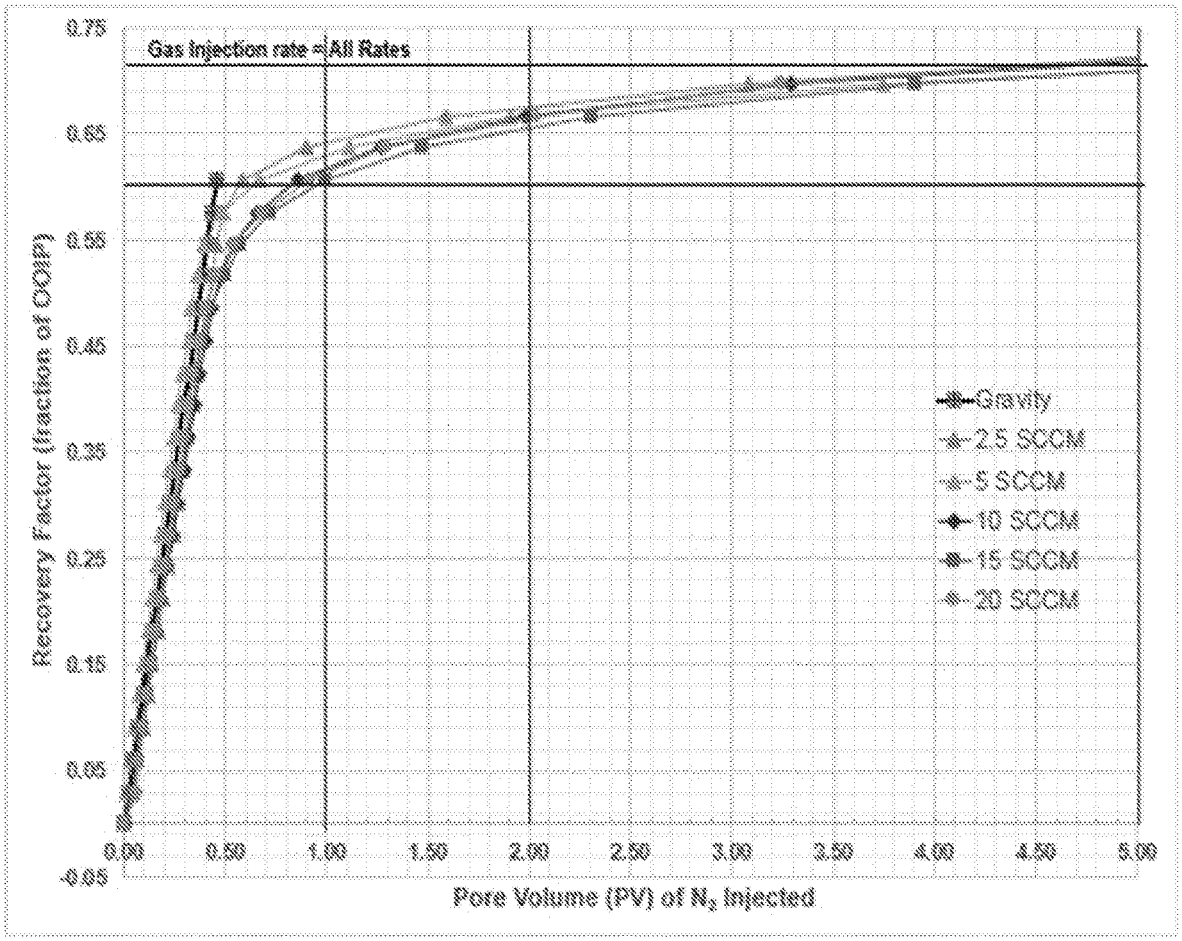
FIG. 37 is Recovery Factor Vs PV Injected for all rates.
Figure 38:
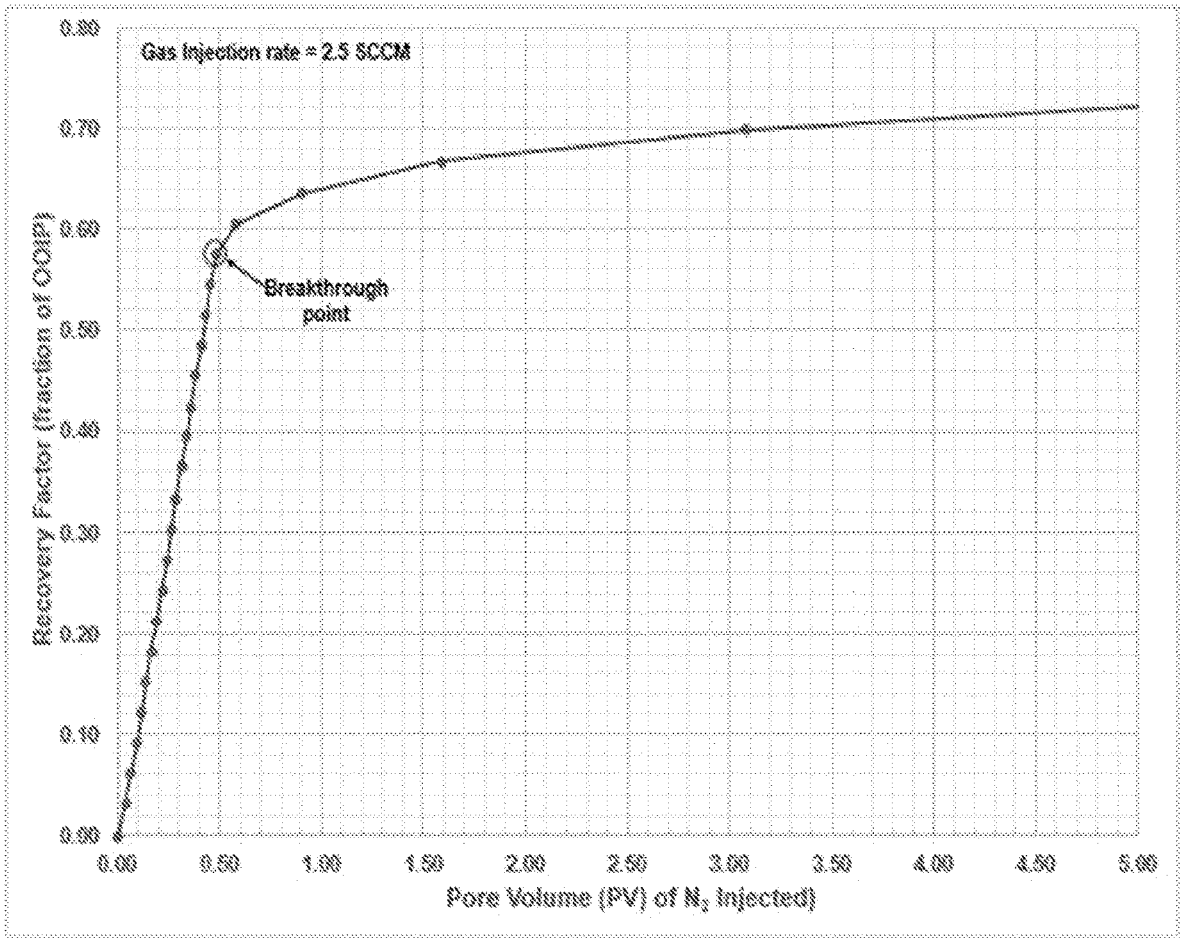
FIG. 38 is Recovery Factor Vs PV Injected at a rate of 2.5 SCCM.
Figure 39:
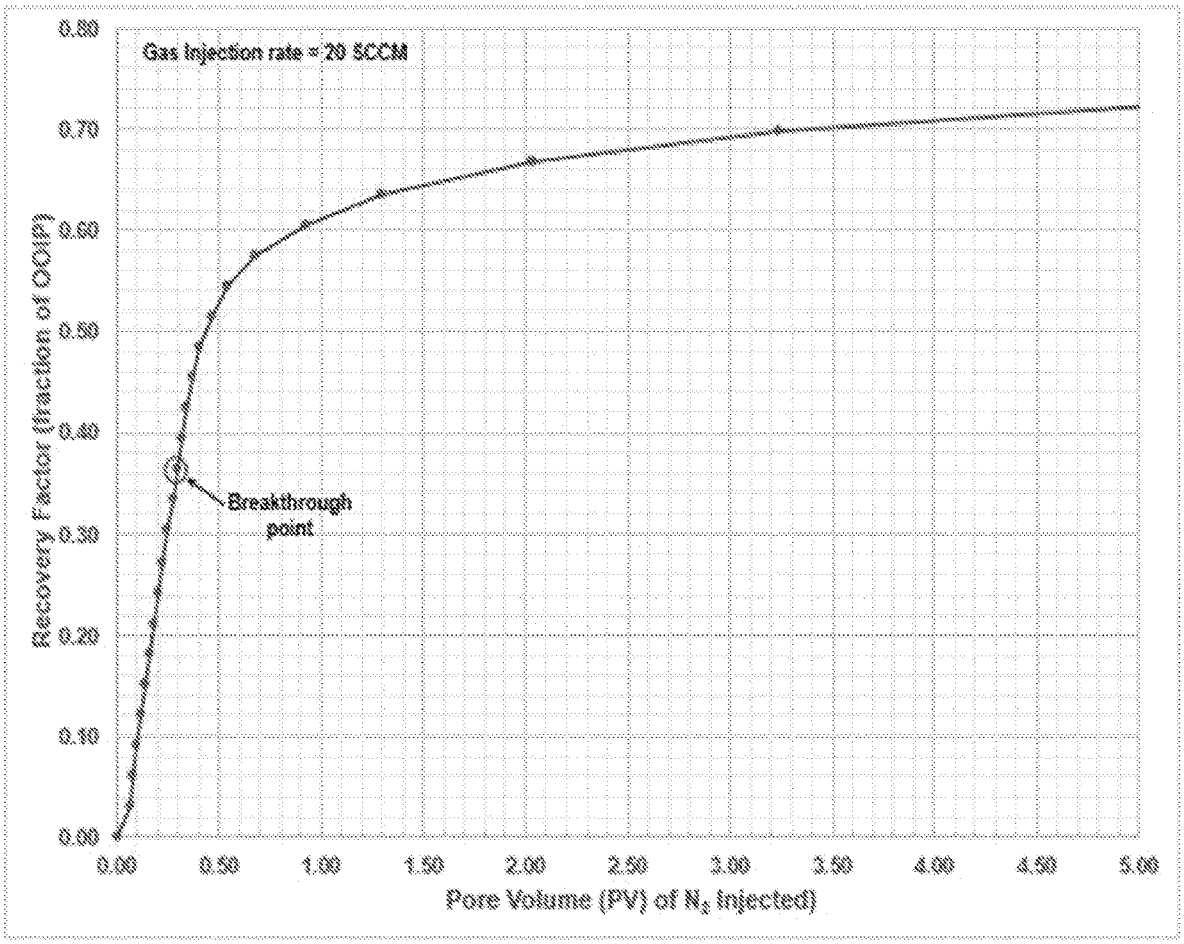
FIG. 39 is Recovery Factor Vs PV Injected at a rate of 20 SCCM.

As can be seen from the table, time taken in case of 2.5 SCCM is 23 times faster than pure gravity drainage and that in case of 20 SCCM injection rate is 93 times faster. Thus gas injection imparts significant rate enhancement to the gravity drainage process. At this point, the question that arises is whether higher injection rates are better than lower injection rates? Not always! Of course, we get a tremendous enhancement in rates with higher injection rates but the recovery factor takes a hit. As can be seen in FIG. 37, the recovery factor at 1 PV injected is higher in case of lower rates than higher rates. The recovery factor does catch up at higher PVs injected though, for example, at 5 PV injected the difference in recovery factor almost vanishes. The reason we have lower recovery factor at 1 PV of gas injection for higher rates is because of early arrival of gas-oil displacement front at the production well. There is a sharp discontinuity in rates of production before and after the arrival of the gas-oil displacement front at the production well. Before the arrival of gas-oil front at the production well, the production is primarily due to displacement at the gas-oil interface. Post arrival of the gas-oil interface at the production well, there is no clear displacement front and the production continues through the interplay of forces of gravity, capillary and inertial. The oil continues to drain to the bottom of the payzone due to gravity. As it drains, it tries to connect to other aggregates of left out oil so to form a continuous layer of oil in the already swept out region. Breakthrough of injected gas at the production well however does not necessarily coincide with the sharp decline in production rates. This is more pronounced in case of higher rates. FIGS. 38 and 39 are the recovery plots for the two injection rates of 2.5 SCCM and 20 SCCM.

As is evident from FIGS. 38 and 39, production rate does not plateau out as swiftly upon breakthrough in case of injection rate of 20 SCCM as in 2.5 SCCM. Thus rather than breakthrough point, it is the point at which the gas-oil displacement front reaches the production well is more significant in terms of sharp decline in production rate. As long as the displacement front is above the horizontal production well, gravity forces play a predominant role in nullifying the breakthrough of injected gas.

Effect of Miscibility

Figure 40:
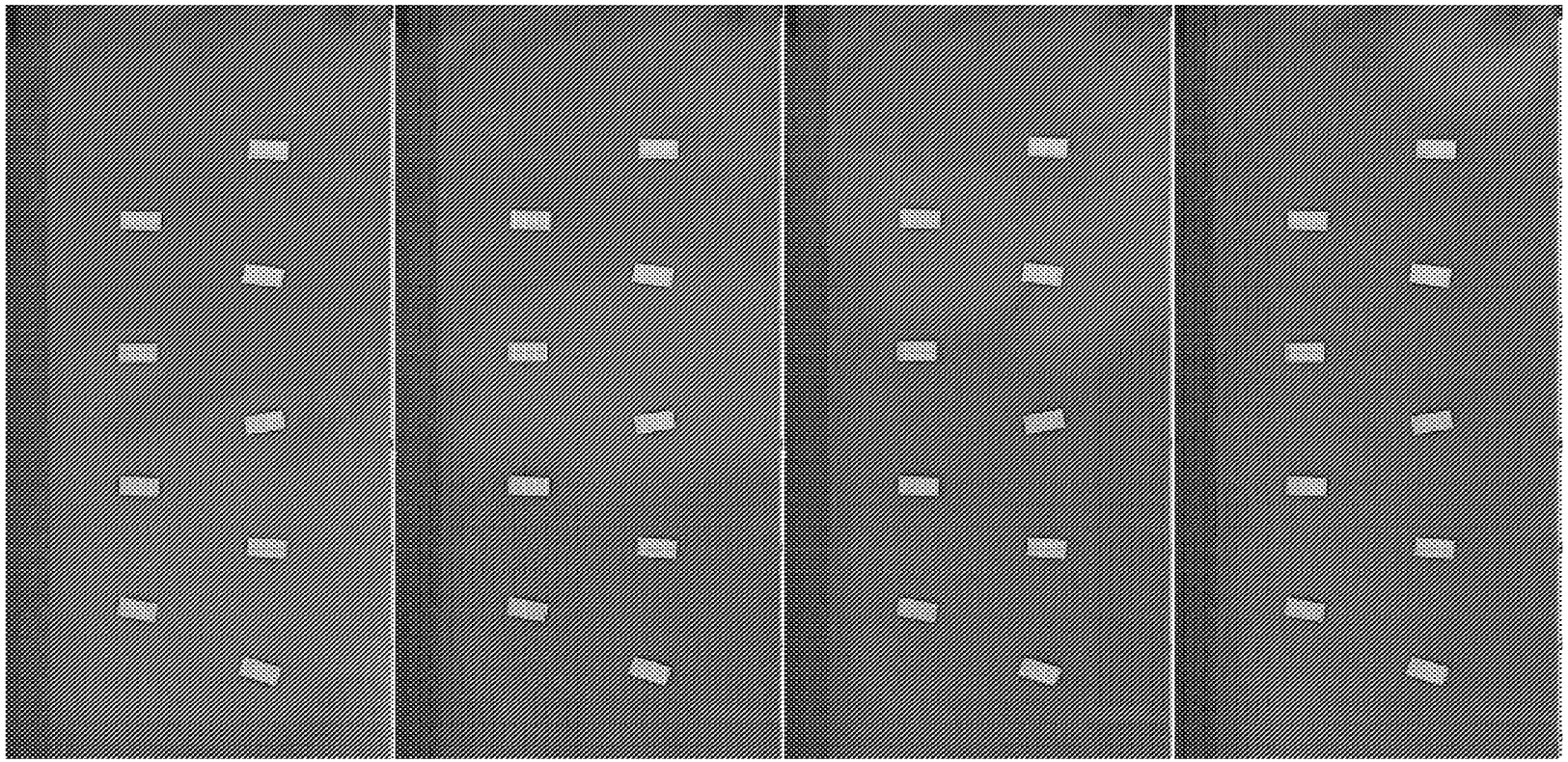
FIG. 40 is a miscible SW-GAGD Process in progress (sequenced top to bottom).

As seen in the previous cases, the recovery factor stands at around 70-75% for immiscible Nitrogen gas injection at 5 PV of injected gas for SW-GAGD processes. Rest 25-30% oil remains trapped inside the model because of the capillary forces. Since, miscibility leads to vanishing of capillary forces, thus using miscible injectant even this remaining oil can be recovered using SW-GAGD process. However, the glass models are not able to withstand pressures beyond 2 psi. Hence it's not possible to do a miscible CO2 flood using glass models. So, we tried to mimic miscible CO2 injection by using Naphtha (miscible with Decane) as the injectant to displace Decane oil. Densities of Decane and Naphtha are comparable at 0.73 g/cc and 0.72 g/cc respectively and this in essence represented the densities of miscible CO2 and Crude oil in an actual reservoir. FIG. 40 shows the progression of a miscible SW-GAGD process in a reservoir.

As can be visually observed from the FIG. 40, the microscopic displacement efficiency is 100% for the flood, thus giving a totally clear color in the swept region. Thus, as mentioned earlier, using a miscible SW-GAGD progress, theoretically, 100% of the oil should be recoverable.

Effect of Injection Depth—Top Vs Bottom Injection Point SW-GAGD Model

Figure 41:
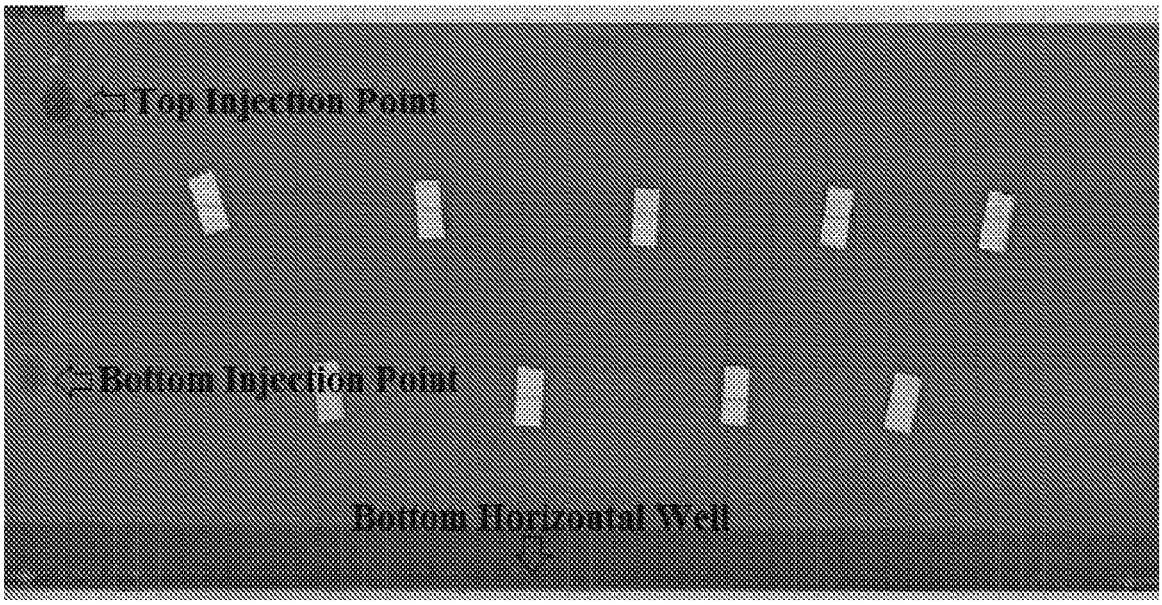
FIG. 41 is a SW-GAGD configuration with both a Top and a Bottom Injector wells.
Figure 42:
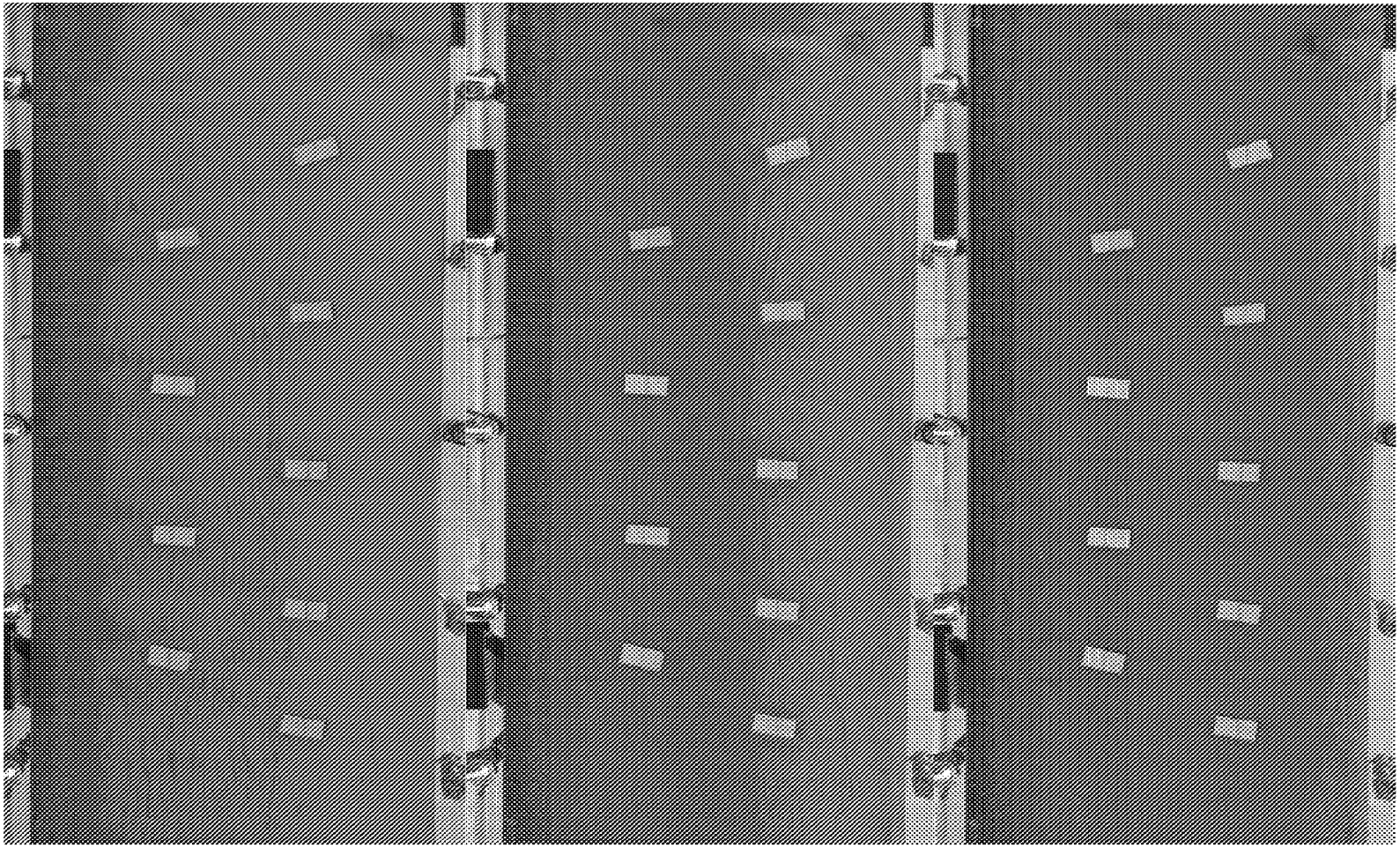
FIG. 42 is development of displacement front with Top injection (sequenced top to bottom).
Figure 43:
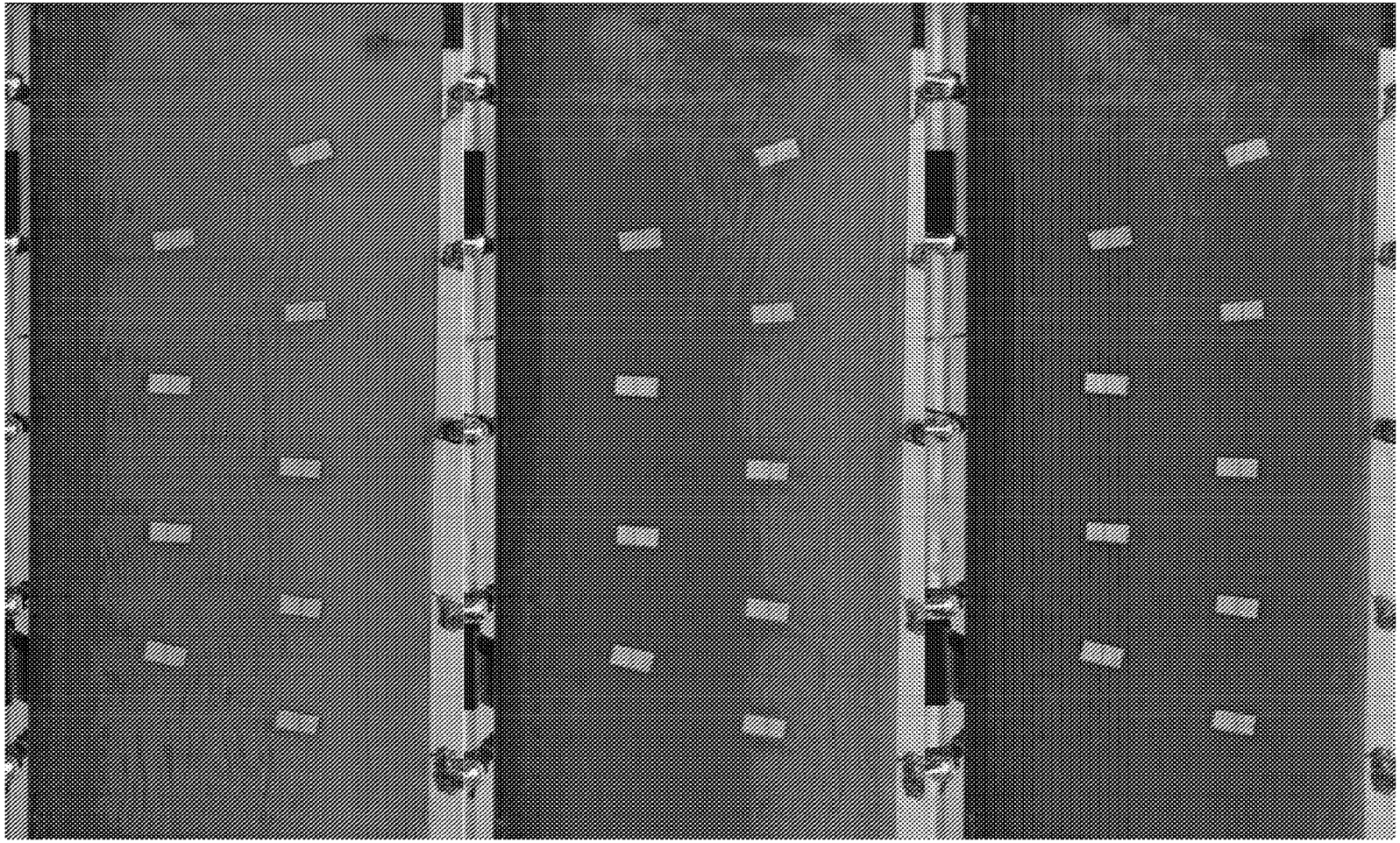
FIG. 43 is development of displacement front with Bottom injection (sequenced top to bottom).
Figure 44:
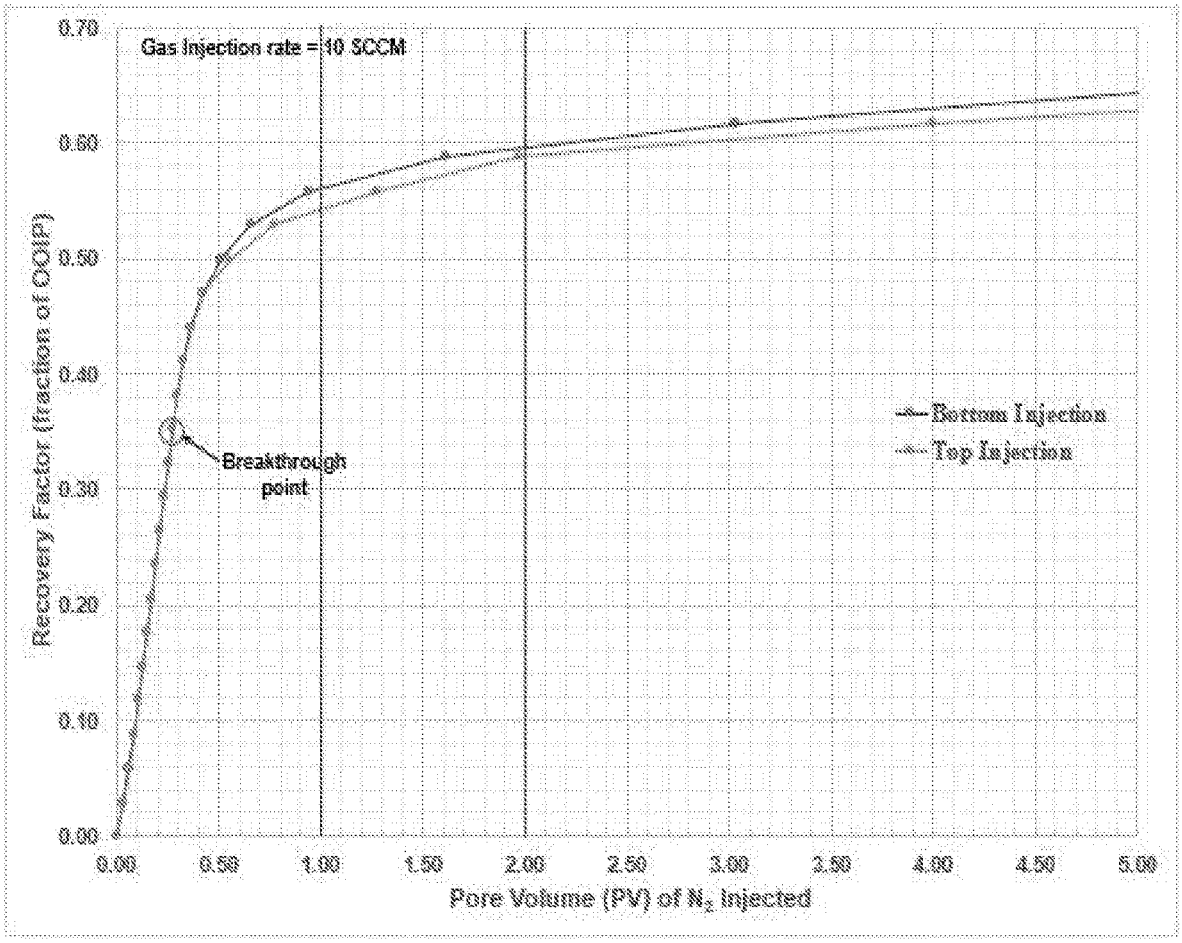
FIG. 44 is recovery plot for Top Vs Bottom Injection.

To investigate the effect of depth of injection point in case of SW-GAGD model, a model was built with concurrent placement of a top and bottom injector well within the same model. FIG. 41 shows the SW-GAGD configuration indicating the location of the injection points. Injection at the bottom injection well was fraught with suspicion of short-circuiting towards the bottom horizontal well as the injection point was much closer to that well. But it was observed that the injected gas rather than moving downward, headed upward to fill the model top first before doing a top-down displacement. FIGS. 42 and 43 shows the development of displacement front with injection at top and bottom injection point respectively. No difference was observed in terms of development of the displacement front in both cases. However, looking at the recovery plot (FIG. 44), there is marginal difference between the 2 cases. In case of bottom injection, recovery factor after breakthrough is higher by 2% and 1% at 1 PV and 2 PV injection respectively. This difference is attributed to boosting of inertial forces at the bottom of the payzone where most of the capillary and frictional trapping occur.

Looking at the recovery plot (FIG. 44), even though there seems to be marginal benefit with bottom injection, it may not be actually beneficial in field application when layering of the reservoir may be an issue. Detail discussion on the effect of layering on production is included under discussion on Toe-Heel configuration.

SW-GAGD Vs GAGD Model

Figure 45:
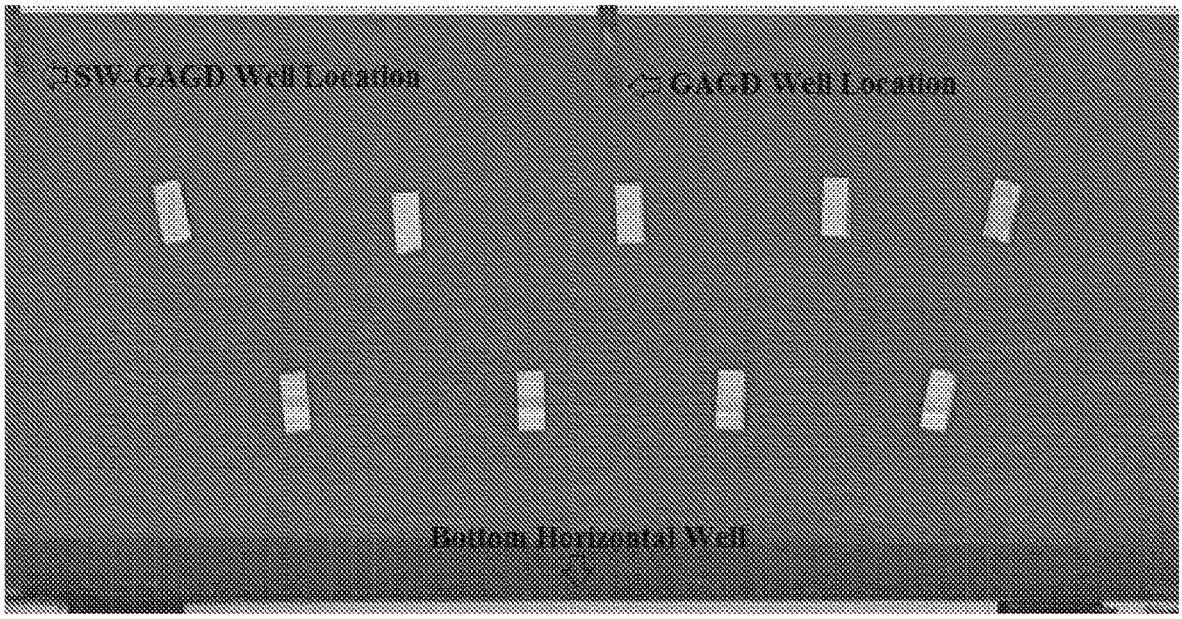
FIG. 45 is SW-GAGD Vs GAGD well configuration.

Comparison between a SW-GAGD well configuration and a GAGD well configuration is critical to the design of SW-GAGD process. It was anticipated that SW-GAGD might not perform as well as a GAGD process, wherein the injection point is symmetrically located with respect to horizontal production well. Even though the injected gas was observed to spread out at the top before initiating a top-down displacement in case of SW-GAGD well configuration, there were doubts about the progress of the displacement front from start to finish of injection. Moreover, there were apprehensions that mere match of displacement profile between them may not mean identical efficiencies in recoveries. So, to put these doubts to rest, a model was built with concurrent placement of 2 wells in SW-GAGD and GAGD configuration each. FIG. 45 shows the actual model where both SW-GAGD and GAGD well locations are identified.

Figure 46:
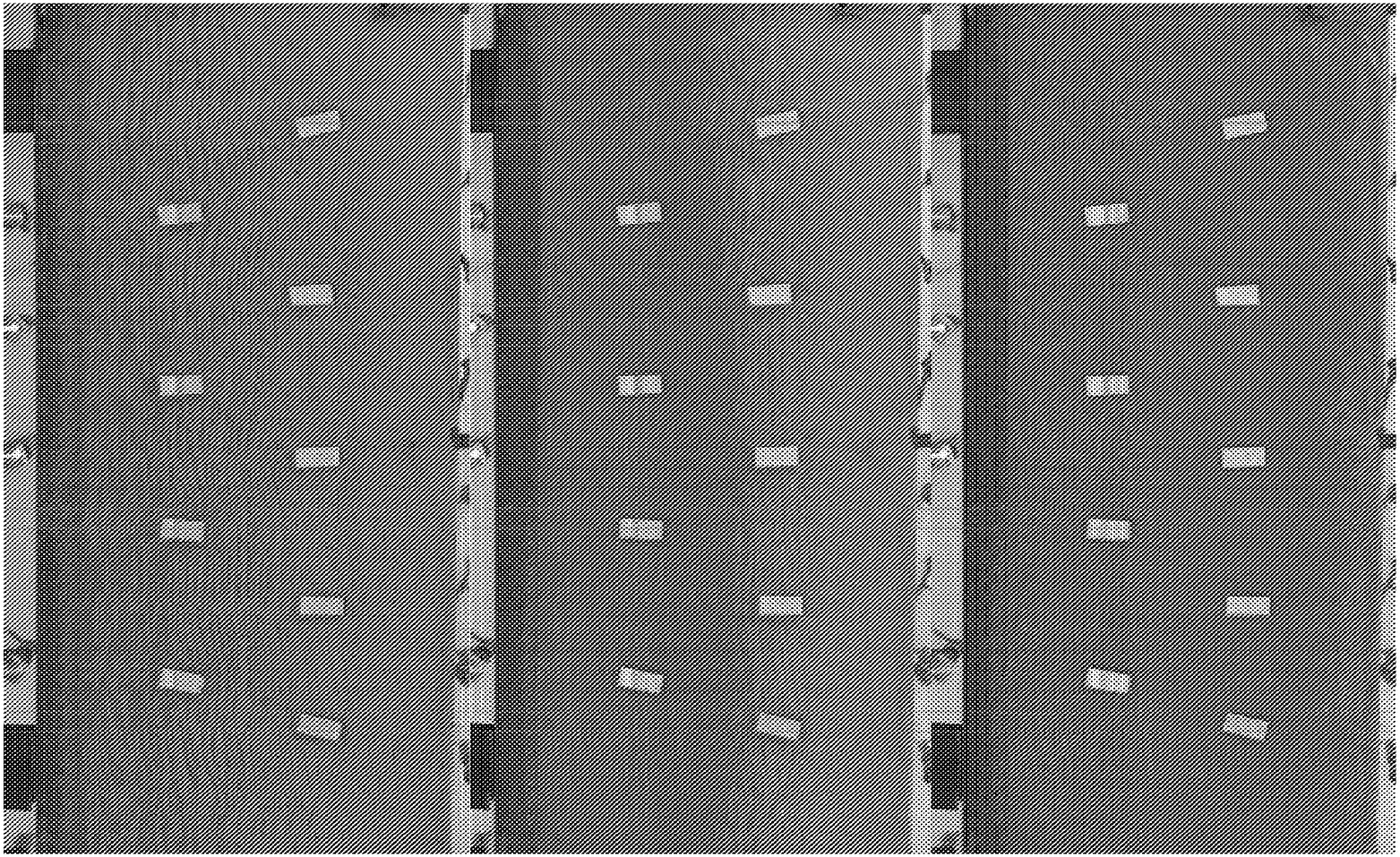
FIG. 46 is development of displacement front with SW-GAGD well configuration (sequenced top to bottom).
Figure 47:
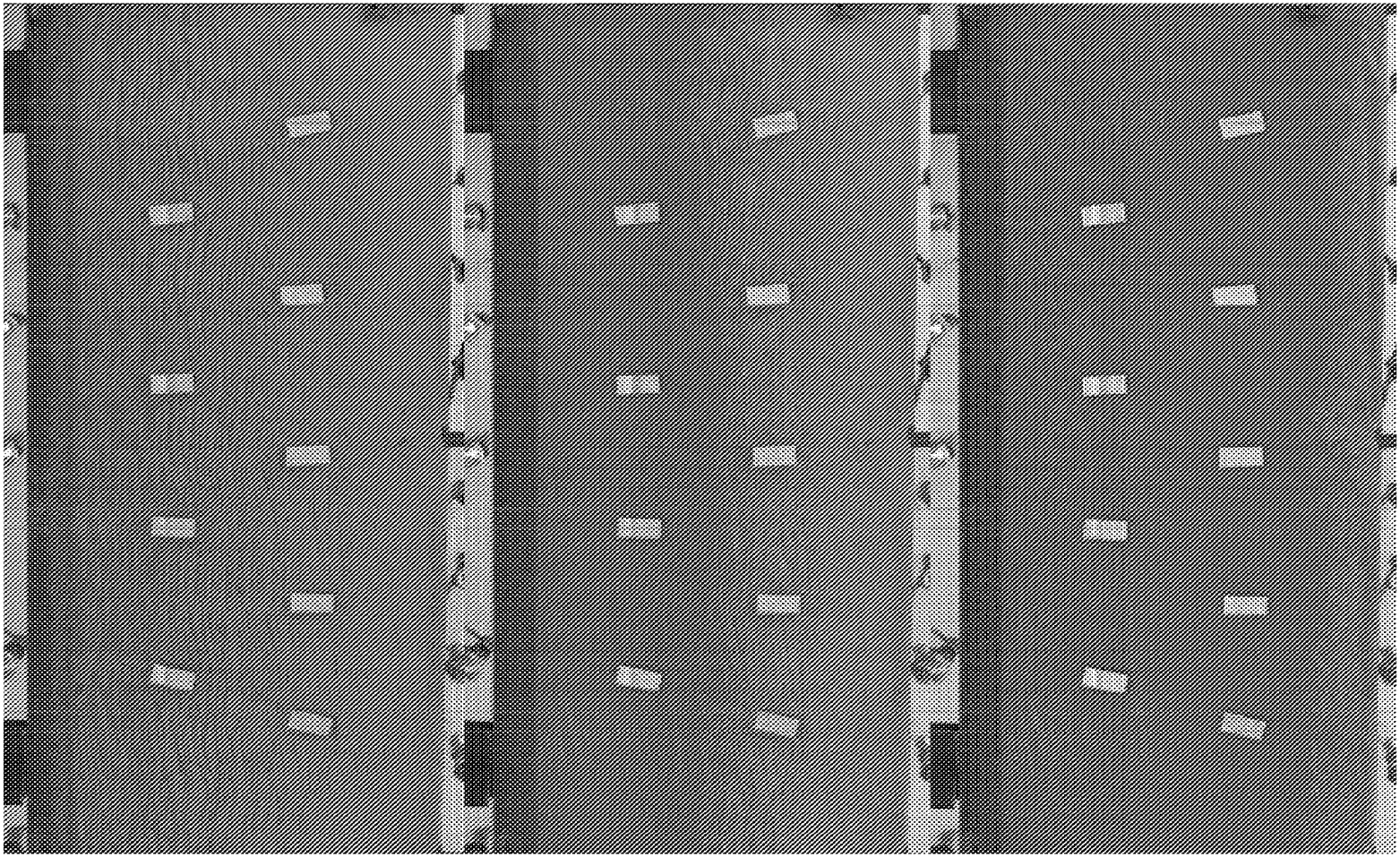
FIG. 47 is development of displacement front with GAGD well configuration (sequenced top to bottom).
Figure 48:
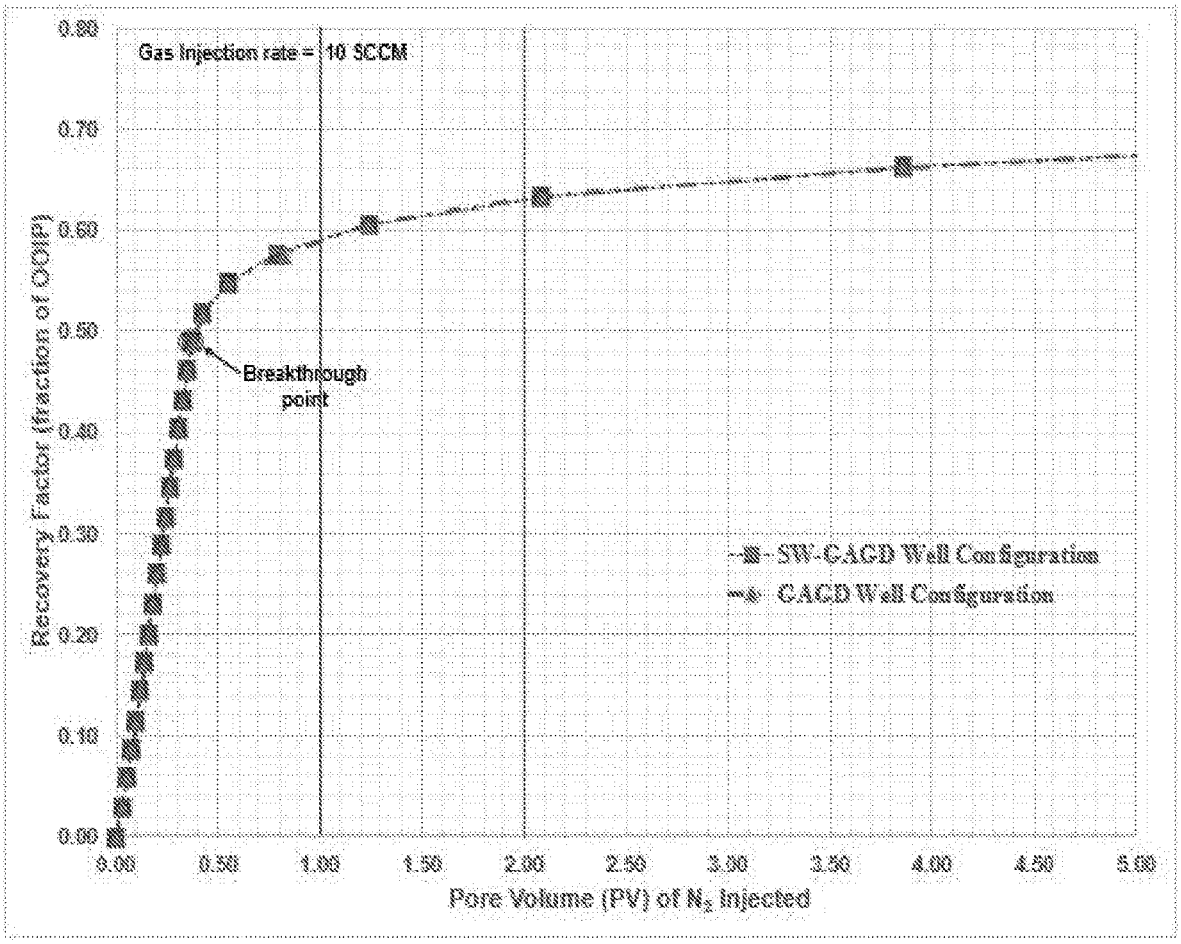
FIG. 48 is recovery plot for SW-GAGD Vs GAGD Injection.

FIGS. 46 and 47 show the development and progression of front in cases of SW-GAGD and GAGD, respectively. The progression of front was almost identical barring the initial part, thereby visually establishing the equivalence of the two processes. FIG. 48 shows the recovery plot for SW-GAGD and GAGD, juxtaposed on one another. The recovery plots exactly overlapped from the beginning till the very end, dispelling any doubts about under-performance of SW-GAGD process compared to GAGD process. Thus, we need not be fixated on the idea of having multiple vertical injectors for establishment of the gas zone at the top of the payzone. A single well in SW-GAGD configuration should be able to serve as well thereby saving greatly in terms of the cost. Only limiting factor in case of a SW-GAGD process compared to a GAGD process, would be the rate of gas injection, since a single well would be required to injected as much gas. But nowadays with the advances in horizontal well technology, that should not be a constraint, should it occur.

Toe-to-Heel Configuration

Figure 49:
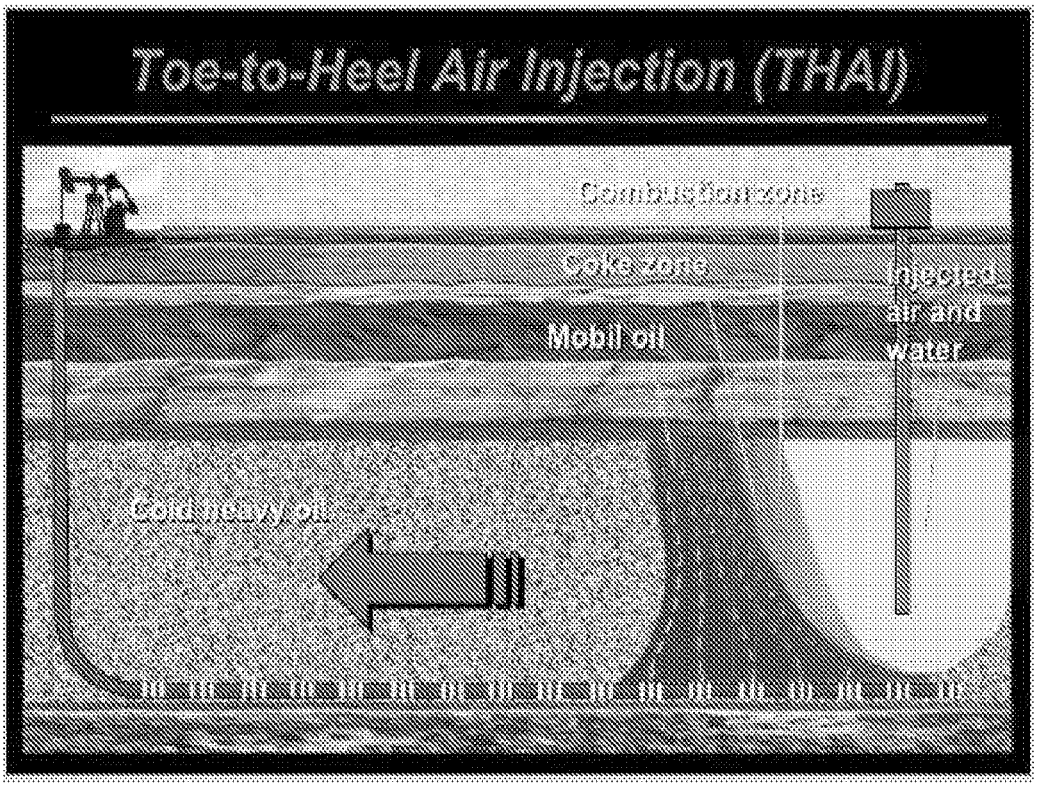
FIG. 49 is Toe-Heel Wells Configuration in use in a THAI process (Courtesy: Tor Bjornstad, IFE).
Figure 50:
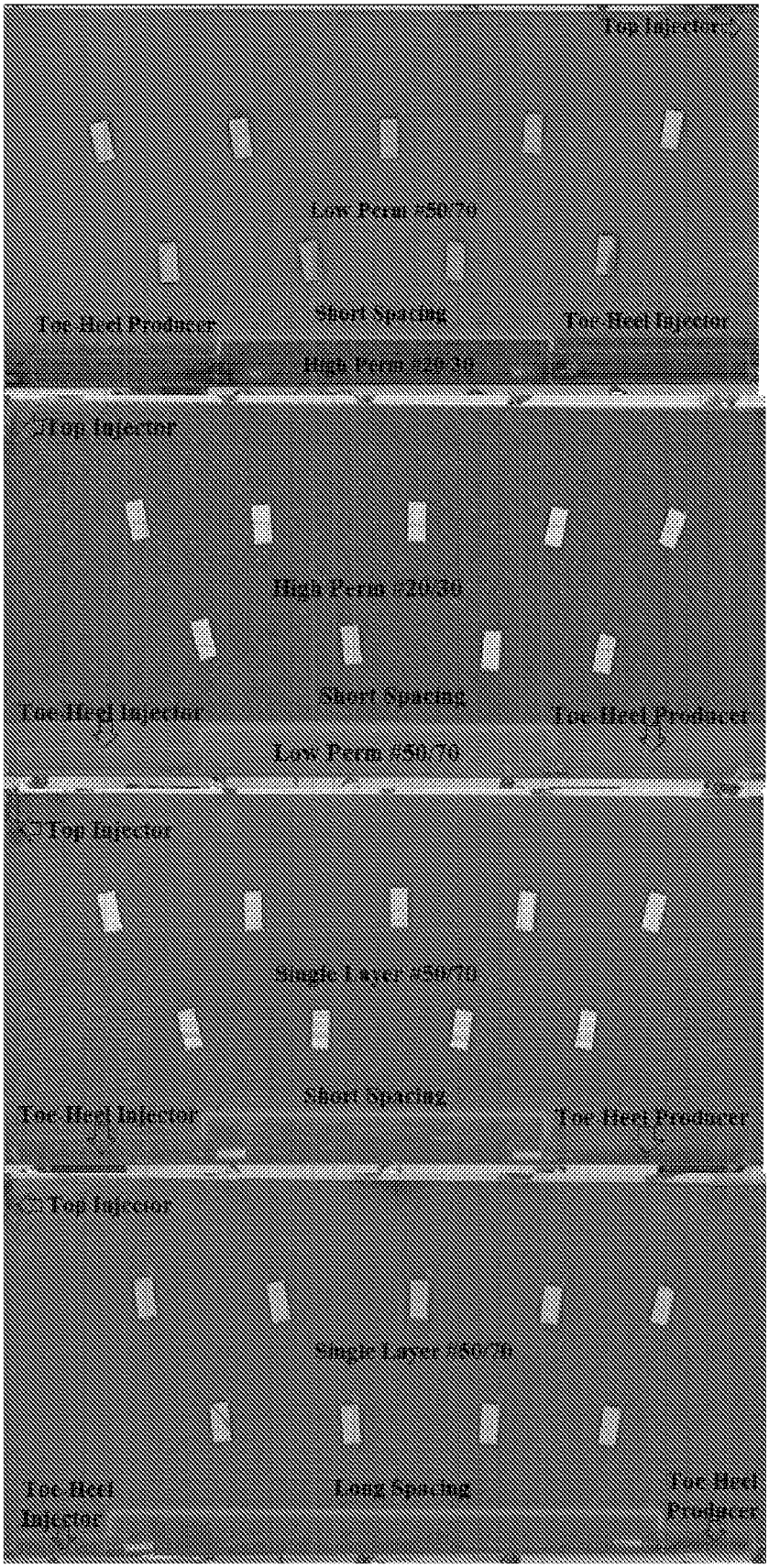
FIG. 50 is four (4) Different Toe-Heel Configurations (from top to bottom a, b, c and d respectively).

Toe-to-Heel is a very popular well configuration used in the recovery of heavy oil through Toe-to-Heel Air Injection (THAI) in-situ combustion (ISC) process. Since the completion technologies for such a configuration is already available in the industry, hence it was considered as a suitable candidate for the application of SW-GAGD process. FIG. 49 shows the Toe-Heel well configuration in use in a THAI process. For the purpose of SW-GAGD process, following four scenarios as depicted in FIG. 50 were evaluated:

1) Single Layer, Short Spaced: Model comprises of a single sand size (#50/70), giving uniform permeability throughout the model. Toe-Heel separation is SHORT (arbitrary relative to LONG) as shown in FIG. 50[c].
2) Single Layer, Long Spaced: Model comprises of a single sand size (#50/70), giving uniform permeability throughout the model. Toe-Heel separation is LONG (arbitrary relative to SHORT) as shown in FIG. 50[d].
3) Bi-Layered with higher permeable layer at the bottom, Short Spaced: Model comprises of 2 layers with smaller sand grain size (#50/70) on top and larger sand grain size (#20/30) at the bottom, giving higher permeability to the bottom layer. Also, Toe-Heel separation is SHORT (arbitrary relative to LONG) as shown in FIG. 50[a].
4) Bi-Layered with lower permeable layer at the bottom, Short Spaced: Model comprises of 2 layers with larger sand grain size (#20/30) on top and smaller sand grain size (#50/70) at the bottom, giving lower permeability to the bottom layer. Also, Toe-Heel separation is SHORT (arbitrary relative to LONG) as shown in FIG. 50[b].

Each of these four scenarios given above were investigated to evaluate the effect of layering and spacing in the performance of SW-GAGD Toe-Heel configuration. Effect of layering was important as the reservoir, as we know it, is layered with varying permeability between layers. Only two (2) cases of spacing, namely, SHORT and LONG (arbitrarily) were considered to understand the effect of spacing, if any, in the progression of a SW-GAGD process in Toe-Heel well configuration. Even though the aim is to investigate Toe-Heel configuration, nevertheless, a top injector was included in each case for performance comparison.

Figure 51:
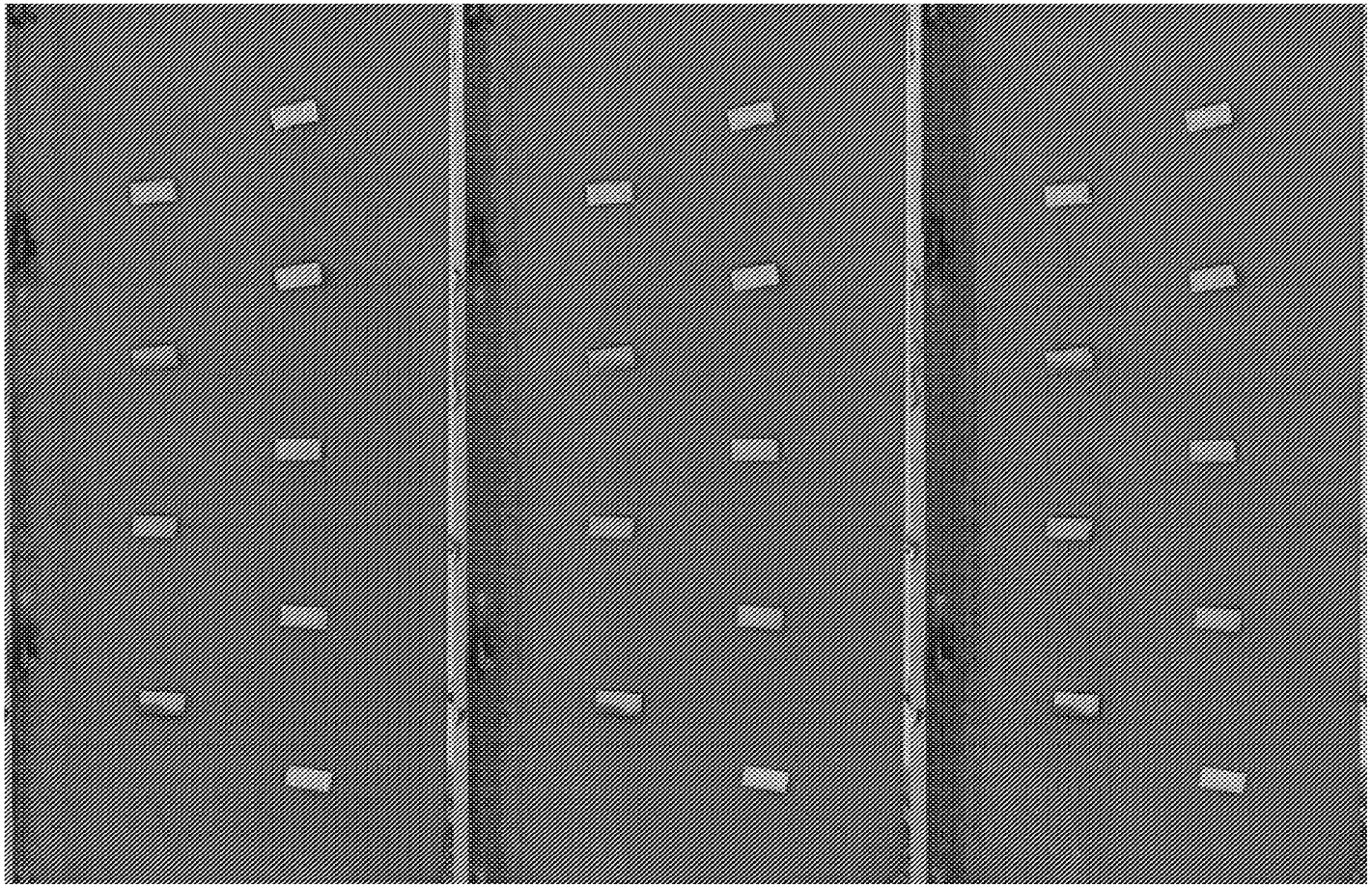
FIG. 51 is progression of production in a Layered Short Spaced Toe-Heel model with High Perm Bottom Layer (sequentially from top to bottom a, b, and c respectively).
Figure 52:
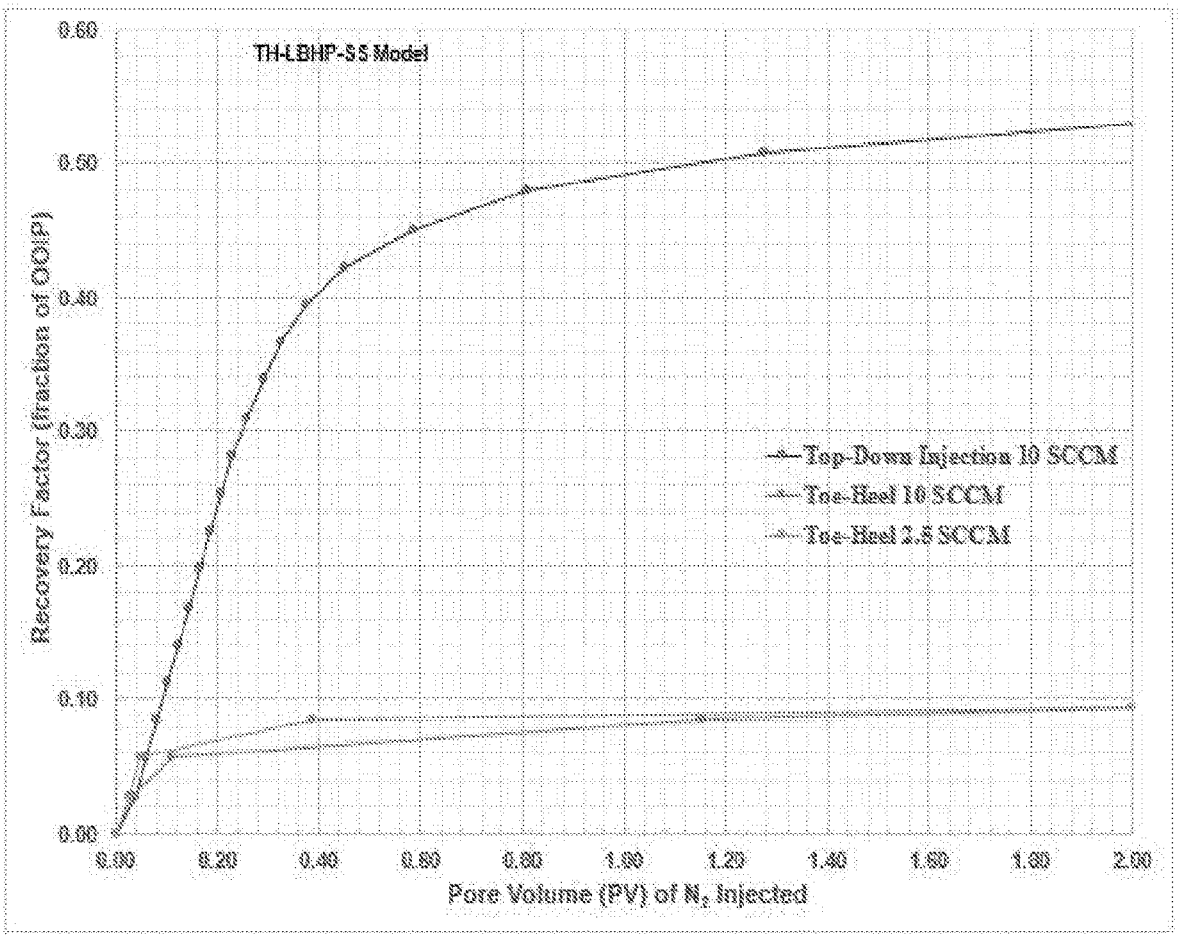
FIG. 52 is recovery plot for Toe-Heel Layered Bottom High Perm, Short Spaced (TH-LBHP-SS) Model.

Bi-Layered with high permeable layer at the bottom, Short spaced The progression of the SW-GAGD process is shown in FIG. 51(*a*) to (*c*). It was observed that because of high permeability near the horizontal well, the injected gas short circuited to the production well, with little change in oil saturation in the rest of the model at the top.

Figure 24:
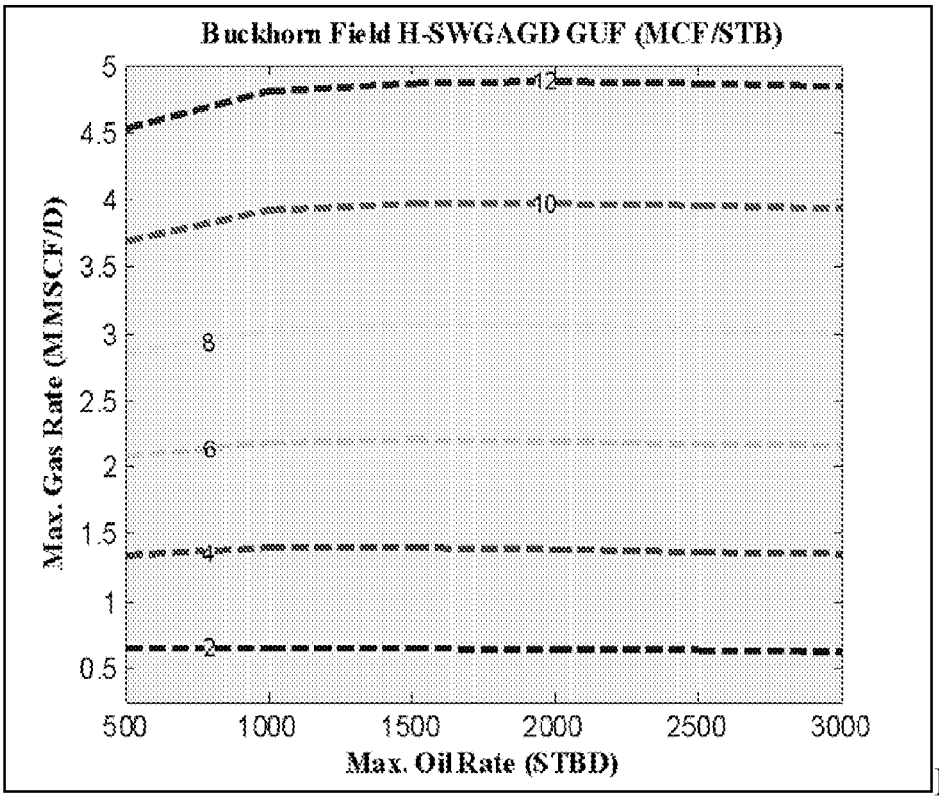
FIG. 24 is a Horizontal SW-GAGD GUF vs. Oil Rate—Field Model.

The injected gas was seen to sweep most of the bottom high permeable layer. This can be inferred from the total absence of red dyed color in the bottom layer of the model. For the case of our model, little amount of oil remained trapped in between the Toe and Heel of the well. Since in an actual field setting, a Toe-Heel configuration looks like shown in FIG. 24, with injection tubing running concentric to the production annulus, such trapping is unlikely to occur. Less than 8% of OOIP was recovered at 1 PV of gas injection at an injection rate of 10 SCCM. Even a lower rate of 2.5 SCCM did not make any difference to the recovery factor. The rate did not seem to matter with respect to short-circuiting of injected gas to the production well. What seemed to matter was the permeability of the layer surrounding the well vis-à-vis permeability of the rest of the model. The oil recovered was commensurate to what was present in the bottom layer of the model. FIG. 27 compares the recovery for 2 Toe-Heel cases with a Top-Down injection from the top injection well.

Single Layered, Short Spaced Toe-Heel Model

Figure 53:
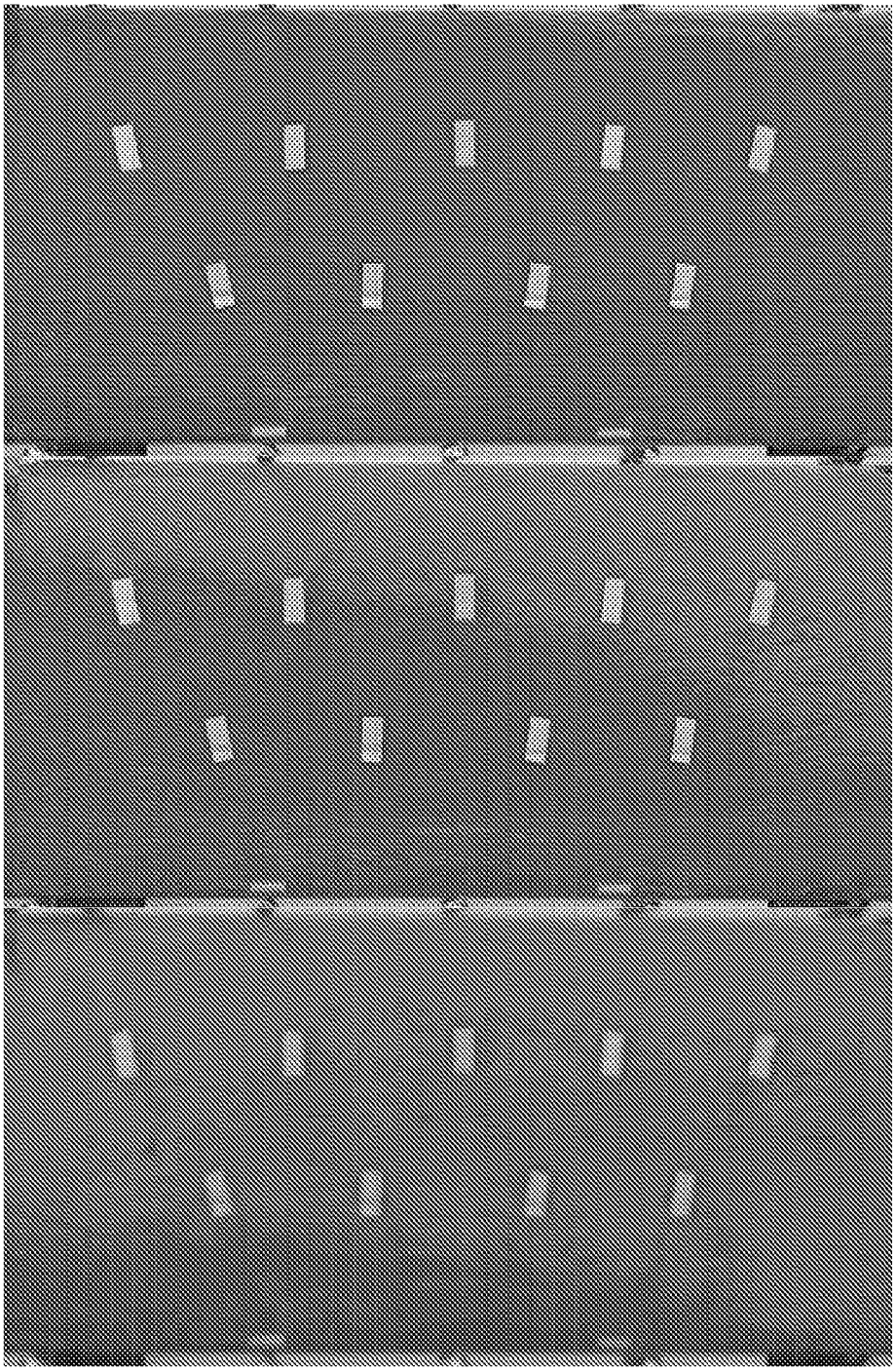
FIG. 53 is development of displacement front of a Single Layered Short Spaced Toe-Heel model (sequentially from top to bottom, a, b, and c respectively).

The progression of the SW-GAGD process in this case is shown in FIG. 53(*a*) to (*c*). Short circuiting of injected gas was not observed, unlike the previous case with high permeable bottom layer.

The injected gas from the Toe was seen to rise to the very top of the model before moving down in a gravity stable top-down displacement front. Significant oil was produced from the Heel. The recovery profile in this case was similar to that from a top-down injection from the top injector well. Toe-Heel configuration in this case performed as well as in Top-Down injection through the top injection well. In all the three cases, however, tilting of the front towards the Heel (production side) was seen.

Single Layered, Long Spaced Toe-Heel Model

The progression of the SW-GAGD process was similar to its short spaced counterpart and there was no short-circuiting as well. However, the tilting of the displacement front was even more acute in this case because of even shorter Heel length. Recovery profile between both Toe-Heel injection rates of 2.5 and 10 SCCM Vs Top-down injection rate of 10 SCCM were very similar. Thus in case of single layer, long or short spacing did not seem to matter in terms of short circuiting. Short circuiting was not present in case of a single layer model.

Bi-Layered with Low Permeable Layer at the Bottom, Short Spaced

Figure 54:
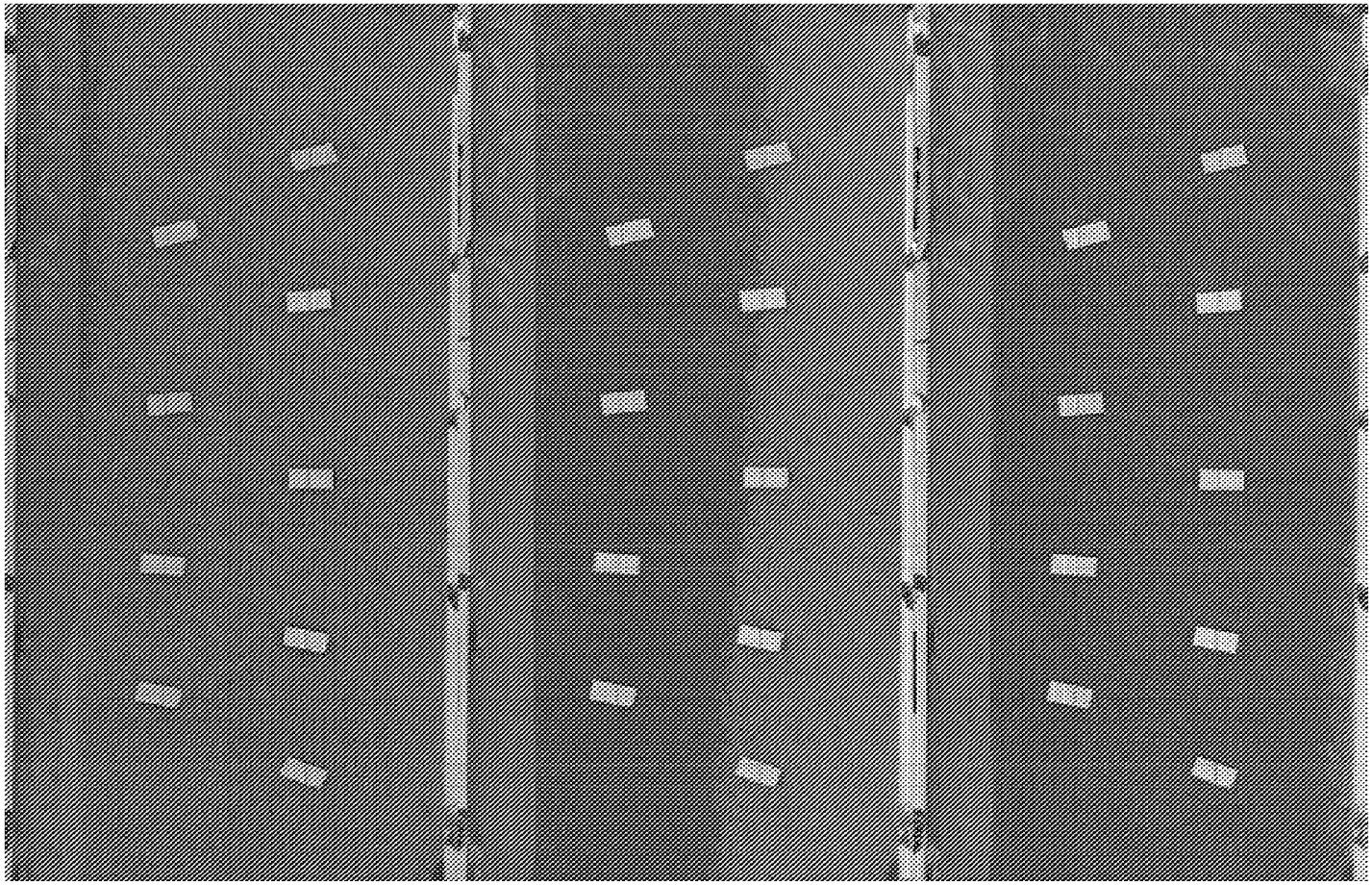
FIG. 54 is development of displacement front in a Layered Short Spaced Toe-Heel model with High Perm Bottom Layer (sequentially from top to bottom, a, b, and c respectively).

The progression of the SW-GAGD process is shown in FIG. 54(*a*) to (*c*). Unlike in the case Bilayered with High Permeable Layer at the Bottom, Short Spaced, short circuiting was not observed even though the permeability of the area near was different, albeit lower, than the rest of the model. The injected gas was seen to rise through the high permeable upper layer to the top forming a gas zone at the top before moving down in a top-down displacement. Thus it can be safely inferred that as long as the permeability of the zone near the horizontal well is lower than the top layers, there will be not be any short circuiting.

Another interesting observation was the development of near flat displacement front unlike that in cases described in the paragraphs under, Singled Layered Short Spaced Toe Heel Model and the paragraph under Single Layered, Long Spaced Toe-Heel Model. Even though the Toe-Heel configuration was similar between cases described in Singled Layered Short Spaced Toe Heel Model, Single Layered, Long Spaced Toe-Heel Model, and the paragraphs under Bilayered with Low Permeable Layer at Bottom, Short Spaced, the inclination of the gas-oil displacement front for the case described Bilayered with Low Permeable Layer at Bottom, Short Spaced, was in stark contrast to cases described Singled Layered Short Spaced Toe Heel Model and Single Layered, Long Spaced Toe-Heel Model. Low permeable zone near the production well, acted to flatten out the displacement front as can be seen from FIG. 54(*a*) to (*c*).

Figure 55:
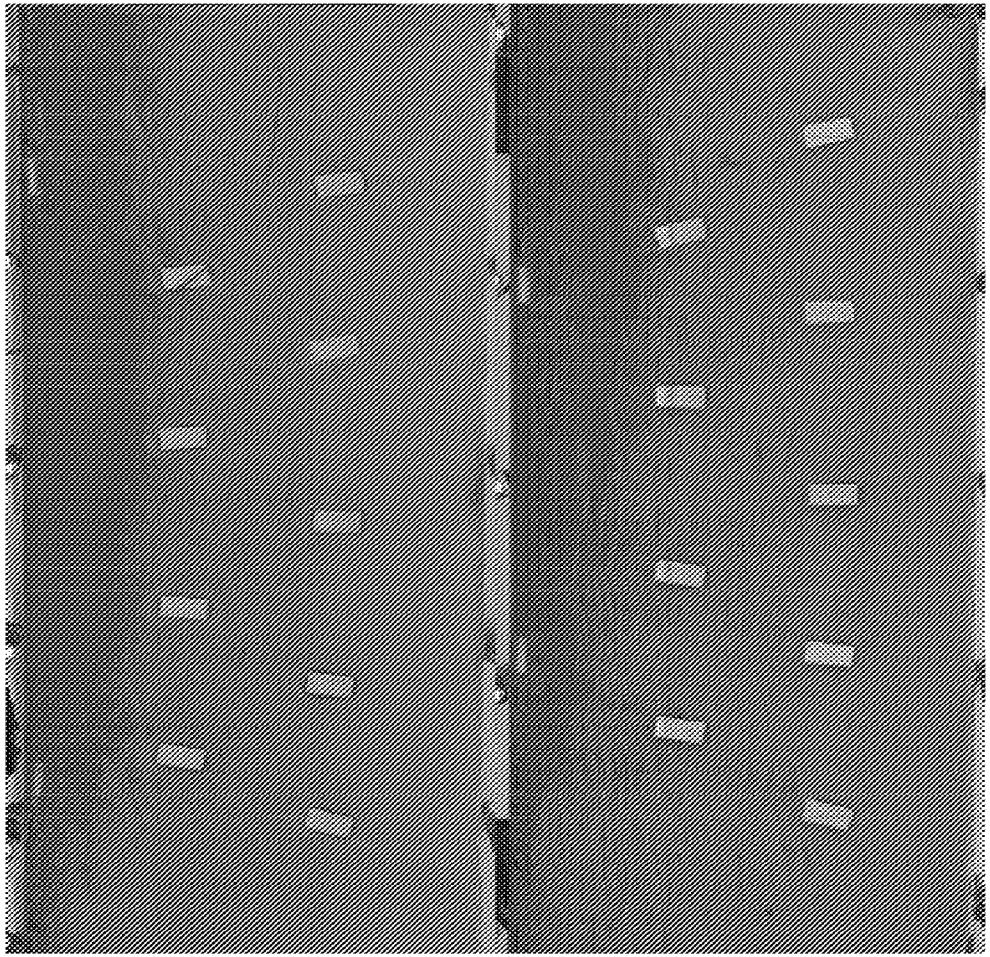
FIG. 55 is displacement front post breakthrough for Single Layered Toe-Heel models Top (Short Spaced) and Bottom (Long Spaced).

FIG. 55 shows the gas-oil displacement profile post breakthrough for cases described in Singled Layered Short Spaced Toe Heel Model and Single Layered, Long Spaced Toe-Heel Model respectively. We can see that, the displacement fronts are much more inclined in them compared to case described in Bilayered with Low Permeable Layer at Bottom, Short Spaced.

It was also observed that the gas-oil displacement front preferred to first sweep the upper higher permeable layer than to move into the bottom lower permeable layer. This is because of higher frictional resistance for the gas to flow in the low permeable layer. This preference of the injected gas leads to much better sweep of the upper high permeable layer. This observation can be utilized to design a SW-GAGD process to get much better sweep of the model even in case of immiscible gas-injection. If we can design a lower permeable zone near the horizontal wellbore, facilitating significant better sweep of the upper layers before having a full blown gas breakthrough to the production well.

Thus in summary we can say, a Toe-to-Heel configuration or any other configuration involving bottom injection of the gas is fraught with risk of short-circuiting to the production well if the injected layer has a lower permeability than the upper layers. Hence, layering of the reservoir will be a critical issue in case of any effort at bottom injection. Top point injection seems to be the safest bet immune to layering of the reservoir. With this additional knowledge, we are able to design a SW-GAGD configuration, immune to reservoir layering and performing a much better sweep even in immiscible mode gas injection.

What is claimed is:

1. A process for producing oil from a single well drilled into a subterranean hydrocarbon-bearing reservoir having a payzone; said process comprising:

a) injecting a gas into the reservoir through perforations in the single well in an upper portion of the payzone at an injection rate sufficient for the gas to push hydrocarbons throughout the reservoir downward while the gas remains substantially above the hydrocarbons, wherein the injection rate is about 0.25 MMSCF/day to about 3 MMSCF/day; and b) removing displaced hydrocarbons from the reservoir using one or more horizontal producer laterals positioned near the bottom of the payzone and drilled from the single well, wherein each lateral is adapted to produce oil from the payzone to the surface.

2. The process as recited in claim 1, wherein the gas comprises at least one of natural gas, methane, ethane, propane, carbon dioxide, nitrogen, flue gas, and air.

3. The process as recited in claim 1, wherein the gas is carbon dioxide.

4. The process as recited in claim 1, wherein the gas is nitrogen.

5. A process for producing oil from a single well with an upper vertical portion with one or more horizontal lateral portions comprising a heel at the vertical portion and a toe at its terminal distal end drilled into a subterranean hydrocarbon-bearing reservoir having a payzone; said process comprising:

(a) injecting a gas into the reservoir through perforations near the toe of the one or more lateral portions at an injection rate sufficient to induce oil sweeping effects in the reservoir toward the heel of the one or more lateral portions, wherein the injection rate is about 0.25 MMSCF/day to about 3 MMSCF/day; and (b) removing displaced hydrocarbons from the reservoir using perforations located near the heel of the one or more horizontal laterals positioned near the bottom of the payzone and drilled from the single well, wherein the heel of the one or more laterals is adapted to produce oil from the payzone to the surface.

6. The process as recited in claim 5, wherein the gas comprises at least one of natural gas, methane, ethane, propane, carbon dioxide, nitrogen, flue gas, and air.

7. The process as recited in claim 5, wherein the gas is carbon dioxide.

8. The process as recited in claim 5, wherein the gas is nitrogen.

* * * * *